US007789478B2

(12) United States Patent
Nakano et al.

(10) Patent No.: US 7,789,478 B2
(45) Date of Patent: Sep. 7, 2010

(54) PRINTING METHOD, PRINTING SYSTEM AND METHOD FOR DETERMINING CORRECTION VALUE

(75) Inventors: Tatsuya Nakano, Nagano-ken (JP); Masahiko Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/422,413

(22) Filed: Apr. 13, 2009

(65) Prior Publication Data

US 2009/0201331 A1 Aug. 13, 2009

Related U.S. Application Data

(62) Division of application No. 11/512,206, filed on Aug. 30, 2006, now Pat. No. 7,549,721.

(30) Foreign Application Priority Data

Aug. 31, 2005 (JP) ..... 2005-251345
Aug. 31, 2005 (JP) ..... 2005-251346
Aug. 31, 2005 (JP) ..... 2005-251347

(51) Int. Cl.
*B41J 29/393* (2006.01)

(52) U.S. Cl. ..... 347/19

(58) Field of Classification Search ..... 347/19, 347/12, 15, 40, 43; 358/504
See application file for complete search history.

(56) References Cited

U.S. PATENT DOCUMENTS 6,726,303 B2 * 4/2004 Otsuki ..... 347/19
6,739,699 B1 * 5/2004 Sender et al. ..... 347/43
6,942,313 B2 9/2005 Kanda
6,979,890 B2 12/2005 Kambe et al.
7,101,017 B2 9/2006 Endo et al.
7,377,613 B2 * 5/2008 Yamazaki et al. ..... 347/19

(Continued)

FOREIGN PATENT DOCUMENTS

JP 2002-280250 A 9/2002

(Continued)

*Primary Examiner*—Lamson D Nguyen
(74) *Attorney, Agent, or Firm*—Sughrue Mion, PLLC

(57) ABSTRACT

A medium is carried to a predetermined position in a carrying direction. A first pattern is formed on the medium with nozzles on the carrying direction upstream side of a nozzle row constituted by a plurality of nozzles lined up at predetermined intervals. After forming the first pattern, the medium is carried in the carrying direction by a target carry amount that is shorter than the length in the carrying direction of the nozzle row. Along with forming on the medium a second pattern that forms a boundary with the first pattern with nozzles on the carrying direction downstream side of the nozzle row, a third pattern is formed on the medium with the nozzles on the carrying direction upstream side of the nozzle row. After forming the second pattern, the medium is carried in the carrying direction by a target carry amount that is shorter than the length in the carrying direction of the nozzle row so that a carry amount of the medium after forming the first pattern is longer than the length in the carrying direction of the nozzle row. A fourth pattern that forms a boundary with the third pattern is formed on the medium with the nozzles on the carrying direction downstream side of the nozzle row.

20 Claims, 26 Drawing Sheets

U.S. PATENT DOCUMENTS

| | | | | |
|---|---|---|---|---|
| 7,549,721 | B2 * | 6/2009 | Nakano et al. | 347/19 |
| 2005/0207091 | A1 | 9/2005 | Kambe et al. | |

FOREIGN PATENT DOCUMENTS

| | | | |
|---|---|---|---|
| JP | 2003-237154 | A | 8/2003 |
| JP | 2004-228190 | A | 8/2004 |
| JP | 2005-039217 | A | 2/2005 |
| JP | 2005-039243 | A | 2/2005 |

* cited by examiner

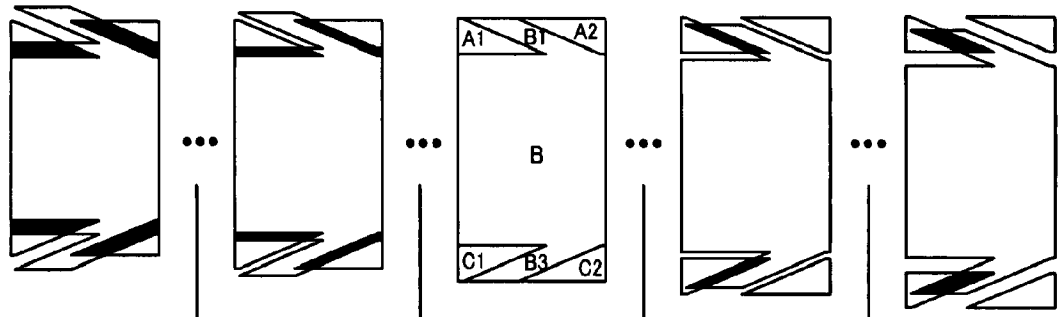

| | −8 | −4 | 0 | +4 | +8 |
|---|---|---|---|---|---|
| | Position of pattern B is shifted by −8/4320 inches with respect to pattern A (becomes closer by 8/4320 inches) | Position of pattern B is shifted by −4/4320 inches with respect to pattern A (becomes closer by 4/4320 inches) | | Position of pattern B is shifted by +4/4320 inches with respect to pattern A (becomes more distant by 4/4320 inches) | Position of pattern B is shifted by +8/4320 inches with respect to pattern A (becomes more distant by 8/4320 inches) |
| | Position of pattern C is shifted by −8/4320 inches with respect to pattern B (becomes closer by 8/4320 inches) | Position of pattern C is shifted by −4/4320 inches with respect to pattern B (becomes closer by 4/4320 inches) | | Position of pattern C is shifted by +4/4320 inches with respect to pattern B (becomes more distant by 4/4320 inches) | Position of pattern C is shifted by +8/4320 inches with respect to pattern B (becomes more distant by 8/4320 inches) |
| Boundary A1B1 | light | slightly light | unrecognizable | slightly dark | dark |
| Boundary A2B1 | dark | slightly dark | unrecognizable | slightly light | light |
| Boundary C1B3 | light | slightly light | unrecognizable | slightly dark | dark |
| Boundary C2B3 | dark | slightly dark | unrecognizable | slightly light | light |

Fig.19

PRINTING METHOD, PRINTING SYSTEM AND METHOD FOR DETERMINING CORRECTION VALUE

CROSS-REFERENCE TO RELATED APPLICATIONS

This is a Divisional application of U.S. application Ser. No. 11/512,206 filed Aug. 30, 2006, which claims priority upon Japanese Patent Application Nos. 2005-251345, 2005-251346 and 2005-251347 filed on Aug. 31, 2005. The entire disclosure of the prior applications are herein incorporated by reference in their entirety.

BACKGROUND

1. Technical Field

The present invention relates to printing methods, printing systems, and methods for determining correction values.

2. Related Art

A printing apparatus such as an inkjet printer prints an image to be printed on a medium (such as paper, a cloth and an OHP sheet) by alternately repeating a dot forming process for forming dots by ejecting ink from a moving head, and a carrying process for carrying the medium in a carrying direction. In such a printing apparatus, a carry roller for performing a carrying process is provided. When the carry roller is rotated by a predetermined rotation amount, the medium is carried by a predetermined carry amount.

However, even if the carry roller is rotated by a rotation amount corresponding to a carry amount to be achieved (target carry amount), during the carrying process, the medium may not be carried by such a targeted carry amount. Therefore, in order to reduce such a carrying error, correction of the target carry amount is performed. Further, since the carrying error varies depending on the position on the circumferential surface of the carry roller used in the carrying process, a technique in which correction values are changed according to the circumferential surface used, etc. is also employed (see JP-A-2003-237154).

SUMMARY (1) When determining a correction value for a certain target carry amount, a first pattern is initially formed and after a medium is carried by such a target carry amount, a second pattern is formed. The interval between the first pattern and the second pattern is determined based on the state of the boundary between the first pattern and second pattern, and the correction value is determined.

However, when the target carry amount subject to correction is longer than the length in the carrying direction of a nozzle row, the first pattern and the second pattern are formed distant from each other, failing in forming a boundary therebetween, which makes it difficult to determine the interval therebetween.

Accordingly, the object of a primary aspect of the present invention is, even in a case where the target carry amount subject to correction is longer than the length in the carrying direction of the nozzle row, to enable determination of the correction value for correcting that target carry amount.

A primary aspect of the present invention for achieving the above-described object is characterized in (A) carrying a medium to a predetermined position in a carrying direction, (B) forming a first pattern on the medium with at least one nozzle on the carrying direction upstream side of a nozzle row constituted by a plurality of nozzles lined up at predetermined intervals, (C) after forming the first pattern, carrying the medium in the carrying direction by a target carry amount that is shorter than the length in the carrying direction of the nozzle row, (D) along with forming on the medium a second pattern that forms a boundary with the first pattern with at least one nozzle on the carrying direction downstream side of the nozzle row, forming on the medium a third pattern with the at least one nozzle on the carrying direction upstream side of the nozzle row, (E) after forming the second pattern, carrying the medium in the carrying direction by a target carry amount that is shorter than the length in the carrying direction of the nozzle row, so that a carry amount of the medium after forming the first pattern is longer than the length in the carrying direction of the nozzle row, and (F) forming on the medium a fourth pattern that forms a boundary with the third pattern with the at least one nozzle on the carrying direction downstream side of the nozzle row.

(2) When determining a correction value for a certain target carry amount, a plurality of correction patterns are printed on a medium along a predetermined direction in order of associated correction values. Then, a predetermined portion of the correction patterns are inspected to select a correction pattern in which that portion is in a suitable condition.

However, if there are two or more correction patterns in which the portion subjected to be inspected is in a suitable condition, which correction pattern should be selected is a problem. Especially, when the correction pattern contains two or more portions to be inspected, if there are two or more correction patterns in which one of the portions is in a suitable condition, and there are also two or more correction patterns in which the other portion is in a suitable condition, it is possible that a suitable correction value cannot be determined depending on a selection method of the correction pattern.

Accordingly, the object of a second aspect of the present invention is to select the correction pattern so as to determine a suitable correction value.

A second aspect of the present invention for achieving the above-described object includes (1) printing a plurality of correction patterns along a predetermined direction in order of associated correction values; (2) selecting a first correction pattern from among a plurality of the correction patterns based on results obtained by inspecting a part of each of the correction patterns; (3) selecting a second correction pattern from among a plurality of the correction patterns based on results obtained by inspecting a part other than the part of each of the correction patterns; and (4) determining a correction value used in printing that is a value between a correction value associated with the first correction pattern and a correction value associated with the second correction pattern, (5) if two or more correction patterns become possible choices in selecting the first correction pattern, a correction pattern on one end's side of the predetermined direction is preferentially selected, and (6) if two or more correction patterns become possible choices in selecting the second correction pattern, a correction pattern on the other end's side of the predetermined direction is preferentially selected.

(3) When determining a correction value for a certain target carry amount, a first pattern is initially formed and after a medium is carried by such a target carry amount, a second pattern is formed. Then, the interval between the first pattern and the second pattern is determined based on the state of the boundary between the first pattern and second pattern, and the correction value is determined.

However, it becomes difficult to determine the interval between the two patterns if visibility of the boundary is poor.

Accordingly, the object of a third aspect of the present invention is to improve the visibility of the boundary of two patterns.

A third aspect of the present invention for achieving the above-described object is characterized in (1) carrying a medium to a predetermined position in a carrying direction, (2) forming a first pattern made up of a plurality of dot rows along the movement direction with at least one nozzle on the carrying direction upstream side of a nozzle row that moves, by moving in a movement direction the nozzle row constituted by a plurality of nozzles lined up at predetermined intervals, (3) carrying the medium in the carrying direction by a predetermined target carry amount, and (4) forming a second pattern made up of a plurality of dot rows along the movement direction with at least one nozzle on the carrying direction downstream side of the nozzle row that moves in the movement direction, (5) wherein a boundary between the first pattern and the second pattern is formed along a direction that intersects the carrying direction and the movement direction.

Other features of the present invention will become clear by reading the description of the present specification with reference to the accompanying drawings.

BRIEF DESCRIPTION OF THE DRAWINGS

FIG. 19 is an explanatory diagram showing what the correction pattern is like when the carrying error is not present in both of DC component and AC component.

DESCRIPTION OF EXEMPLARY EMBODIMENTS

Figure 1:
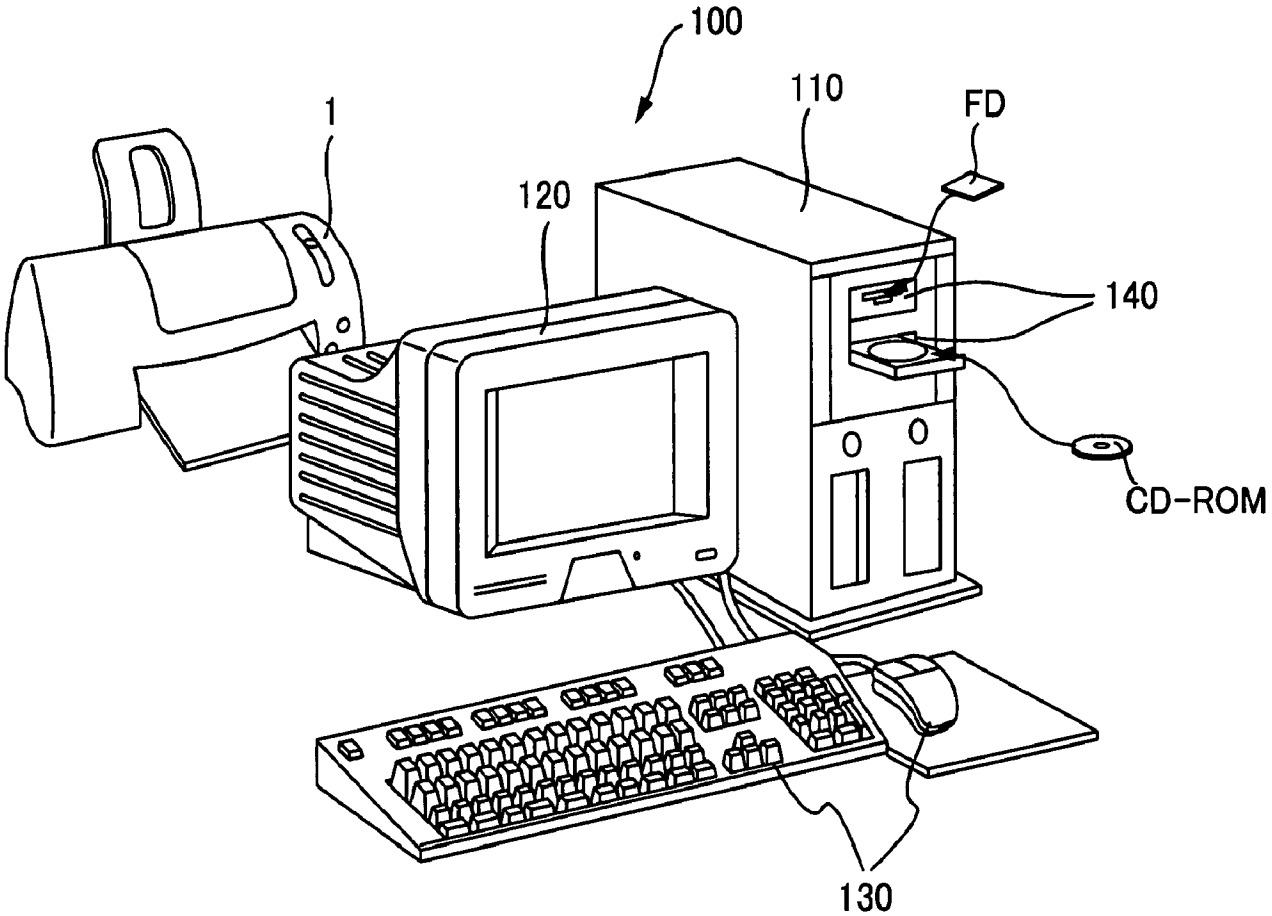
FIG. 1 is an explanatory diagram illustrating the overall configuration of a printing system.

At least the following matters will be made clear by the explanation in the present specification and the description of the accompanying drawings.

A printing method including:

carrying a medium to a predetermined position in a carrying direction;

forming a first pattern on the medium with at least one nozzle on the carrying direction upstream side of a nozzle row constituted by a plurality of nozzles lined up at predetermined intervals;

after forming the first pattern, carrying the medium in the carrying direction by a target carry amount that is shorter than the length in the carrying direction of the nozzle row;

along with forming on the medium a second pattern that forms a boundary with the first pattern with at least one nozzle on the carrying direction downstream side of the nozzle row, forming on the medium a third pattern with the at least one nozzle on the carrying direction upstream side of the nozzle row;

after forming the second pattern, carrying the medium in the carrying direction by a target carry amount that is shorter than the length in the carrying direction of the nozzle row, so that a carry amount of the medium after forming the first pattern is longer than the length in the carrying direction of the nozzle row; and forming on the medium a fourth pattern that forms a boundary with the third pattern with the at least one nozzle on the carrying direction downstream side of the nozzle row.

With such a printing method, it is possible to prepare a test sheet that can detect the carrying error when the medium is carried by a target carry amount that is longer than the length in the carrying direction the nozzle row.

It is preferable that a carry roller is rotated when the medium is carried, and the length in the carrying direction of the nozzle row is shorter than the length of a circumferential surface of the carry roller.

The present invention having such a configuration is particularly useful.

It is preferable that a carry roller is rotated when the medium is carried, and a carry amount of the medium after the first pattern is formed until formation of the third pattern is started corresponds to substantially a single rotation of the carry roller. In this way, it is possible to prepare a test sheet for correcting the target carry amount that corresponds to a single rotation of the carry roller. It should be noted that the carrying error generated when the medium is carried by a target carry amount that corresponds to a single rotation of the carry roller is constant regardless of the rotational position of the carry roller.

It is preferable that a carry amount of the medium after the first pattern is formed until formation of the second pattern is started corresponds to substantially a half rotation of the carry roller. Also, it is preferable that at least one nozzle for forming the first pattern is the same as the at least one nozzle for forming the third pattern, and the at least one nozzle for forming the second pattern is the same as the at least one nozzle for forming the fourth pattern. In this way, it becomes possible to form the boundary between the first pattern and second pattern and the boundary between the third pattern and fourth pattern in a similar manner.

A boundary is formed along a direction that intersects a movement direction in which the nozzle row moves. In this way, it is possible to prepare a test sheet in which determination of the boundary is easy. Also, it is preferable that the direction of the boundary between the first pattern and the second pattern intersects the direction of the boundary between the third pattern and the fourth pattern. In this way, it is possible to prepare the test sheet suitable for correcting the carrying error even if the ink ejection speed varies for each nozzle.

It is preferable that a correction value for a target carry amount is determined based on the boundary between the first pattern and the second pattern and the boundary between the third pattern and the fourth pattern. With such a printing method, it is possible to determine the correction value for correcting the target carry amount that is longer than the length in the carrying direction of the nozzle row.

It is preferable that a plurality of correction patterns including the first pattern to the fourth pattern are formed, a first correction pattern is selected from a plurality of the correction patterns based on a state of the boundary between the first pattern and the second pattern, a second correction pattern is selected from a plurality of the correction patterns based on a state of the boundary between the first pattern and the second pattern, and the correction value is determined based on the first correction pattern and the second correction pattern. In this way, it is possible to determine the correction value for correcting the target carry amount that is longer than the length in the carrying direction of the nozzle row.

It is preferable that a value between a correction value associated with the first correction pattern and a correction value associated with the second correction pattern is determined as the correction value. Further, it is preferable that a plurality of the correction patterns are lined up along a predetermined direction, when selecting the first correction pattern, a plurality of the correction patterns are inspected in order from one end of the predetermined direction, and when selecting the second correction pattern, a plurality of the correction patterns are inspected in order from the other end of the predetermined direction. In this way, the correction value that can accurately correct the carrying error can be determined.

It is preferable that a correction value for a target carry amount is determined based on the boundary between the first pattern and the second pattern and the boundary between the third pattern and the fourth pattern, and when the medium is carried to perform printing, a target carry amount is corrected and the medium is carried according to the corrected target carry amount. With such a printing method, high quality printed images can be obtained.

A printing system including:

a carry unit for carrying a medium to a predetermined position in a carrying direction; and a controller that causes the carry unit to carry the medium according to a target carry amount, and causes ink to be ejected from a nozzle row constituted by a plurality of nozzles lined up at predetermined intervals, wherein the controller causes a first pattern to be formed on the medium with at least one nozzle on the carrying direction upstream side of the nozzle row, after causing a first pattern to be formed, causes to carry the medium in the carrying direction by a target carry amount that is shorter than the length in the carrying direction of the nozzle row, along with causing to form on the medium a second pattern that forms a boundary with the first pattern with at least one nozzle on the carrying direction downstream side of the nozzle row, causes to form on the medium a third pattern with the at least one nozzle on the carrying direction upstream side of the nozzle row, after forming the second pattern, causes to carry the medium in the carrying direction by a target carry amount that is shorter than the length in the carrying direction of the nozzle row, so that a carry amount of the medium after forming the first pattern is longer than the length in the carrying direction of the nozzle row, and causes to form on the medium a fourth pattern that forms a boundary with the third pattern with the at least one nozzle on the carrying direction downstream side of the nozzle row.

With such a printing system, it is possible to correct the target carry amount that is longer than the length in the carrying direction of the nozzle row.

A method for determining a correction value, including:

printing a plurality of correction patterns along a predetermined direction in order of associated correction values;

selecting a first correction pattern from among a plurality of the correction patterns based on results obtained by inspecting a part of each of the correction patterns;

selecting a second correction pattern from among a plurality of the correction patterns based on results obtained by inspecting a part other than the part of each of the correction patterns; and determining a correction value used in printing that is a value between a correction value associated with the first correction pattern and a correction value associated with the second correction pattern, wherein if two or more correction patterns become possible choices in selecting the first correction pattern, a correction pattern on one end's side of the predetermined direction is preferentially selected, and if two or more correction patterns become possible choices in selecting the second correction pattern, a correction pattern on the other end's side of the predetermined direction is preferentially selected.

With such a method for determining a correction value, the correction value suitable for printing can be determined.

It is preferable that the correction pattern is constituted by a first pattern, a second pattern, a third pattern, and a fourth pattern, in selecting the first correction pattern, a boundary between the first pattern and the second pattern of each correction pattern is inspected, and in selecting the second correction pattern, a boundary between the third pattern and the fourth pattern of each correction pattern is inspected. Also, it is preferable that when the correction pattern is printed, (1) a medium is carried to a predetermined position in a carrying direction, (2) the first pattern is formed on the medium with at least one nozzle on the carrying direction upstream side of a nozzle row constituted by a plurality of nozzles lined up at predetermined intervals, (3) after forming the first pattern, the medium is carried in the carrying direction by a target carry amount that is shorter than the length in the carrying direction of the nozzle row, (4) along with forming on the medium the second pattern that forms a boundary with the first pattern with at least one nozzle on the carrying direction downstream side of the nozzle row, the third pattern is formed on the medium with the at least one nozzle on the carrying direction upstream side of the nozzle row, (5) after forming the second pattern, the medium is carried in the carrying direction by a target carry amount that is shorter than the length in the carrying direction of the nozzle row, and (6) the fourth pattern that forms a boundary with the third pattern is formed on the medium with the at least one nozzle on the carrying direction downstream side of the nozzle row. With the correction pattern prepared as described above, the correction value that corresponds to the target carry amount can be determined.

It is preferable that a carry amount of the medium after the first pattern is formed until the formation of the fourth pattern is started is longer than the length in the carrying direction of the nozzle row. The present invention having such a configuration is particularly useful.

It is preferable that the at least one nozzle for forming the first pattern and the at least one nozzle for forming the third pattern are the same, and the at least one nozzle for forming the second pattern and the at least one nozzle for forming the fourth pattern are the same. In this way, it becomes possible to form the boundary between the first pattern and second pattern and the boundary between the third pattern and fourth pattern in a similar manner.

It is preferable that the first pattern, the second pattern, the third pattern, and the fourth pattern are constituted by a plurality of dot rows, and the boundary is formed along a direction that intersects the direction of the dot rows. In this way, determination of the boundary state becomes easy. It is preferable that the direction of a boundary between the first pattern and the second pattern intersects the direction of a boundary between the third pattern and the fourth pattern. In this way, a suitable correction value can be determined even if the ink ejection speed varies for each nozzle.

It is preferable that a sensor that can move in the predetermined direction is used for inspecting the part and the part other than the part of the correction pattern, and in selecting the first correction pattern, the sensor moves in one direction of the predetermined direction, and in selecting the second correction pattern, the sensor moves in a direction opposite to the predetermined direction. In this way, the inspection can be conducted in a shorter time.

A printing method including:

carrying a medium to a predetermined position in a carrying direction;

forming a first pattern made up of a plurality of dot rows along the movement direction with at least one nozzle on the carrying direction upstream side of a nozzle row that moves, by moving in a movement direction the nozzle row constituted by a plurality of nozzles lined up at predetermined intervals;

carrying the medium in the carrying direction by a predetermined target carry amount; and forming a second pattern made up of a plurality of dot rows along the movement direction with at least one nozzle on the carrying direction downstream side of the nozzle row that moves in the movement direction, wherein a boundary between the first pattern and the second pattern is formed along a direction that intersects the carrying direction and the movement direction.

With such a printing method, a test sheet with good visibility of the boundary of two patterns can be prepared.

It is preferable that a first boundary and a second boundary are formed between the first pattern and the second pattern, at the first boundary, the first pattern is located further carrying direction upstream side than the second pattern, and at the second boundary, the second pattern is located further carrying direction upstream side than the first pattern. In this way, it is possible that both the white streak and black streak appear between the two patterns, thereby visibility is improved.

It is preferable that the first boundary and the second boundary are parallel to each other. In this way, since the white streak and the black streak appear to the same degree, visibility can be improved.

It is preferable that when the second pattern is formed, a third pattern is formed with the at least one nozzle on the carrying direction upstream side of the nozzle row, after forming the second pattern, the medium is carried in the carrying direction by a target carry amount that is shorter than the length in the carrying direction of the nozzle row so that a carry amount of the medium after forming the first pattern is longer than the length in the carrying direction of the nozzle row, and a fourth pattern that forms a boundary with the third pattern is formed on the medium with the at least one nozzle on the carrying direction downstream side of the nozzle row. In this way, it is possible to prepare a test sheet that can detect the carrying error when the medium is carried by a target carry amount that is longer than the length in the carrying direction the nozzle row.

It is preferable that a carry roller is rotated when the medium is carried, and the length in the carrying direction of the nozzle row is shorter than the length of a circumferential surface of the carry roller. The present invention having such a configuration is particularly useful.

It is preferable that a carry roller is rotated when the medium is carried, and a carry amount of the medium after the first pattern is formed until formation of the third pattern is started corresponds to substantially a single rotation of the carry roller. In this way, it is possible to prepare a test sheet for correcting the target carry amount that corresponds to a single rotation of the carry roller. It should be noted that the carrying error generated when the medium is carried by a target carry amount that corresponds to a single rotation of the carry roller is constant regardless of the rotational position of the carry roller.

It is preferable that a carry amount of the medium after the first pattern is formed until formation of the second pattern is started corresponds to substantially a half rotation of the carry roller. Also, it is preferable that the at least one nozzle for forming the first pattern is the same as the at least one nozzle for forming the third pattern, and the at least one nozzle for forming the second pattern is the same as the at least one nozzle for forming the fourth pattern. In this way, it becomes possible to form the boundary between the first pattern and second pattern and the boundary between the third pattern and fourth pattern in a similar manner.

It is preferable that the boundary between the third pattern and the fourth pattern is formed along a direction that intersects the carrying direction and the movement direction, and the direction of the boundary between the first pattern and the second pattern intersects the direction of the boundary between the third pattern and the fourth pattern. In this way, it is possible to prepare a test sheet suitable for correcting the carrying error even if the ink ejection speed varies for each nozzle.

It is preferable that a correction value for a target carry amount is determined based on the boundary between the first pattern and the second pattern, and the boundary is formed along a direction that intersects the carrying direction and the movement direction. With such a printing method, the correction value can be determined easily due to good visibility of the boundary.

It is preferable that a correction value for a target carry amount is determined based on the boundary between the first pattern and the second pattern, when the medium is carried to perform printing, a target carry amount is corrected and the medium is carried according to the corrected target carry amount, and the boundary is formed along a direction that intersects the carrying direction and the movement direction. With such a printing method, high quality printed images can be obtained.

A printing system including:

a carry unit for carrying a medium to a predetermined position in a carrying direction; and a controller that causes the carry unit to carry the medium according to a target carry amount, and that causes ink to be ejected from a nozzle row constituted by a plurality of nozzles lined up at predetermined intervals, wherein the controller causes to form a first pattern made up of a plurality of dot rows along the movement direction with at least one nozzle on the carrying direction upstream side of the nozzle row that moves, by causing the nozzle row to move in a movement direction, causes to carry the medium in the carrying direction by a predetermined target carry amount, and causes to form a second pattern made up of a plurality of dot rows along the movement direction with at least one nozzle on the carrying direction downstream side of the nozzle row that moves in the movement direction, and wherein a boundary between the first pattern and the second pattern is caused to be formed along a direction that intersects the carrying direction and the movement direction.

With such a printing system, visibility of the boundary of two patterns can be improved.

Configuration of the Printing System

An embodiment of the printing system is described next with reference to drawings. It should be noted that the following description of the embodiment includes embodiments involving a computer program, storing medium on which a computer program is stored and the like.

FIG. 1 is an explanatory diagram illustrating an external configuration of the printing system. The printing system 100 includes a printer 1, a computer 110, a display device 120, an input device 130, and a recording and reproduction device 140. The printer 1 is a printing apparatus that prints images on a medium such as paper, a cloth or a film. The computer 110 is communicably connected to the printer 1, and outputs to the printer 1 print data corresponding to an image to be printed so as to cause the printer 1 to print that image.

A printer driver is installed on the computer 110. The printer driver is a program for causing the display device 120 to display a user interface and for converting image data output from an application program to print data. The printer driver is stored on the storing medium such as a flexible disk FD or CD-ROM (computer-readable storing medium). The printer driver can be also downloaded to the computer 110 via the Internet. The program is constituted by codes for realizing various functions.

The "printing apparatus" means an apparatus that prints images on a medium and includes, for example, the printer 1. The "print control device" means a device that controls the printing apparatus and includes, for example, a computer on which a printer driver is installed. The "printing system" means a system including at least a printing apparatus and a print control device.

Description of the Printer

<Regarding the Configuration of the Inkjet Printer>

Figure 2:
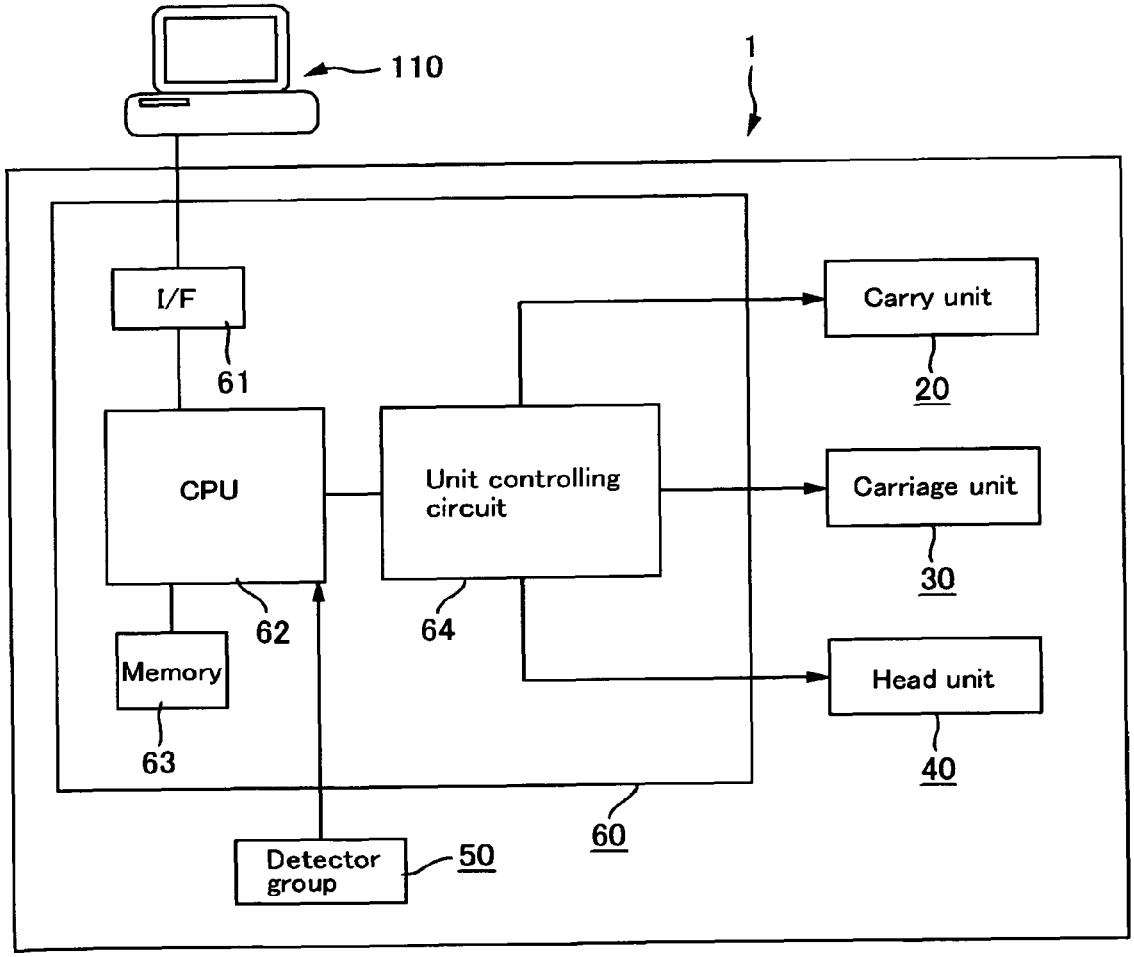
FIG. 2 is a block diagram of the overall configuration of a printer 1.
Figure 3A:
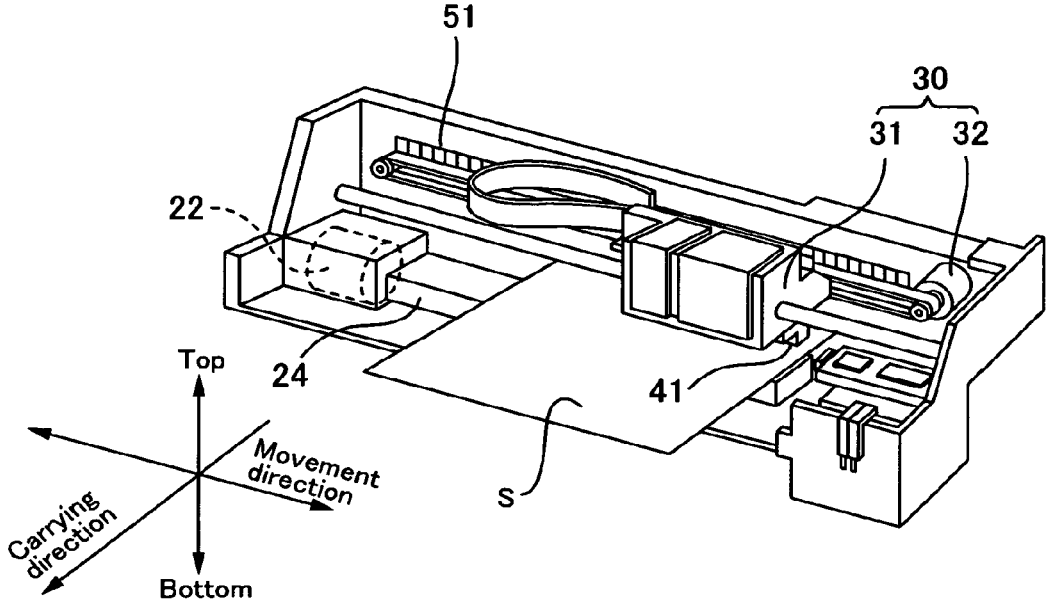
FIG. 3A is a schematic view of the overall configuration of the printer 1.
Figure 3B:
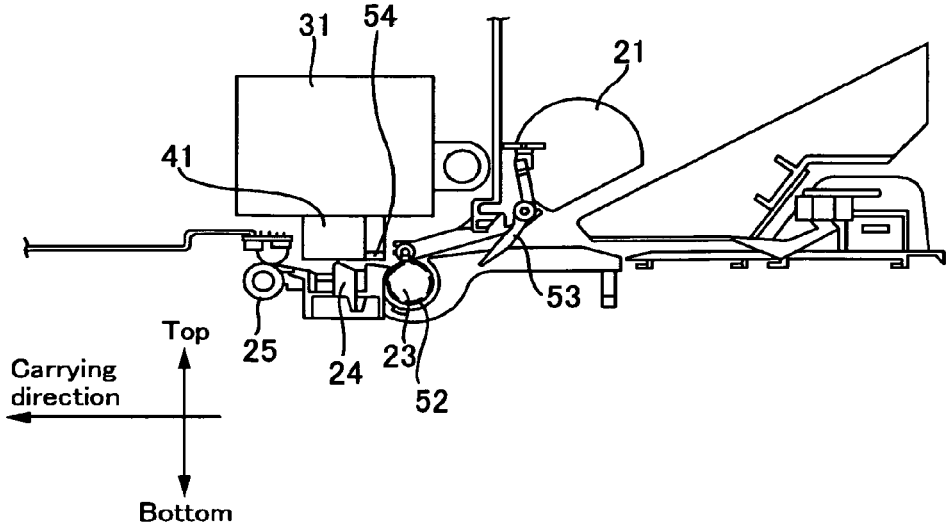
FIG. 3B is a transverse cross-sectional view of the overall configuration of the printer 1.

FIG. 2 is a block diagram of the overall configuration of the printer 1. FIG. 3A is a schematic view of the overall configuration of the printer 1. FIG. 3B is a transverse cross-sectional view of the overall configuration of the printer 1. The basic configuration of the printer according to the present embodiment is described below.

The printer 1 of the present embodiment has a carry unit 20, a carriage unit 30, a head unit 40, a detector group 50, and a controller 60. The printer 1 that has received print data from the computer 110, which is an external device, controls the various units (the carry unit 20, the carriage unit 30, and the head unit 40) with the controller 60. The controller 60 controls the units in accordance with the print data that has been received from the computer 110 to form an image on paper. The detector group 50 monitors the conditions in the printer 1, and outputs the results of this detection to the controller 60. The controller 60 controls the units in accordance with the detection results output from the detector sensor 50.

The carry unit 20 is for carrying a medium (paper S, for example) in a predetermined direction (hereinafter, referred to as the "carrying direction"). The carry unit 20 has a paper-supply roller 21, a carry motor 22 (hereinafter also referred to as the "PF motor"), a carry roller 23, a platen 24, and a paper-discharge roller 25. The paper-supply roller 21 is a roller for supplying paper that has been inserted into a paper insert opening into the printer. The carry roller 23 is a roller for carrying the paper S that has been supplied by the paper-supply roller 21 up to a printable region, and is driven by the carry motor 22. The platen 24 supports the paper S on which printing is being performed. The paper-discharge roller 25 is a roller for discharging the paper S to the outside of the printer, and is provided on the carrying direction downstream side with respect to the printable region.

The carriage unit 30 is for making the head move (also referred to as "scan") in a predetermined direction (hereinafter referred to as the "movement direction"). The carriage unit 30 has a carriage 31 and a carriage motor 32 (also referred to as the "CR motor"). The carriage 31 can move in a reciprocating manner along the movement direction, and is driven by the carriage motor 32. The carriage 31 detachably retains an ink cartridge that contains ink.

The head unit 40 is for ejecting ink onto paper. The head unit 40 is provided with a head 41 including a plurality of nozzles. The head 41 is provided to the carriage 31 so that when the carriage 31 moves in the movement direction, the head 41 also moves in the movement direction. Dot lines (raster lines) are formed on paper along the movement direction as a result of the head 41 intermittently ejecting ink while moving in the movement direction.

The detector group 50 includes a linear encoder 51, a rotary encoder 52, a paper detection sensor 53, and an optical sensor 54, for example. The linear encoder 51 is for detecting the position in the movement direction of the carriage 31. The rotary encoder 52 is for detecting the rotation amount of the carry roller 23. The paper detection sensor 53 is for detecting the position of the front end of the paper that is being supplied. The optical sensor 54 detects whether or not paper is present by a light-emitting section and a light-receiving section provided in the carriage 31. The optical sensor 54 can detect the width of paper by detecting the position of the lateral ends of the paper while being moved by the carriage 31. Depending on the circumstances, the optical sensor 54 can also detect the front end of the paper (downstream end in the carrying direction, also referred to as the "upper end") and the rear end of the paper (upstream end in the carrying direction, also referred to as the "lower end").

The controller 60 is a control unit (controller) for carrying out control of the printer. The controller 60 has an interface section 61, a CPU 62, a memory 63, and a unit controlling circuit 64. The interface section 61 is for exchanging data between the computer 110, which is an external device, and the printer 1. The CPU 62 is a computational processing device for performing control of the entire printer. The memory 63 is for reserving a region for storing programs and a working region for the CPU 62 for instance, and includes storage elements such as a RAM or an EEPROM. The CPU 62 controls the various units via the unit controlling circuit 64 in accordance with programs stored in the memory 63. For example, the CPU 62 provides an instruction on the target carry amount to the unit control circuit 64, and the unit control circuit 64 drives the carry motor 22 of the carry unit 20 based on the instruction.

<Regarding the Printing Operation>

Figure 4:
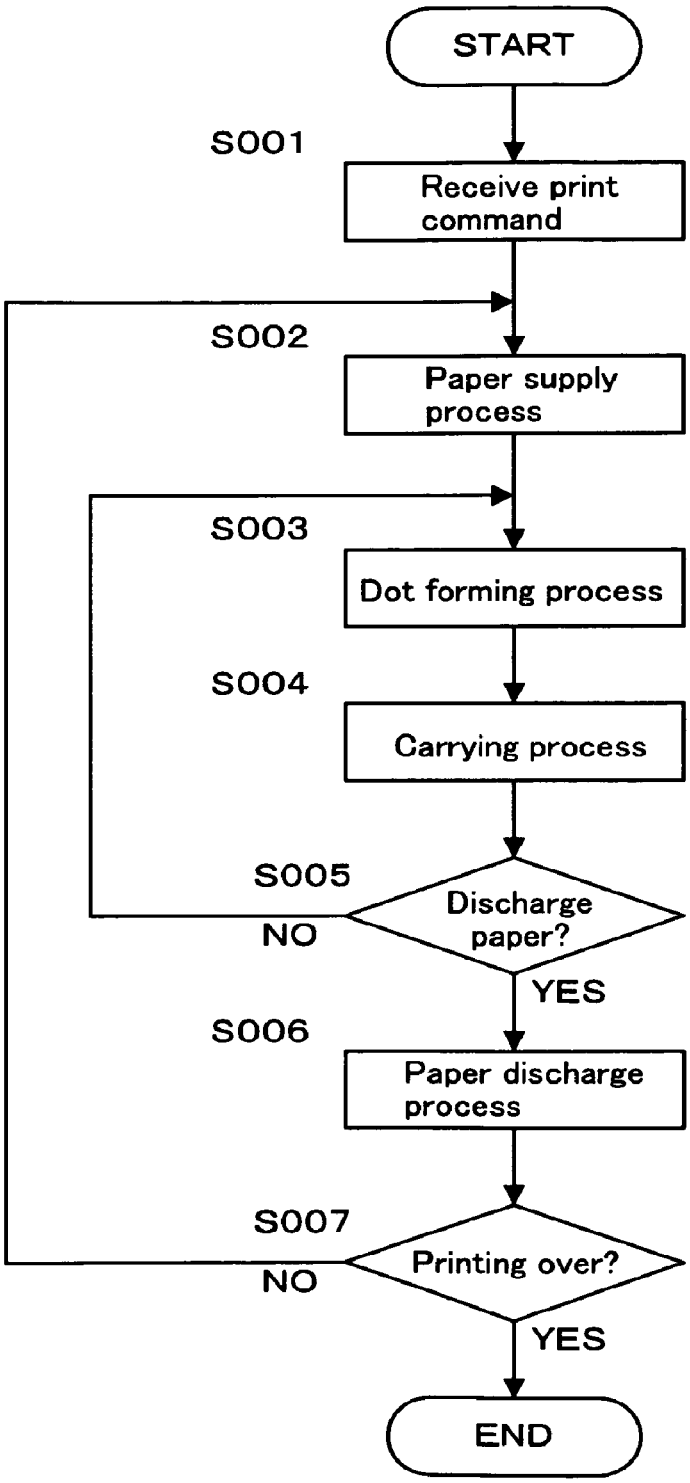
FIG. 4 is a flowchart of the processes during printing.

FIG. 4 is a flowchart of the processes during printing. The processes described below are executed by the controller 60 controlling the various units in accordance with the programs stored in the memory 63. These programs include codes for executing the various processes.

Receive Print Command (S001): First, the controller 60 receives a print command from the computer 110 via the interface section 61. This print command is included in the header of print data transmitted from the computer 110. The controller 60 then analyzes the content of the various commands included in the print data that has been received, and uses the various units to perform the following paper supplying process, carrying process and dot forming process, for example.

Paper Supplying Process (S002): The paper supplying process is a process for supplying paper to be printed on into the printer and positioning the paper at a print start position (also referred to as the "indexing position"). The controller 60 rotates the paper-supply roller 21 to feed the paper to be printed on to the carry roller 23. Then, the controller 60 rotates the carry roller 23 to position the paper that has been fed by the paper-supply roller 21 to the print start position. When the paper is positioned at the print start position, at least part of the nozzles of the head 41 is opposed to the paper.

Dot Forming Process (S003): The dot forming process is a process for causing ink to be intermittently ejected from the head that moves in the movement direction so as to form dots on the paper. The controller 60 drives the carriage motor 32 to move the carriage 31 in the movement direction. Then, the controller 60 causes ink to be ejected from the head in accordance with the print data while the carriage 31 is moving. Dots are formed on the paper when ink droplets ejected from the head 41 land on the paper. Since ink is intermittently ejected from the head 41 that is moving, rows of dots (raster lines) made up of a plurality of dots arranged in the movement direction are formed on the paper. This dot forming process is also referred to as the "pass". The "n"th dot forming process is also referred to as the "pass n".

Carrying Process (S004): The carrying process is a process for moving the paper in the carrying direction relatively with respect to the head. The controller 60 drives the carry motor to rotate the carry roller and thereby carries the paper in the carrying direction. Through this carrying process, the head 41 can form dots during a dot forming process at positions that are different from the positions of the dots formed during the preceding dot forming process.

Paper Discharge Determination (S005): The controller 60 determines whether or not to discharge the paper being printed. The paper is not discharged if there still remains data to print to the paper being printed. The controller 60 alternately repeats the dot forming process and the carrying process until there is no longer data to be printed, thereby gradually printing an image made of dots on the paper.

Paper Discharge Process (S006): When there is no longer data to print to the paper being printed, the controller 60 discharges that paper by rotating the paper-discharge roller. It should be noted that whether or not to discharge the paper can also be determined based on a paper discharge command contained in the print data.

Print Over Determination (S007): Next, the controller 60 determines whether or not to continue printing. If the next sheet of paper is to be printed on, then printing is continued and the paper supply process for the next sheet of paper is started. If no further sheet of paper is to be printed on, then the printing operation is ended.

Carrying Error During the Carrying Process and Correction thereof

<Regarding Carrying of Paper>

Figure 5:
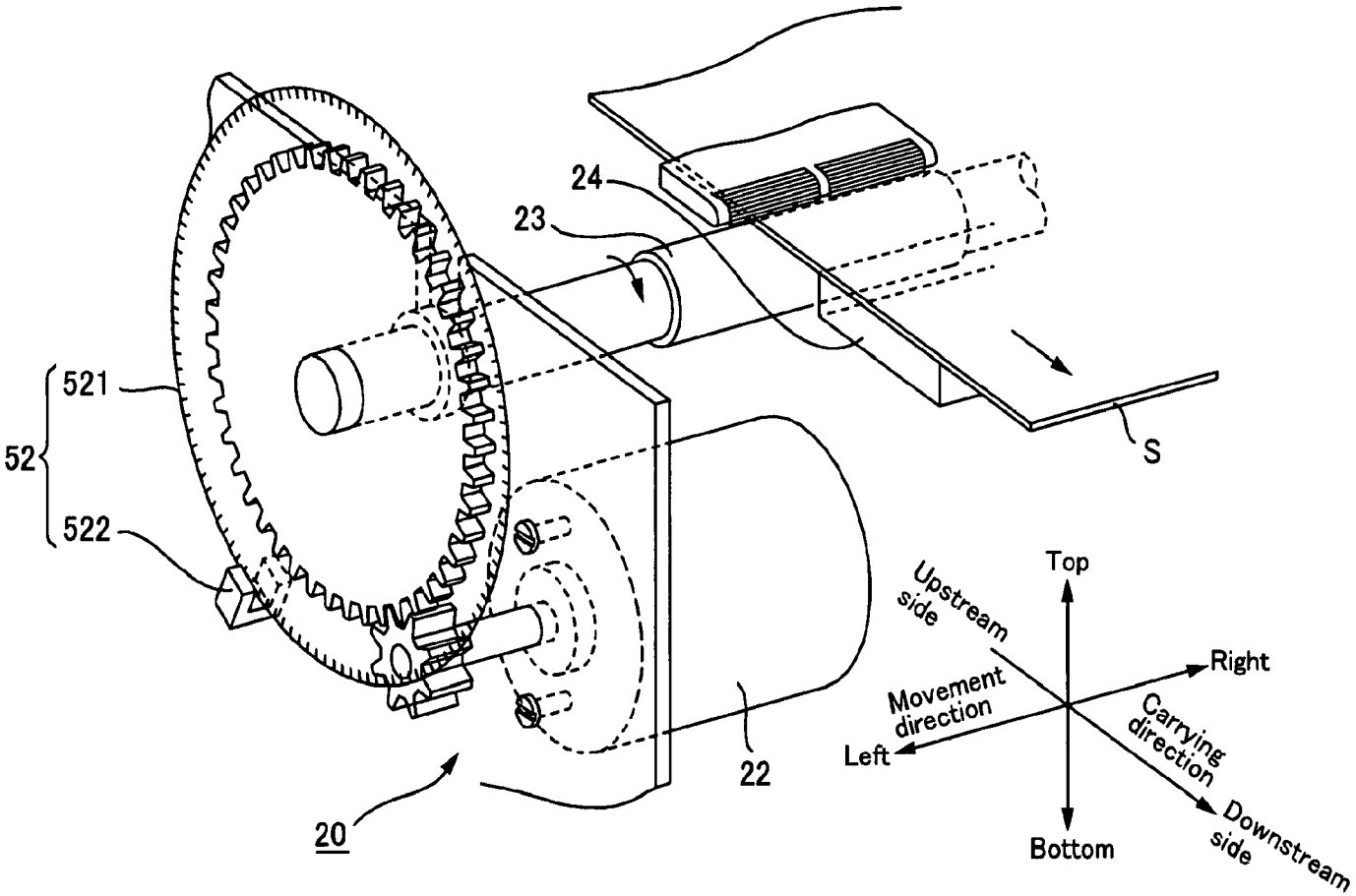
FIG. 5 is an explanatory diagram of the structure of the carrying unit 20.

FIG. 5 is an explanatory diagram of a configuration of the carry unit 20.

The carry unit 20 drives the carry motor 22 by a predetermined driving amount based on a carrying instruction from the controller 60. The carry motor 22 generates a driving force in the rotational direction according to the instructed driving amount. The carry motor 22 rotates the carry roller 23 with this driving force. That is, when the carry motor carry motor 22 generates a predetermined driving amount, the carry roller 23 rotates a predetermined rotation amount. When the carry roller 23 rotates a predetermined rotation amount, paper is carried by a predetermined carry amount.

The carry amount of the paper is determined according to the rotation amount of the carry roller 23. In the present embodiment, it is assumed that the paper is carried by 1.25 inches with a single rotation of the carry roller 23 (in other words, the circumferential length of the carry roller 23 is 1.25 inches). Therefore, the paper is carried by 0.625 inches with a half rotation of the carry roller 23.

Therefore, if the rotation amount of the carry roller 23 can be detected, the carry amount of the paper can be also detected. In order to detect the rotation amount of the carry roller 23, the rotary encoder 52 is provided.

The rotary encoder 52 includes a scale 521 and a detection section 522. The scale 521 has a plurality of slits provided at predetermined intervals. The scale 521 is provided in the carry roller 23. In other words, when the carry roller 23 rotates, the scale 521 rotates together. When the carry roller 23 rotates, the slits of the scale 521 pass through the detection section 522 in sequence. The detection section 522 is provided facing the scale 521, and is fixed to the printer main unit. The rotary encoder 52 outputs a pulse signal every time the slit 521 passes through the detection section 522. Since the slits 521 pass through the detection section 522 in sequence according to the rotation amount of the carry roller 23, the rotation amount of the carry roller 23 is detected based on the output from the rotary encoder 52.

For example, when the paper is carried by a carry amount of 1.25 inches, the controller 60 drives the carry motor 22 until the rotary encoder 52 detects that the carry roller 23 has finished a single rotation. In this manner, the controller 60 drives the carry motor 22 until the rotary encoder 52 detects that the rotation amount corresponding to a targeted carry amount (target carry amount) has been reached so as to carry the paper by the target carry amount.

<Regarding the Carrying Error>

The rotary encoder 52 is directly for detecting the rotation amount of the carry roller 23, and in a strict sense, does not detect the carry amount of the paper S. Therefore, when the rotation amount of the carry roller 23 and the carry amount of the paper S do not coincide with each other, the rotary encoder 52 cannot detect the carry amount of the paper S accurately, which causes a carrying error (detection error). The carrying error includes two types of error, i.e., a DC component carrying error and an AC component carrying error.

The DC component carrying error refers to the carrying error in a constant amount that is generated when the carry roller has performed a single rotation. It seems that the DC component carrying error is caused by the fact that the circumferential length of the carry roller 23 varies among individual printers due to manufacturing error or the like. In other words, the DC component carrying error refers to the carrying error that is caused due to discrepancy between the circumferential length in design of the carry roller 23 and the actual circumferential length of the same. The amount of the DC component carrying error is constant regardless of the position on the carry roller from which the carry roller starts a single rotation.

The AC component carrying error refers to the carrying error that depends on the location on the circumferential surface of the carry roller used during carrying. The amount of the AC component carrying error varies depending on the location on the circumferential surface of the carry roller used during carrying. Specifically, the amount of the AC component carrying error varies depending on the rotational position of the carry roller when carrying is started and the carry amount.

Figure 6:
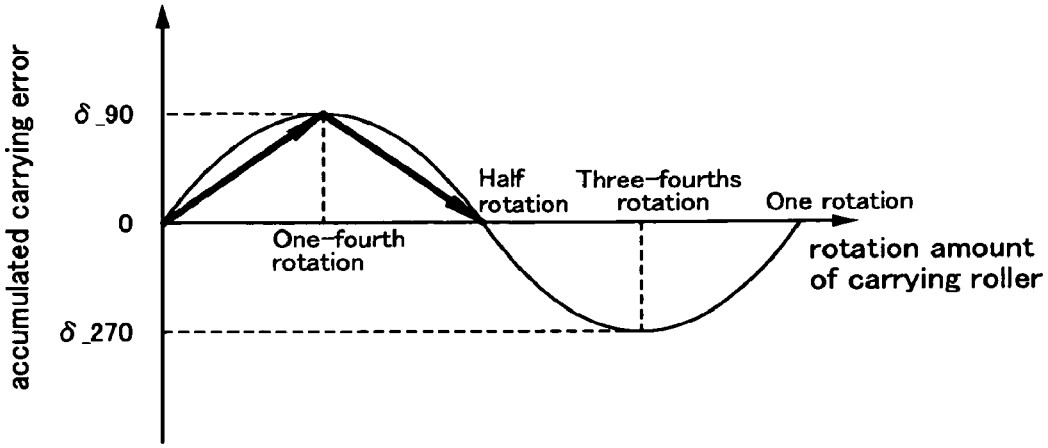
FIG. 6 is an explanatory graph showing an AC component carrying error.

FIG. 6 is an explanatory graph showing the AC component carrying error. The horizontal axis shows the rotation amount of the carry roller 23 from a reference rotational position. The vertical axis shows the accumulated carrying error. The carrying error generated when the carry roller is carrying a medium over a certain rotational position can be derived by differentiating this graph. In this case, the accumulated carrying error at the reference position is assumed to be "0", and the DC component carrying error is also assumed to be "0".

When the carry roller 23 performs a one-fourth rotation from the reference position, a carrying error of δ_90 is generated and the paper is carried by an amount (1.25/4) inches+δ_90. However, if the carry roller 23 performs another one-fourth rotation, a carrying error of −δ_90 is generated and the paper is carried by an amount (1.25/4) inches −δ_90.

Possible causes of the AC component carrying error include, for example, three causes described below.

A first cause seems to be the effect by the shape of the carry roller. For example, if the carry roller has an oval or egg shape, the distance to the rotational center varies depending on the location on the circumferential surface of the carry roller. When a medium is carried over a portion of the carry roller that has a long distance to the rotational center, the carry amount with respect to the rotation amount of the carry roller increases. On the other hand, when a medium is carried over a portion of the carry roller that has a short distance to the rotational center, the carry amount with respect to the carry amount of the carry roller decreases.

A second cause seems to be decentering of the rotation axis of the carry roller. In this case as well, the distance to the rotational center varies depending on the location on the circumferential surface of the carry roller. For this reason, even under the same the rotation amount of the carry roller, the carry amount varies depending on the location on the circumferential surface of the carry roller.

A third cause seems to be mismatching of the rotational axis of the carry roller and the center of the scale 521 of the rotary encoder 52. In this case, the scale 521 is rotated decentered. As a result, the rotation amount of the carry roller 23 for a detected pulse signal varies depending on the location of the scale 521 detected by the detection section 522. For example, if the location of the scale 521 detected is distant from the rotational axis of the carry roller 23, the rotation amount of the carry roller 23 for the detected pulse signal decreases, and the carry amount decreases. On the other hand, if the location of the scale 521 detected is near the rotational axis of the carry roller 23, the rotation amount of the carry roller 23 for the detected pulse signal increases, and the carry amount increases.

Due to the above causes, the AC component carrying error shows a substantial sine curve as shown in FIG. 6.

<Regarding Correction of the Carrying Error>

Figure 7:
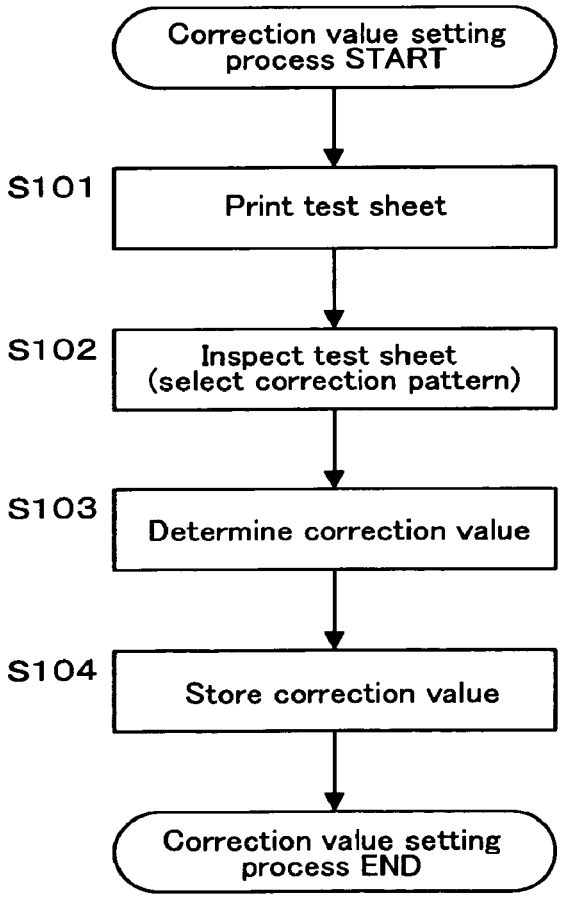
FIG. 7 is a flowchart of processes for setting a correction value for correcting the carrying error.

FIG. 7 is a flowchart of processes for setting a correction value for correcting the carrying error. These processes are performed in the inspection process at the printer manufacturing plant when the printer is manufactured. It should be noted that the printer to be inspected is connected to a computer for the inspection in the plant.

First, the printer prints a test sheet for setting the correction value (S101). A plurality of correction patterns are formed in the test sheet. The correction pattern is also referred to as the "patch pattern". The respective correction patterns are associated with certain correction values and have different shapes. The test sheet is described later.

An inspection operator inspects the test sheet and selects the correction pattern that has the optimal shape among the plurality of correction patterns in the test sheets (S102). The inspection operator inputs the number of the selected correction pattern to the computer connected to the printer. The computer determines the correction value based on the number associated with the selected correction pattern (S103), and stores the correction value in a memory of the printer (S104).

In this way, for each printer manufactured at the manufacturing plant, the correction value suitable for each printer is stored in the memory of each printer. Then, the printer that stores the correction value in the memory is packed and shipped.

When printing is performed under the user who has purchased the printer, the controller 60 reads out the correction value from the memory, corrects the target carry amount based on the correction value, and performs the carrying process based on the corrected target carry amount. As a result, paper is carried by the target carry amount, and the image quality of a printed image is improved.

REFERENCE EXAMPLE

Figure 8:
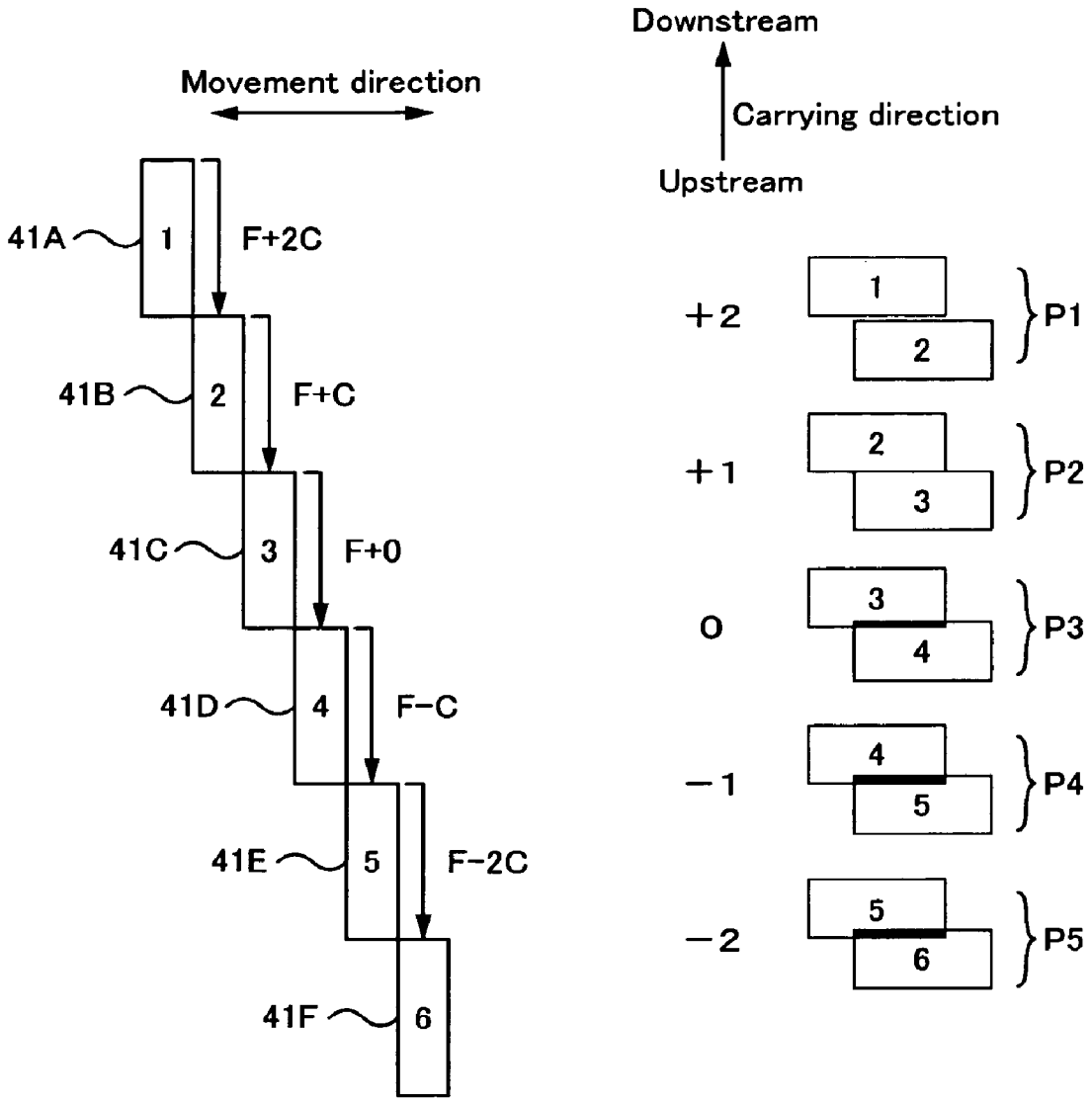
FIG. 8 is an explanatory diagram of printing a test sheet of a reference example.

FIG. 8 is an explanatory diagram of printing the test sheet of a reference example. In this reference example, the length in the carrying direction of the head is 1.25 inches and coincides with the length of the circumferential surface of the carry roller 23.

The test sheet of the reference example is for obtaining the correction value for a target carry amount F. The target carry amount F is 1.25 inches, which is the same as the length of the circumferential surface of the carry roller 23. Therefore, the test sheet is for detecting the carrying error (the DC component carrying error) generated when the carry roller 23 finishes a single rotation.

The six rectangles on the left side of FIG. 8 represent the position of the head with respect to the paper during pass 1 through pass 6. The figures in the rectangles representing the position of the head indicate the pass number. Although the head is illustrated as if moving with respect to the paper in FIG. 8, in actuality, the position of the head with respect to the paper changes by the paper being carried. Between pass 1 and pass 2, the carrying process by a target carry amount F+2C is performed. If any carrying error is present, the paper is not carried by the target carry amount in FIG. 8.

On the right side of FIG. 8, five correction patterns P1 to P5 are illustrated that are formed in the test sheet. Each of the correction patterns has two block patterns. The upper block pattern is formed by the nozzles of the head on the carrying direction upstream side during a certain pass, and the lower block pattern is formed by the nozzles of the head on the carrying direction downstream side during the subsequent pass. For each correction pattern, the target carry amount for the carrying process that is performed after the upper block pattern is formed until the formation of the lower block pattern is started varies. For example, in the correction pattern P1, the carrying process by a target carry amount F+2C is performed between the formation of the two block patterns, and in the correction pattern P2, the carrying process by a target carry amount F+C is performed. Accordingly, the interval between the two block patterns varies in the respective correction patterns.

When the two block patterns are formed distant from each other, a white streak appears at the boundary of the two block patterns. On the other hand, when the two block patterns are formed overlapped, a black streak appears between the two block patterns.

Should the paper be carried by the target carry amount, neither white streak nor black streak is supposed to appear in the correction pattern P3. However, in the test sheet in FIG. 8, when the paper was carried by a target carry amount F, the paper was carried by a carry amount smaller than the target carry amount F due to the carrying error, and therefore a black streak is present in the correction pattern P3.

The inspection operator pays attention to the boundary of the two block patterns when inspecting the test sheet. Then, the inspection operator selects the correction pattern P2 that has neither white streak nor black streak as the optimal correction pattern. As a result, a correction value of "+1" is stored in the memory of the printer.

When printing is performed under the user, in carrying out the carrying process by a target carry amount F, the controller 60 corrects the target carry amount to "F+C" based on the correction value of "+1" stored in the memory. If the carrying process is performed by a corrected target carry amount F+C, the paper is carried by a carry amount smaller than the target carry amount due to the carrying error, and therefore the paper is carried by a carry amount F. That is, it is possible to carry the paper by the target carry amount before correction.

Configuration of the Head of the Present Embodiment

In the foregoing reference example, the length in the carrying direction of the head is 1.25 inches, which coincides with the length of the circumferential surface of the carry roller 23. However, as described below, the length in the carrying direction of the head of the present embodiment is shorter than the length of the circumferential surface of the carry roller 23.

Figure 9:
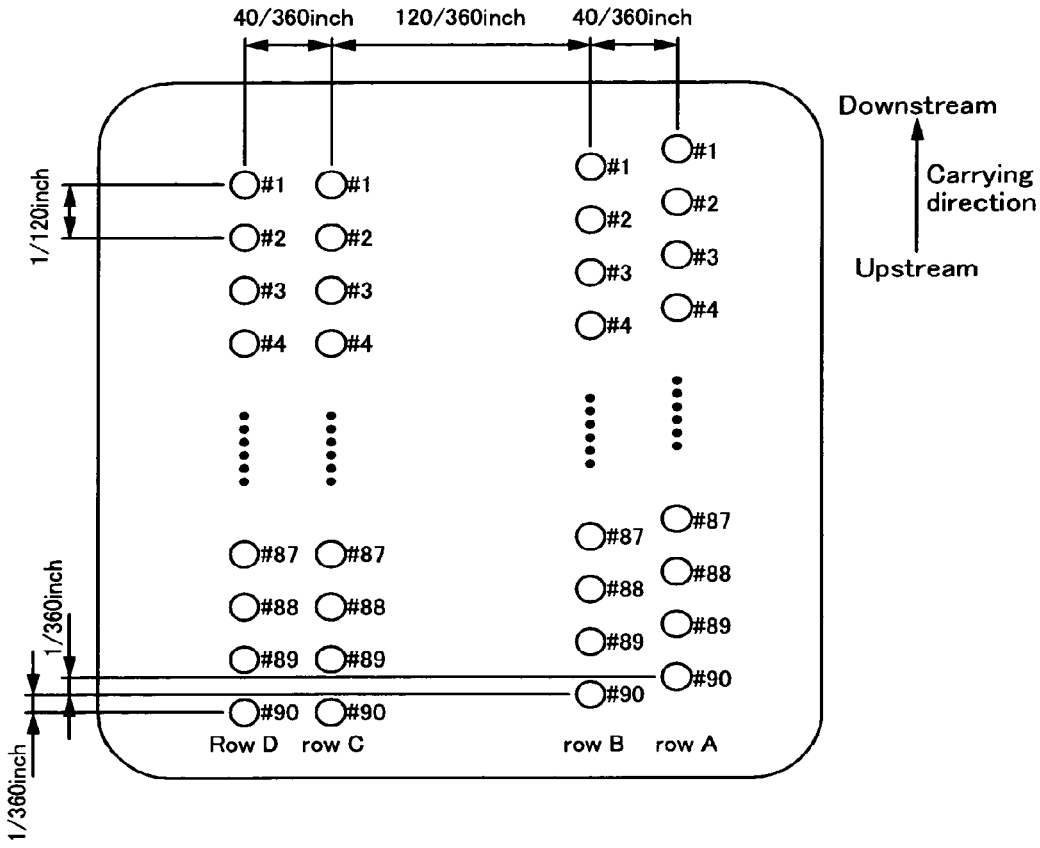
FIG. 9 is an explanatory diagram of nozzle arrangement of a head.

FIG. 9 is an explanatory diagram of the nozzle arrangement of the head. In the lower surface of the head 41, four nozzle rows (row A to row D) are provided. Each nozzle row includes 90 nozzles.

90 nozzles of each nozzle row are lined up in the carrying direction at 1/120 inch intervals (nozzle pitch). The nozzles of the row B are located shifted to the carrying direction upstream side by 1/360 inches with respect to the nozzles of the row A. In addition, the nozzles of the row C and row D are located shifted to the carrying direction upstream side by 1/360 inches with respect to the nozzles of the row B.

Numbers (#1 to #90) are assigned to the nozzles of each nozzle row, with the number becoming smaller the further downstream in the carrying direction the nozzle is. In short, the nozzle #1 is located on the further downstream side in the carrying direction than the nozzle #90.

Each nozzle is provided with an ink chamber (not shown) and a piezo element. The ink chamber constricts and expands due to drive of the piezo element, and ink droplets are ejected from the nozzle.

Cyan ink is ejected from the nozzles of the row A. Magenta ink is ejected from the nozzles of the row B. Yellow ink is ejected from the nozzles of the row C. Black ink is ejected from the nozzles of the row D. When the test sheet is printed at the printer manufacturing plant, however, light magenta ink for inspection is supplied to the row B, and the light magenta ink is ejected from the nozzles of the row B to print the test sheet.

The width in which a pattern can be formed in a single dot forming operation is referred to as the "length in the carrying direction of the head". Specifically, the "length in the carrying direction of the head" means the length of the nozzle row that ejects ink, and is represented as "nozzle pitch×nozzle number". The length in the carrying direction of the head in printing the test sheet means the length of the nozzle row B, namely, 0.75 inches (=1/120 inches×90).

Accordingly, in the present embodiment, the length in the carrying direction of the head (0.75 inches) is shorter than the length of the circumferential surface of the carry roller (1.25 inches).

Measures for Various Problems of the Present Embodiment

<Problem Due to the Fact that the Length of the Head is Shorter than the Length of the Roller Circumferential Surface>

Figure 10A:
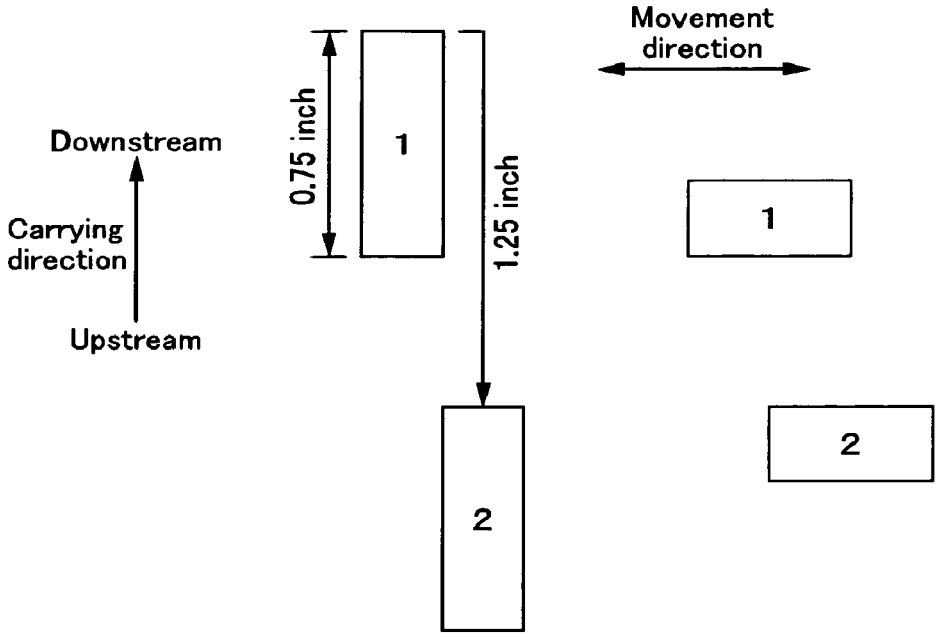
FIG. 10A is an explanatory diagram of a problem due to the fact that the length of the head is shorter than the length of a roller circumferential surface.

FIG. 10A is an explanatory diagram of the problem due to the fact that the length of the head is shorter than the length of the roller circumferential surface.

In order to correct the DC component carrying error, it is necessary that the nozzles of the head on the carrying direction upstream side form a block pattern, the carrying process for a single rotation of the carry roller 23 is performed, and then the nozzles of the head on the carrying direction downstream side form another block pattern to form the correction pattern.

However, in the case where length in the carrying direction of the head is shorter than the length of the circumferential surface of the carry roller, the two block patterns cannot be formed close to each other. For this reason, it is not possible to form a boundary to be inspected by the inspection operator between the two block patterns, as in the reference example. In addition, while the interval between the two block patterns reflects the carrying error, when the two block patterns are distant from each other as shown in FIG. 10A, it is impossible to determine the interval between the two block patterns.

Figure 10B:
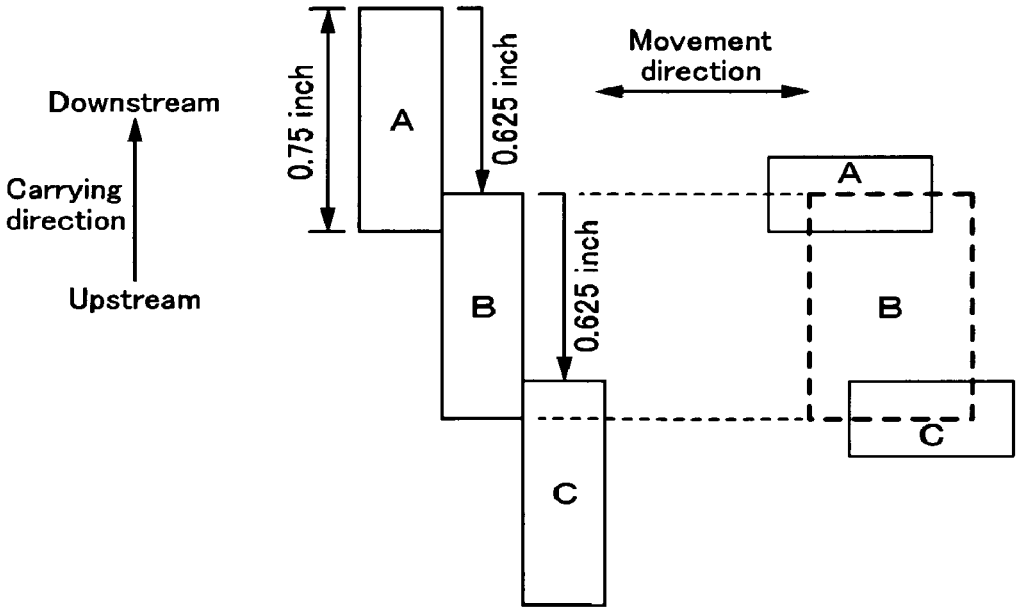
FIG. 10B is an explanatory diagram of measures for this problem of the present embodiment.

FIG. 10B is an explanatory diagram of measures for this problem of the present embodiment.

In the present embodiment, after forming a pattern A, the carrying process for a half rotation of the carry roller 23 is performed and a pattern B is formed. Then, the carrying process for another half rotation of the carry roller 23 is performed and a pattern C is formed, thereby forming the correction pattern made up of the patterns A to C. In this correction pattern as well, two patterns formed before and after the carrying process for a single rotation of the carry roller 23 (pattern A and pattern C), which are necessary to correct the DC component carrying error, are included.

In addition, in the present embodiment, the pattern A and the pattern B, and the pattern B and the pattern C can be respectively formed close to each other. As a result, it becomes possible to form a boundary to be inspected by the inspection operator between the pattern A and pattern B, as well as between the pattern B and pattern C. In the present embodiment, the positional relation between the pattern A and pattern B can be inspected based on the boundary between the pattern A and pattern B, and the positional relation between the pattern B and pattern C can be inspected based on the boundary between the pattern B and pattern C. Therefore, it is possible to indirectly determine the positional relation between the pattern A and pattern C.

<Problem of the AC Component Carrying Error of the Pattern B>

The amount of the DC component carrying error is constant regardless of the position on the carry roller from which the carry roller starts a single rotation. Therefore, the positional relation between the pattern A and pattern C that are respectively formed before and after the carrying process of the carry roller for a single rotation is not affected by the rotation start position of the carry roller when forming the pattern A.

However, in the present embodiment, the pattern B is formed before the carry roller finishes a single rotation after the pattern A was formed. Therefore, the positional relation between the pattern A and pattern B is affected by the rotation start position of the carry roller when forming the pattern A.

Figure 11A:
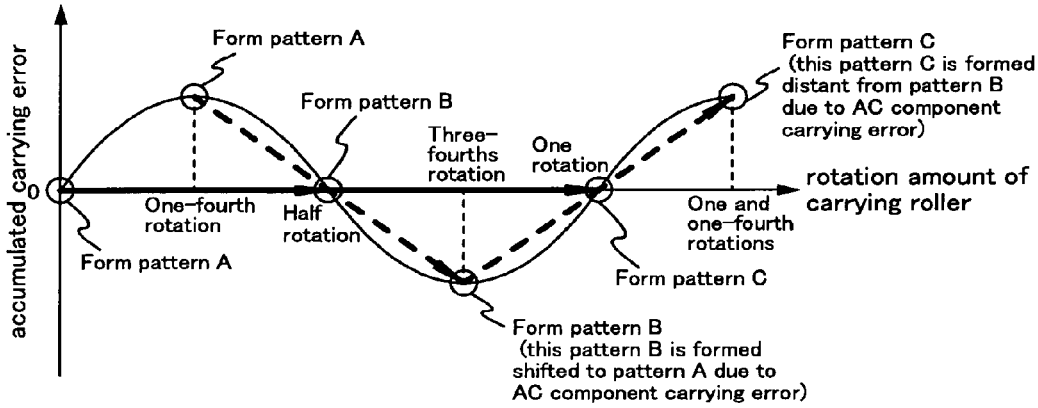
FIG. 11A is an explanatory diagram of the AC component carrying error when forming each pattern.
Figure 11B:
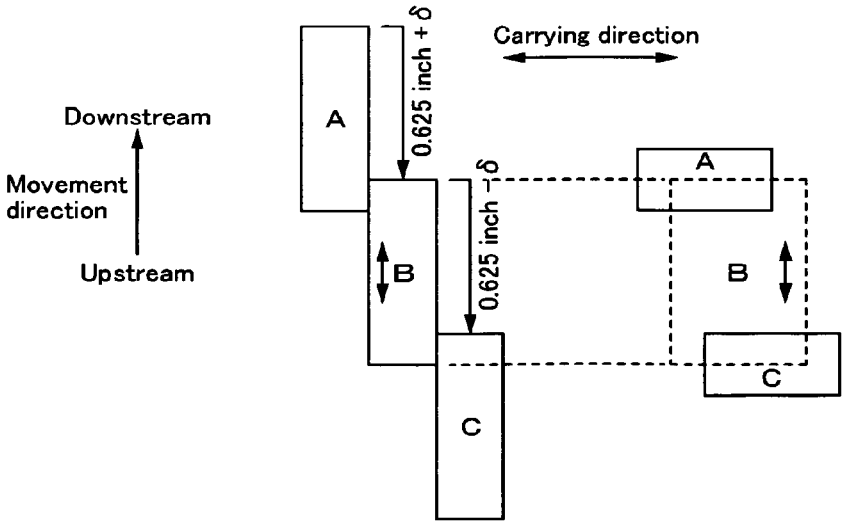
FIG. 11B is an explanatory diagram of the effect on the formation position of a pattern B due to the AC component carrying error.

FIG. 11A is an explanatory diagram of the AC component carrying error when forming each pattern. FIG. 11B is an explanatory diagram of the effect on the formation position of the pattern B due to the AC component carrying error.

In the case where the rotation start position of the carry roller when forming the pattern A is the reference position, when the carry roller is rotated by a half rotation, it is possible to carry paper without the AC component carrying error being generated. Accordingly, the pattern B can be formed without being affected by the AC component carrying error.

On the other hand, in the case where the rotation start position of the carry roller when forming the pattern A is the position rotated by a one-fourth rotation from the reference position, when the carry roller is rotated by a half rotation, the paper is carried by a carry amount smaller than the target carry amount as affected by the AC component carrying error. As a result, the pattern B is formed shifted near to the pattern A. Also, when the carry roller is rotated further by another half rotation, the paper is carried by a carry amount larger than the target carry amount as affected by the AC component carrying error. As a result, the pattern C is formed distant from the pattern B.

As described above, the pattern B in FIG. 11B changes its position vertically (to the downstream side or upstream side in the carrying direction) due to the effect of the AC component carrying error (however, since the positional relation between the pattern A and pattern C is not affected by the AC component, the positions of the pattern A and pattern C in FIG. 11B do not change). When the position in the carrying direction of the pattern B changes, the states of boundaries between the pattern A and pattern B and between the pattern B and pattern C also change.

On the other hand, in the present embodiment, although the relative rotation amount of the carry roller 23 can be detected by the rotary encoder 52, an original point sensor or the like for detecting that the carry roller 23 is in the reference position is not provided so that the absolute rotation start position of the carry roller 23 is not detected. Therefore, in the present embodiment, it is necessary to assess the correction pattern in a state in which it is unknown to which of the upper or lower side the position of the pattern B is shifted.

Since the correction value for correcting the DC component carrying error is determined under such a condition, in the present embodiment, the correction pattern in which the boundary between the pattern A and pattern B is optimal is selected, and further the correction pattern in which the boundary between the pattern B and pattern C is optimal is selected, and the correction value is determined based on the selected two correction patterns. In this way, the correction value can be determined corresponding to the DC component carrying error even if the position in the carrying direction of the pattern B is changed.

<Problem of the Shape of the Boundary between Two Patterns>

In the correction pattern of the reference example, the boundary is formed by two block patterns. The two block patterns are, when viewed microscopically, constituted by a plurality of raster lines formed by dots lined up in the movement direction. Accordingly, the boundary between the two block patterns is parallel to the raster line.

Figure 12A:
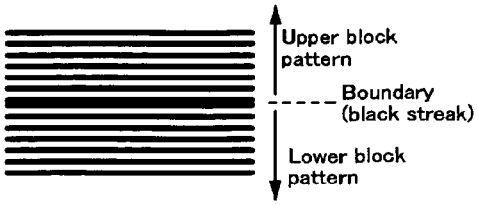
FIG. 12A and FIG. 12B are explanatory diagrams showing an area around a boundary of two block patterns.
Figure 12B:
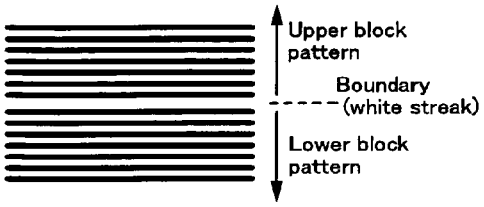

FIG. 12A and FIG. 12B are explanatory diagrams showing the area around the boundary of the two block patterns. The solid lines in FIG. 12A and FIG. 12B indicate raster lines, which are in actuality formed by lined up dots.

A black streak appears in FIG. 12A because the two block patterns are formed close to each other. A white streak appears in FIG. 12B because the two block patterns are formed distant from each other. Both boundaries are parallel to the raster line. In the foregoing reference example, whether the black streak or white streak is present is determined at such boundaries.

By the way, the raster line that constitutes a block pattern is sometimes formed with its position in the carrying direction shifted due to variance in manufacturing of the nozzles, irregularity in the flying direction of ink or other reasons. As a result, the interval between a raster line and a raster line adjacent thereto may differ to some extent for each raster line.

Figure 12C:
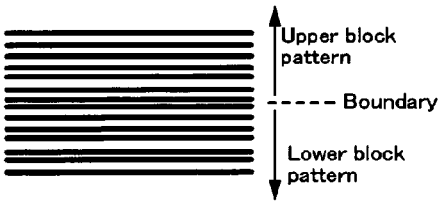
FIG. 12C and FIG. 12D are explanatory diagrams showing the area around the boundary when the interval between raster lines is inconsistent.
Figure 12D:
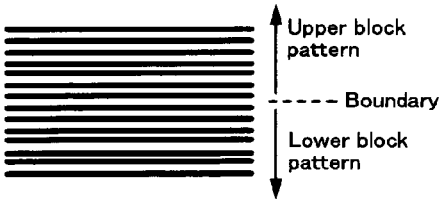

FIG. 12C and FIG. 12D are explanatory diagrams showing the area around the boundary when the interval between the raster lines is inconsistent. In FIG. 12C, two block patterns are formed close to each other, and in FIG. 12D, distant from each other.

When the interval between the raster lines is inconsistent, an area in which raster lines are formed close to each other so as to be recognized as a black streak, or an area in which raster lines are formed distant from each other so as to be recognized as a white streak may be present in the block pattern as well. Consequently, it becomes difficult to specify the boundary position. Even if the boundary position can be specified, it is difficult to determine whether a black streak or white streak is present at the boundary of the two block patterns. In addition, depending on the manner of inconsistency in the position in the carrying direction of the raster lines around the boundary, the presence of the black streak or white streak at the boundary is determined differently.

Figure 12E:
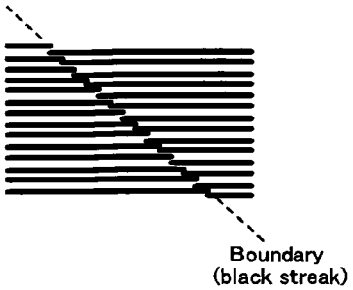
FIG. 12E and FIG. 12F are explanatory diagrams of the measures for this problem of the present embodiment.
Figure 12F:
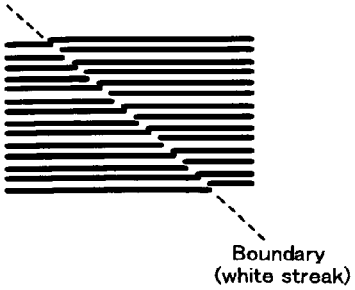

FIG. 12E and FIG. 12F are explanatory diagrams of the measures for this problem of the present embodiment. In FIG. 12E, a black streak appears since the two patterns are formed close to each other. In FIG. 12F, a white streak appears since the two patterns are formed distant from each other.

In the present embodiment, the direction of the boundary between the two patterns is set to a direction that intersects the carrying direction and the movement direction. As viewed macroscopically, in the present embodiment, diagonal sides are formed respectively in the two patterns (pattern A and pattern B for example), and the boundary is formed with these diagonal sides formed close to each other.

By forming the boundary in this way, the boundary is constituted by a plurality of raster lines that constitute one of the patterns, and a plurality of raster lines that constitute the other pattern. Therefore, even if the position in the carrying direction of the raster lines is inconsistent, the presence of the black streak or white streak at the boundary can be performed in a stable manner. That is, it becomes easier for the inspection operator to inspect the test sheet.

The present embodiment is described below in detail.

Test Sheet of the Present Embodiment

<Regarding the Constitution of the Test Sheet>

Figure 13:
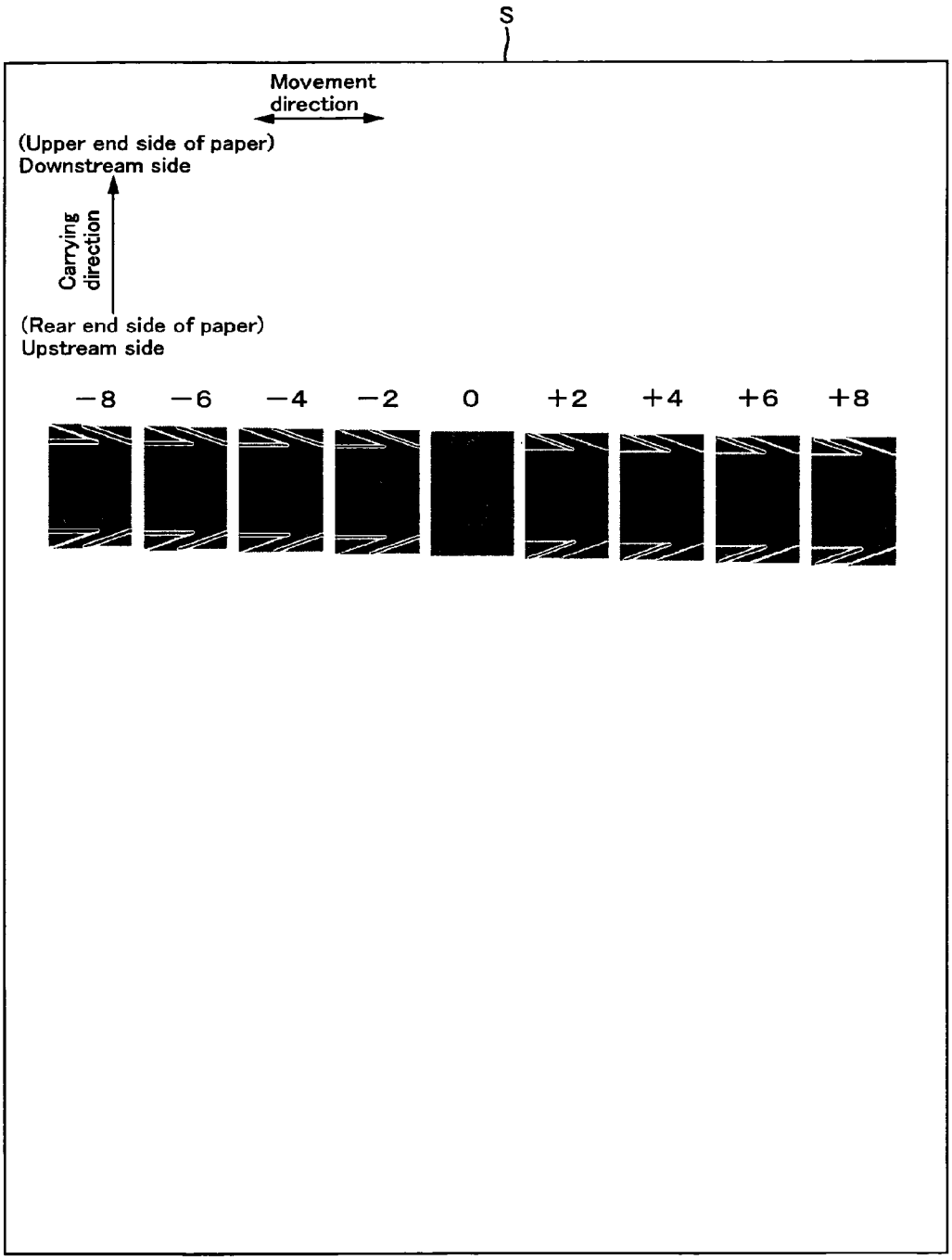
FIG. 13 is an explanatory diagram of a test sheet of the present embodiment.

FIG. 13 is an explanatory diagram of the test sheet of the present embodiment.

In the test sheet of the present embodiment, nine correction patterns are formed side by side in the movement direction. Each correction pattern is associated with a certain correction value, and the figure indicating the correction value is printed above (upper end side of paper) each correction pattern. In the following description, the "correction pattern (n)" refers to the correction pattern associated with the correction value "n".

<Regarding the Constitution of the Correction Pattern>

Figure 14:
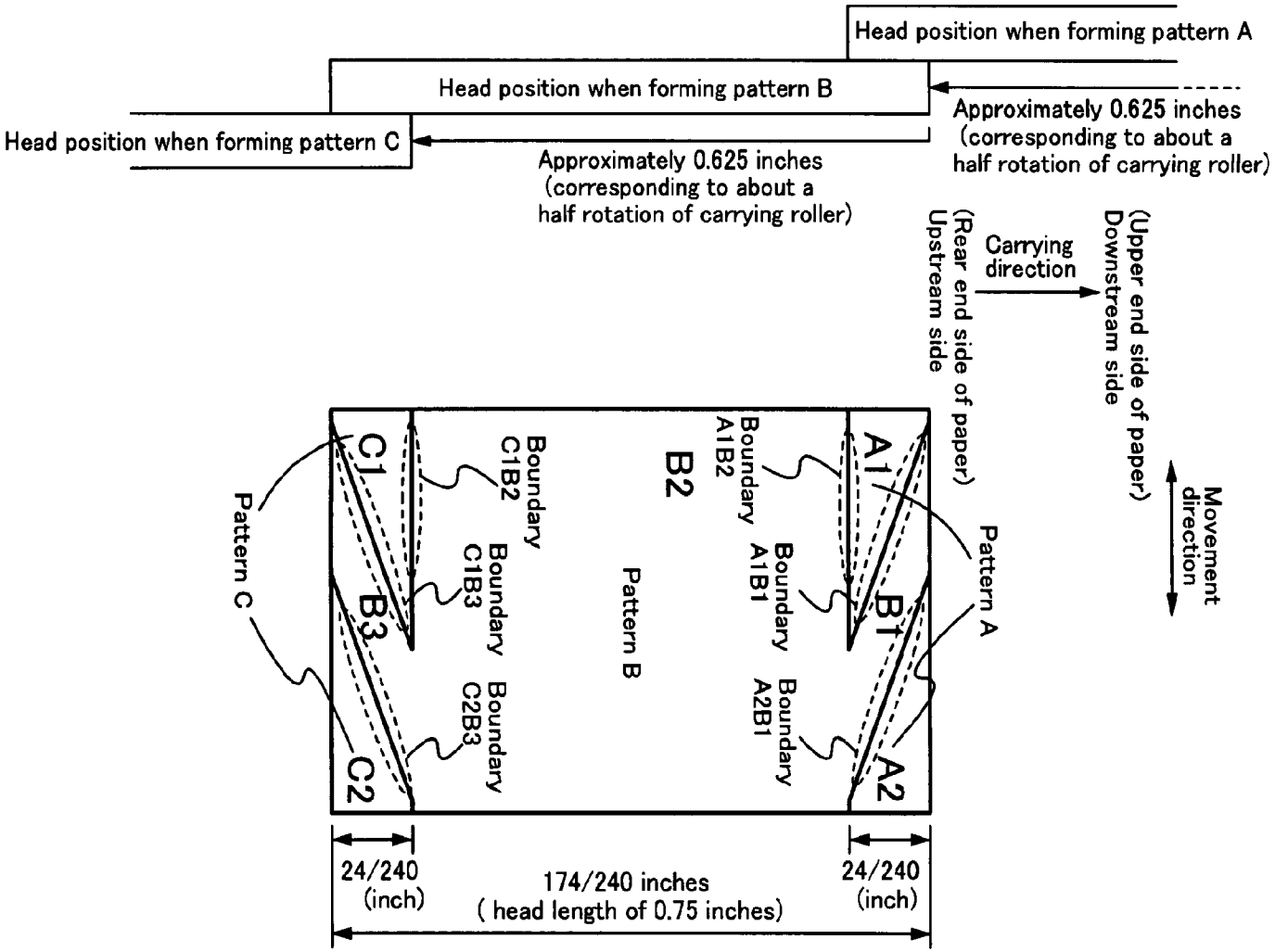
FIG. 14 is an explanatory diagram of a correction pattern of the present embodiment.

FIG. 14 is an explanatory diagram of the correction pattern of the present embodiment.

Each correction pattern is constituted by a pattern A, a pattern B and a pattern C, and has a substantially rectangular shape as a whole.

The pattern A is constituted by a trapezoid pattern A1 and an inverted trapezoid pattern A2. The trapezoid pattern A1 and the inverted trapezoid pattern A2 are respectively formed at the two corners on the top side (carrying direction downstream side) of the correction pattern. In the trapezoid pattern A1 and the inverted trapezoid pattern A2, one of the two sides between the upper base and lower base forms a right angle with the upper base and the lower base, and constitutes one of the lateral sides of the correction pattern. Also, in the trapezoid pattern A1 and the inverted trapezoid pattern A2, the other of the two sides between the upper base and lower base is a diagonal side. This diagonal side extends along a direction that intersects the carrying direction and the movement direction. The diagonal sides of the trapezoid pattern A1 and the inverted trapezoid pattern A2 are parallel to each other. The constitution of the pattern A is described later in detail.

The pattern B is constituted by a sloping pattern B1, a rectangular pattern B2 and a sloping pattern B3. The sloping pattern B1 is formed above the rectangular pattern B2 in the form of a parallelogram. One side of the parallelogram forms the upper side of the correction pattern. Two parallel sides sandwiching that side are parallel to the diagonal sides of the trapezoid pattern A1 and the inverted trapezoid pattern A2 described above. The rectangular pattern B2 is located in the central portion of the correction pattern. Two sides of the rectangular pattern B2 constitute two lateral sides of the correction pattern. The sloping pattern B3 is formed below (carrying direction upstream side) the rectangular pattern B2 in the form of a parallelogram. One side of the parallelogram constitutes the bottom side of the correction pattern. Two parallel sides sandwiching that side are parallel to diagonal sides of an inverted trapezoid pattern C1 and a trapezoid pattern C2 described below. By comparing the sloping pattern B1 and the sloping pattern B3, it is found that the sloping directions are opposite. Note that, the constitution of the pattern B is described later in detail.

The pattern C is constituted by the inverted trapezoid pattern C1 and the trapezoid pattern C2. The inverted trapezoid pattern C1 and the trapezoid pattern C2 are respectively formed at the two corners on the lower side (carrying direction upstream side) of the correction pattern. In the inverted trapezoid pattern C1 and the trapezoid pattern C2, one of the two sides between the upper base and lower base forms a right angle with the upper base and the lower base, and constitutes one of the lateral sides of the correction pattern. Also, in the inverted trapezoid pattern C1 and the trapezoid pattern C2, the other of the two sides between the upper base and lower base is a diagonal side. This diagonal side extends along a direction that intersects the carrying direction and the movement direction. The diagonal sides of the inverted trapezoid pattern C1 and the trapezoid pattern C2 are parallel to each other. Provided that the diagonal sides of the inverted trapezoid pattern C1 and the trapezoid pattern C2 are formed along a direction that intersects the diagonal sides of the trapezoid pattern A1 and the inverted trapezoid pattern A2. The constitution of the pattern C is described later in detail.

A boundary A1B1, a boundary A2B1 and a boundary A1B2 are formed between the pattern A and pattern B. The boundary A1B1 is the boundary formed between the trapezoid pattern A1 of the pattern A and the sloping pattern B1 of the pattern B. The boundary A2B1 is the boundary formed between the inverted trapezoid pattern A2 of the pattern A and the sloping pattern B1 of the pattern B. The boundary A1B2 is the boundary formed between the trapezoid pattern A1 of the pattern A and the rectangular pattern B2 of the pattern B. The boundary A1B1 and the boundary A2B1 is formed along a direction that intersects the carrying direction and also the movement direction. The boundary A1B2 is formed along the movement direction. As described below, the inspection operator pays attention to the boundary A1B1 and boundary A2B1 during the inspection, whereas the inspection operator does not pay attention to the boundary A1B2.

A boundary C1B3, a boundary C2B3 and a boundary C1B2 are formed between the pattern B and pattern C. The boundary C1B3 is the boundary formed between the inverted trapezoid pattern C1 of the pattern C and the sloping pattern B3 of the pattern B. The boundary C2B3 is the boundary formed between the trapezoid pattern C2 of the pattern C and the sloping pattern B3 of the pattern B. The boundary C1B2 is the boundary formed between the inverted trapezoid pattern C1 of the pattern C and the rectangular pattern B2 of the pattern B. The boundary C1B3 and the boundary C2B3 are formed along a direction that intersects the carrying direction and also the movement direction. Provided that the boundary C1B3 and the boundary C2B3 extend along a direction that intersects the boundary A1B1 and the boundary A2B1 as well. As described below, the inspection operator pays attention to the boundary C1B3 and boundary C2B3 during the inspection, whereas the inspection operator does not pay attention to the boundary C1B2.

In every correction pattern, after forming the pattern A, the paper is carried by a carry amount for approximately a half rotation of the carry roller, and the pattern B is formed. However, the target carry amount of the carrying process performed after the pattern A is formed until the formation of the pattern B is started varies for each correction pattern. Moreover, after forming the pattern B, the paper is carried by a carry amount for approximately a half rotation of the carry roller, and the pattern C is formed. However, the target carry amount of the carrying process performed after the pattern B is formed until the formation of the pattern C is started varies for each correction pattern. For this reason, the positional relation of the pattern B with respect to the pattern A, and that of the pattern C with respect to the pattern B vary for each correction pattern. In short, the positional relation between the pattern A and pattern C varies for each correction pattern.

Consequently, the states of the boundaries vary for each correction pattern. A boundary at which two patterns overlap is recognized dark (recognized as a black streak). On the other hand, a boundary at which two patterns are distant from each other is recognized light (recognized as a white streak).

Next, the method for printing the patterns A to C of the respective correction patterns is described. Then, the method for printing all the correction patterns is described. The patterns are formed at a resolution of 360 dpi (movement direction)×240 dpi (carrying direction). Since the diameter of a dot that constitutes the raster line is $1/240$ inches, in the pattern formed at this resolution, a gap is present between the raster lines constituting each pattern.

<Regarding the Method for Printing Pattern A>

Figure 15:
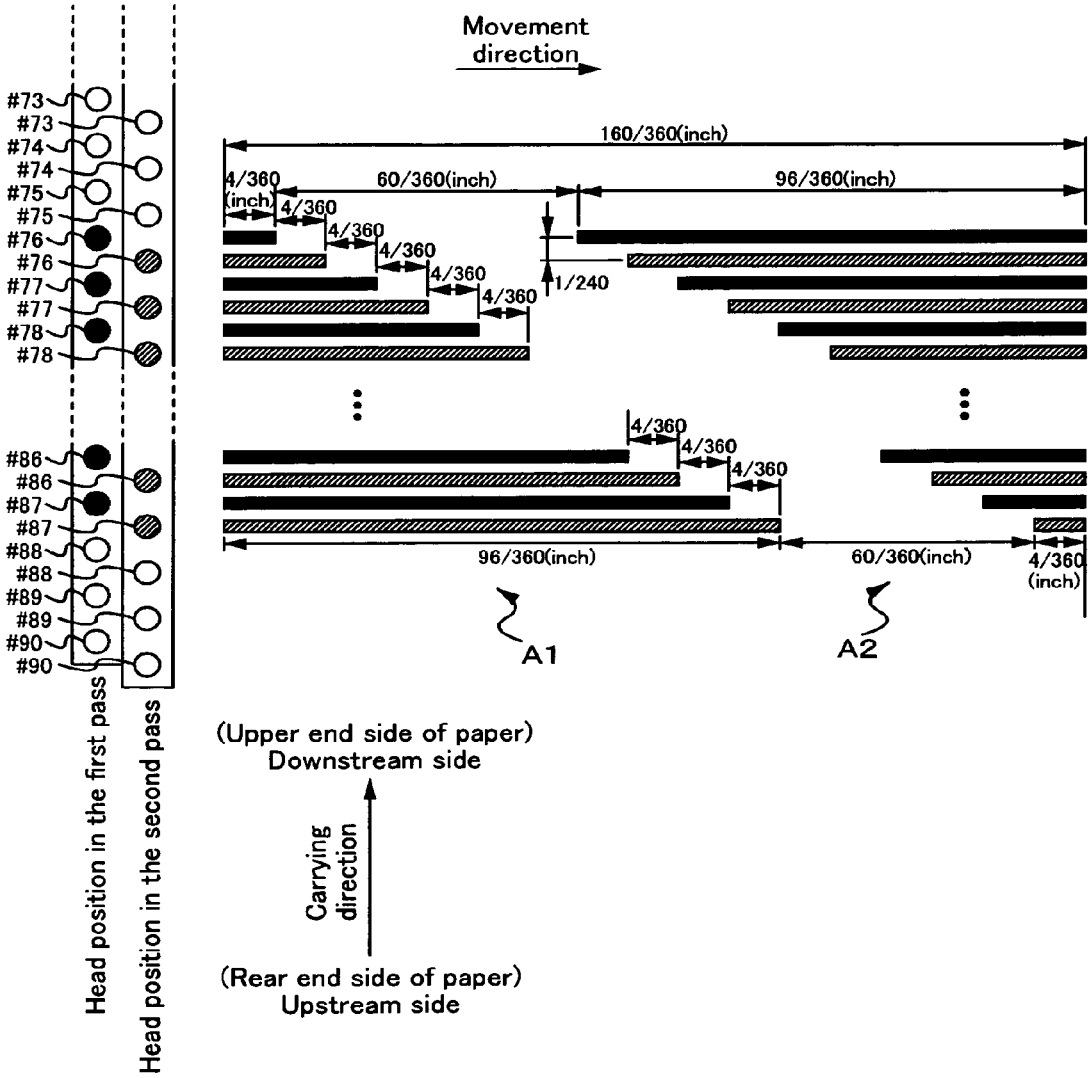
FIG. 15 is an explanatory diagram of the method for printing a pattern A.

FIG. 15 is an explanatory diagram of the method for printing the pattern A. The pattern A is formed by two passes. In the left side of FIG. 15, the position of the head (position of the row B) with respect to the paper during the first and second passes are illustrated. When forming the pattern A, ink is ejected from the nozzles #76 to #87. The nozzles that eject ink are indicated by solid circle for the first pass and by hatching for the second pass. Although the head can move reciprocally in the movement direction, the head moves only in one direction when forming the pattern A. Here, it is assumed that the pattern A is formed while the head moves from the left to the right in FIG. 15.

In the right side of FIG. 15, raster lines that constitute the pattern A are illustrated. The raster lines formed during the first pass are indicated by solid line and the raster lines formed during the second pass are indicated by hatched line.

During the first pass, the nozzles #76 to #87 start ejecting ink when the head has reached a predetermined position in the movement direction. The nozzle #76 forms a raster line of $4/360$ inches that constitutes the trapezoid pattern A1 (in other words, forms 4 dots), and after an idle running section of $60/360$ inches, forms a raster line of $96/360$ inches that constitutes the inverted trapezoid pattern A2 (in other words, forms 96 dots). Then, each nozzle forms a raster line that is longer by $8/360$ inches than the raster line formed by the nozzle adjacent thereto on the carrying direction downstream side to form a raster line that constitutes the trapezoid pattern A1, and after an idle running section of $60/360$ inches, forms a raster line that is shorter by $8/360$ inches than the raster line formed by the nozzle adjacent thereto on the carrying direction downstream side to form a raster line that constitutes the inverted trapezoid pattern A2. Thereafter, ejection of ink from the nozzles #76 to #87 is stopped when the head has reached a predetermined position in the movement direction.

After the first pass, the carrying process by a target carry amount of $18/4320$ inches ($1/240$ inches), which corresponds to a half of the nozzle pitch, is performed. This carry amount is so small that the carrying error is also very small (can be ignored).

During the second pass, a raster line is formed between the raster lines formed during the first pass. During the second pass as well, the nozzles #76 to #87 start ejecting ink when the head has reached a predetermined position in the movement direction. The nozzle #76 forms a raster line of $8/360$ inches that constitutes the trapezoid pattern A1 (in other words, forms 8 dots), and after an idle running section of $60/360$ inches, forms a raster line of $92/360$ inches that constitutes the inverted trapezoid pattern A2 (in other words, forms 92 dots). Then, each nozzle forms a raster line that is longer by $8/360$ inches than the raster line formed by the nozzle adjacent thereto on the carrying direction downstream side to form a raster line that constitutes the trapezoid pattern A1, and after an idle running section of $60/360$ inches, forms a raster line that is shorter by $8/360$ inches than the raster line formed by the nozzle adjacent thereto on the carrying direction downstream side to form a raster line that constitutes the inverted trapezoid pattern A2. Thereafter, ejection of ink from the nozzles #76 to #87 is stopped when the head has reached a predetermined position in the movement direction.

The right extremity position in the movement direction of 24 raster lines that constitute the trapezoid pattern A1 gradually changes by 4/360 inches at a time. Accordingly, when the trapezoid pattern A1 is viewed macroscopically, a diagonal side that intersects both the carrying direction and the movement direction is formed. Also, the left extremity position in the movement direction of 24 raster lines that constitute the inverted trapezoid pattern A2 gradually changes by 4/360 inches at a time. Accordingly, when the inverted trapezoid pattern A2 is viewed macroscopically, a diagonal side that intersects both the carrying direction and the movement direction is formed.

<Regarding the Method for Printing Pattern B>

Figure 16:
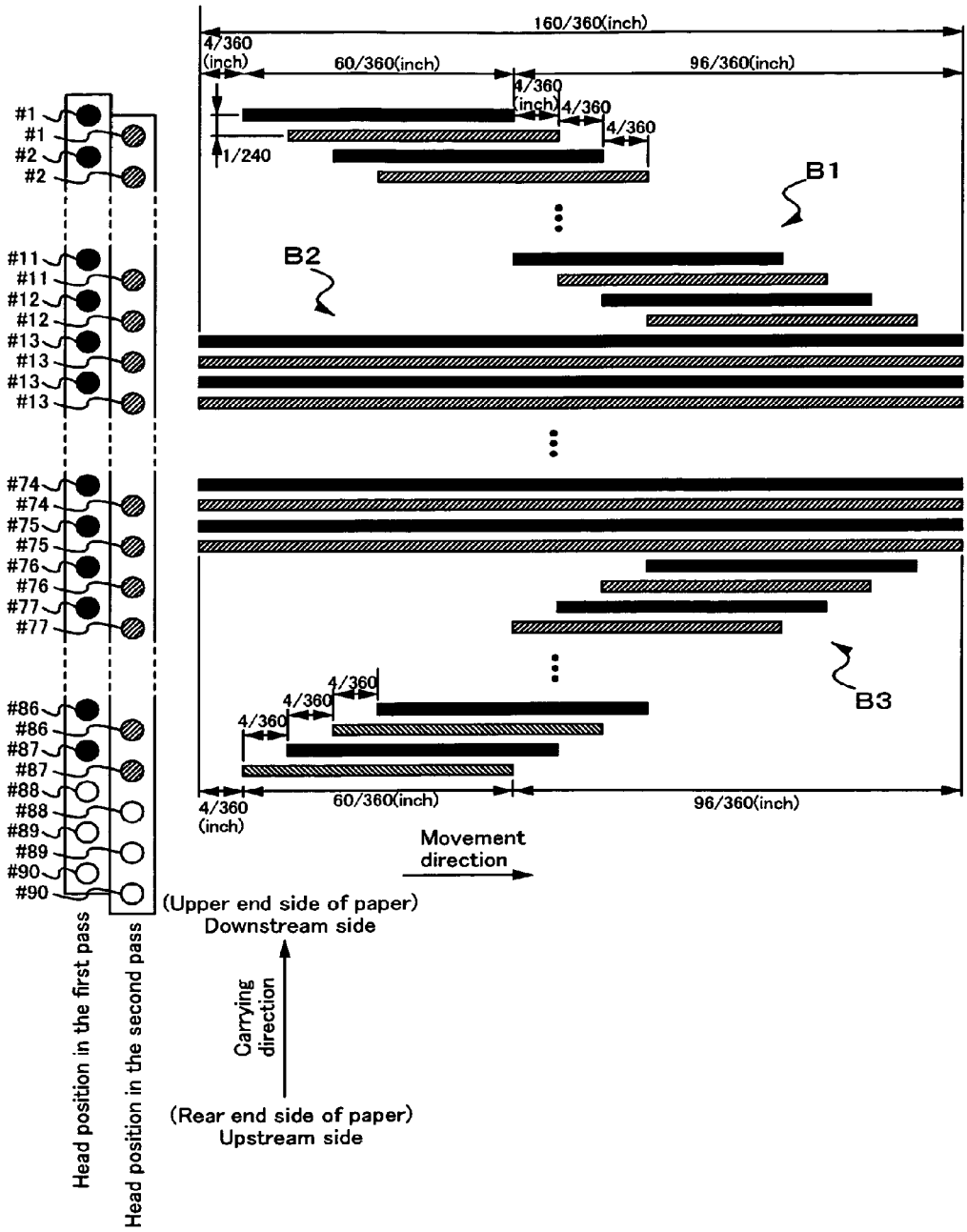
FIG. 16 is an explanatory diagram of the method for printing a pattern B.

FIG. 16 is an explanatory diagram of the method for printing the pattern B. The pattern B is also formed by two passes. In the left side of FIG. 16, the position of the head (position of the row B) with respect to the paper during the first and second passes are illustrated. When forming the pattern B, ink is ejected from the nozzles #1 to #87. The nozzles that eject ink are indicated by solid circle for the first pass and by hatching for the second pass. Although the head can move reciprocally in the movement direction, the head moves only in one direction when forming the pattern B. Here, it is assumed that the pattern B is formed while the head moves from the left to the right in FIG. 16.

In the right side of FIG. 16, raster lines that constitute the pattern B are illustrated. The raster lines formed during the first pass are indicated by solid line and the raster lines formed during the second pass are indicated by hatched line.

During the first pass, the nozzles #13 to #75 start ejecting ink when the head has reached a predetermined position in the movement direction. The nozzles #13 to #75 form a raster line of 160/360 inches that constitutes the rectangular pattern B2. After the nozzles #13 to #75 have moved 4/360 inches after they started ejecting ink, the nozzle #1 starts ejecting ink to form a raster line of 60/360 inches. The nozzles #1 to #12 respectively start ejecting ink to form a raster line of 60/360 inches after the respective nozzles adjacent thereto on the carrying direction downstream side have moved 8/360 inches after they respectively started ejecting ink. The raster lines formed by the nozzles #1 to #12 constitute the sloping pattern B1. The nozzle #87 starts ejecting ink to form a raster line of 60/360 inches after the nozzles #13 to #75 have moved 4/360 inches after they started ejecting ink. The nozzles #76 to #87 respectively start ejecting ink to form a raster line of 60/360 inches after the respective nozzles adjacent thereto on the carrying direction upstream side have moved 8/360 inches after they respectively started ejecting ink. The raster lines formed by the nozzles #76 to #87 constitute the sloping pattern B3.

After the first pass, the carrying process by a target carry amount of 18/4320 inches (1/240 inches), which corresponds to a half of the nozzle pitch, is performed. This carry amount is so small that the carrying error is also very small (can be ignored).

During the second pass, a raster line is formed between the raster lines formed during the first pass. During the second pass as well, the nozzles #13 to #75 start ejecting ink when the head has reached a predetermined position in the movement direction. The nozzles #13 to #75 form a raster line of 160/360 inches that constitutes the rectangular pattern B2. The nozzle #1 starts ejecting ink to form a raster line of 60/360 inches after the nozzles #13 to #75 have moved 8/360 inches after they started ejecting ink. The nozzles #1 to #12 respectively start ejecting ink to form a raster line of 60/360 inches after the respective nozzles adjacent thereto on the carrying direction downstream side have moved 8/360 inches after they respectively started ejecting ink. The raster lines formed by the nozzles #1 to #12 constitute the sloping pattern B1. The nozzle #87 starts ejecting ink to form a raster line of 60/360 inches after the nozzles #13 to #75 have moved 8/360 inches after they started ejecting ink. The nozzles #76 to #87 respectively start ejecting ink to form a raster line of 60/360 inches after the respective nozzles adjacent thereto on the carrying direction upstream side have moved 8/360 inches after they respectively started ejecting ink. The raster lines formed by the nozzles #76 to #87 constitute the sloping pattern B3. Since the sloping pattern B3 is formed by the nozzles #76 to #87, the sloping pattern B3 is formed by the same nozzles as the nozzles that form the pattern A.

The left extremity position in the movement direction of 24 raster lines that constitute the sloping pattern B1 gradually changes by 4/360 inches at a time. The right extremity position in the movement direction of 24 raster lines that constitute the sloping pattern B1, also gradually changes by 4/360 inches at a time. Accordingly, when the sloping pattern B1 is viewed macroscopically, a diagonal side that intersects both the carrying direction and the movement direction is formed. In the similar manner, when the sloping pattern B3 is viewed macroscopically, a diagonal side that intersects both the carrying direction and the movement direction is formed.

<Regarding the Method for Printing Pattern C>

Figure 17:
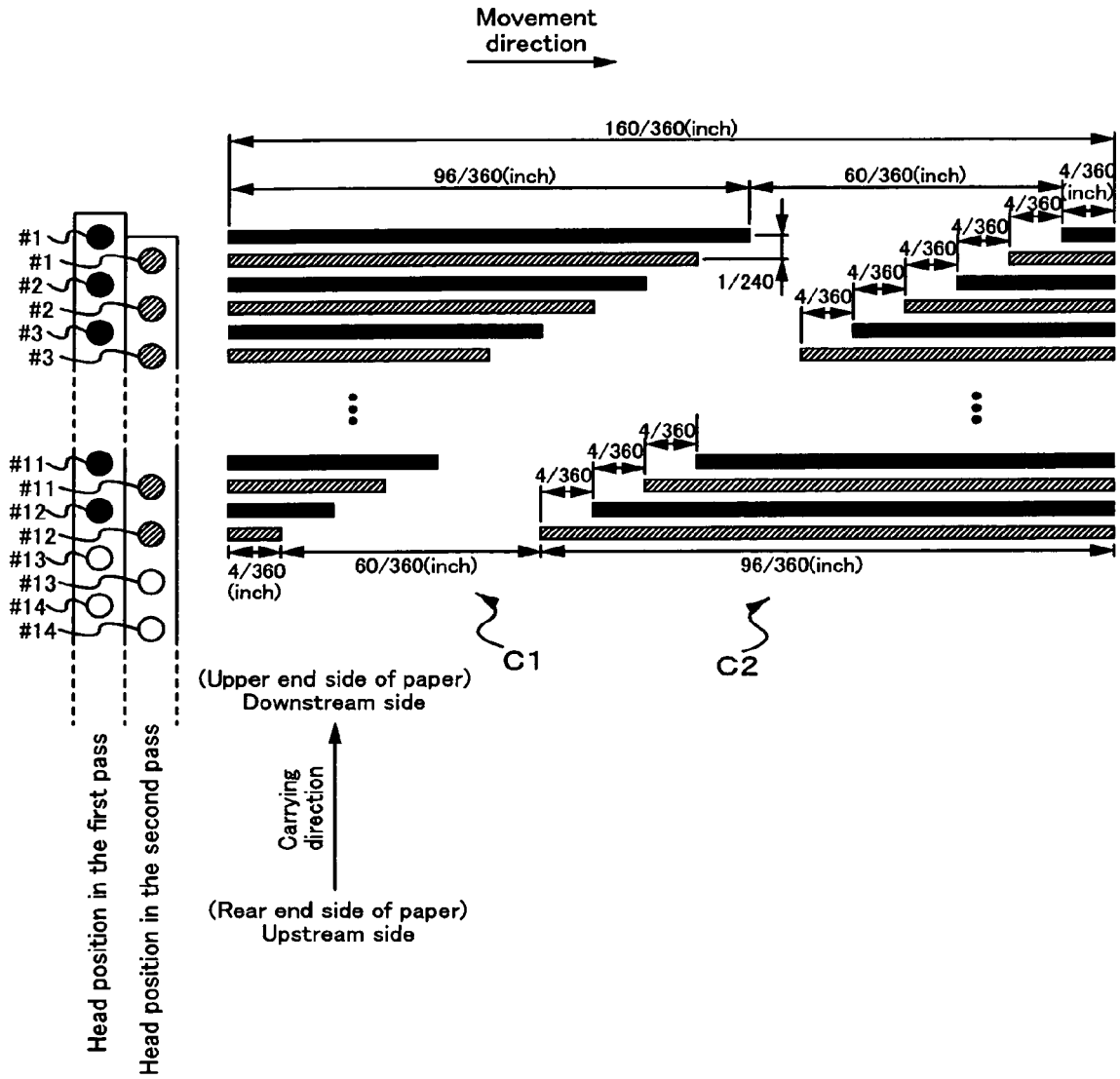
FIG. 17 is an explanatory diagram of the method for printing a pattern C.

FIG. 17 is an explanatory diagram of the method for printing the pattern C. The pattern C is also formed by two passes. In the left side of FIG. 17, the position of the head (position of the row B) with respect to the paper during the first and second passes are illustrated. When forming the pattern C, ink is ejected from the nozzles #1 to #12. The nozzles that eject ink are indicated by solid circle for the first pass and by hatching for the second pass. Although the head can move reciprocally in the movement direction, the head moves only in one direction when forming the pattern C. Here, it is assumed that the pattern C is formed while the head moves from the left to the right in FIG. 17.

In the right side of FIG. 17, raster lines that constitute the pattern C are illustrated. The raster lines formed during the first pass are indicated by solid line and the raster lines formed during the second pass are indicated by hatched line.

During the first pass, the nozzles #1 to #12 start ejecting ink when the head has reached a predetermined position in the movement direction. The nozzle #1 forms a raster line of 96/360 inches that constitutes the inverted trapezoid pattern C1 (in other words, forms 96 dots), and after an idle running section of 60/360 inches, forms a raster line of 4/360 inches that constitutes the trapezoid pattern C2 (in other words, forms 4 dots). Then, each nozzle forms a raster line that is shorter by 8/360 inches than the raster line formed by the nozzle adjacent thereto on the carrying direction downstream side to form a raster line that constitutes the inverted trapezoid pattern C1, and after an idle running section of 60/360 inches, forms a raster line that is longer by 8/360 inches than the raster line formed by the nozzle adjacent thereto on the carrying direction downstream side to form a raster line that constitutes the trapezoid pattern C2. Thereafter, ejection of ink from the nozzles #1 to #12 is stopped when the head has reached a predetermined position in the movement direction.

After the first pass, the carrying process by a target carry amount of 18/4320 inches (1/240 inches), which corresponds to a half of the nozzle pitch, is performed. This carry amount is so small that the carrying error is also very small (can be ignored).

During the second pass, a raster line is formed between the raster lines formed during the first pass. During the second pass as well, the nozzles #1 to #12 starts ejecting ink when the head has reached a predetermined position in the movement direction. The nozzle #1 forms a raster line of $^{92}/_{360}$ inches that constitutes the inverted trapezoid pattern C1 (in other words, forms 92 dots), and after an idle running section of $^{60}/_{360}$ inches, forms a raster line of $^{8}/_{360}$ inches that constitutes the trapezoid pattern C2 (in other words, forms 8 dots). Then, each nozzle forms a raster line that is shorter by $^{8}/_{360}$ inches than the raster line formed by the nozzle adjacent thereto on the carrying direction downstream side to form a raster line that constitutes the inversed trapezoid pattern C1, and after an idle running section of $^{60}/_{360}$ inches, forms a raster line that is longer by $^{8}/_{360}$ inches than the raster line formed by the nozzle adjacent thereto on the carrying direction downstream side to form a raster line that constitutes the trapezoid pattern C2. Thereafter, ejection of ink from the nozzles #1 to #12 is stopped when the head has reached a predetermined position in the movement direction. It should be noted that since the pattern C is formed by the nozzles #1 to #12, the pattern C is formed by the same nozzles as the nozzles that form the sloping pattern B1 of the pattern B.

The right extremity position in the movement direction of 24 raster lines that constitute the inversed trapezoid pattern C1 gradually changes by $^{4}/_{360}$ inches at a time. Accordingly, when the inversed trapezoid pattern C1 is viewed macroscopically, a diagonal side that intersects both the carrying direction and the movement direction is formed. Also, the left extremity position in the movement direction of 24 raster lines that constitute the trapezoid pattern C2 gradually changes by $^{4}/_{360}$ inches at a time. Accordingly, when the trapezoid pattern C2 is viewed macroscopically, a diagonal side that intersects both the carrying direction and the movement direction is formed.

With respect to 24 raster lines of the inversed trapezoid pattern C1, the length of the raster line becomes shorter the further upstream side in the carrying direction the raster line is. In contrast, with respect to 24 raster lines of the trapezoid pattern A1, the length of the raster line becomes longer the further upstream side in the carrying direction the raster line is. As a result, when viewed macroscopically, the diagonal side of the inversed trapezoid pattern C1 extends along a direction that intersects the diagonal side of the trapezoid pattern A1. In addition, with respect to 24 raster lines of the trapezoid pattern C2, the length of the raster line becomes longer the further upstream side in the carrying direction the raster line is. In contrast, with respect to 24 raster lines of the inverted trapezoid pattern A2, the length of the raster line becomes shorter the further upstream side in the carrying direction the raster line is. As a result, when viewed macroscopically, the diagonal side of the trapezoid pattern C2 extends along a direction that intersects the diagonal side of the inverted trapezoid pattern A2.

<Regarding the Method for Printing All Correction Patterns>

Figure 18:
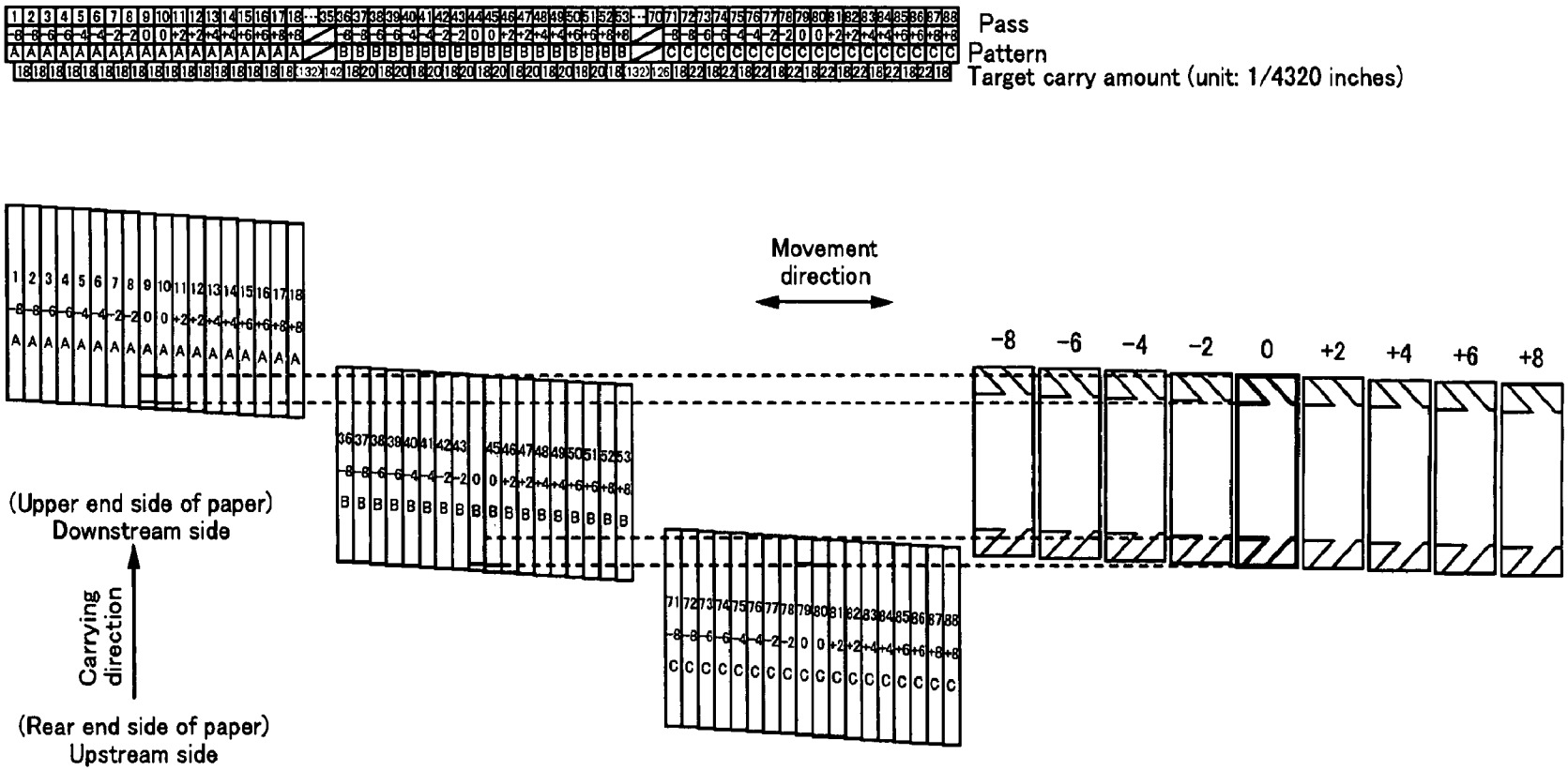
FIG. 18 is an explanatory diagram of the method for printing the test sheet.

FIG. 18 is an explanatory diagram of the method for printing the test sheet.

On the right side of FIG. 18, nine test patterns to be formed in the test sheet are shown.

On the left side of FIG. 18, the position of the head (position of the row B) with respect to the paper during each pass is illustrated. In the rectangle that indicates the position of the head, two figures and one of alphabet letters of A, B and C are indicated. The figure on the top indicates the pass number. The figure in the middle indicates the number of the correction pattern that is formed during that pass. The figure at the bottom indicates the name of the pattern that is formed during that pass. For example, the rectangle on the left extremity indicates the position of the head with respect to the paper during the initial pass (pass 1). During that pass, the pattern A of the correction pattern (−8) is formed.

In the table shown on the upper side of FIG. 18, the correction pattern number and the pattern name that are formed during each pass, as well as the target carry amount of the carrying process that is performed between the passes are indicated. According to this table also, it is indicated that the pattern A of the correction pattern (−8) is formed during the initial pass (pass 1). In addition, it is indicated in the table that the medium is carried by the carrying process that is performed between pass 1 and pass 2 by a target carry amount of $^{18}/_{4320}$ inches.

The pattern A of each correction pattern is formed from pass 1 to pass 18. The pattern A of each correction pattern is formed by two passes. For example, the pattern A of the correction pattern (0) is formed by passes 9 and 10. Therefore, in the pattern A of the correction pattern (0), the "first pass" in FIG. 15 corresponds to pass 9, and the "second pass" corresponds to pass 10. Between the two passes for forming the pattern A, the carrying process by a target carry amount of $^{18}/_{4320}$ inches is performed. After forming the pattern A for a certain correction pattern, the carrying process by a target carry amount of $^{18}/_{4320}$ inches is performed, and the pattern A for the subsequent correction pattern is formed. Accordingly, the pattern A of a certain correction pattern is formed shifted by $^{36}/_{4320}$ inches to the carrying direction upstream side, compared with the pattern A of the correction pattern that was formed immediately before the pattern A of that certain correction pattern.

After pass 18 and until pass 35, the carrying process by a target carry amount of $^{132}/_{4320}$ inches is repeated. From pass 19 to pass 35, ejection of ink and movement of the head are omitted and not performed because there is no pattern to form. Between pass 35 and pass 36, the carrying process by a target carry amount of $^{142}/_{4320}$ inches is performed.

The pattern B of each correction pattern is formed from pass 36 to pass 53. The pattern B of each correction pattern is formed by two passes. For example, the pattern B of the correction pattern (0) is formed by passes 44 and 45. Therefore, in the pattern B of the correction pattern (0), the "first pass" in FIG. 16 corresponds to pass 44, and the "second pass" corresponds to pass 45. Between the two passes for forming the pattern B, the carrying process by a target carry amount of $^{18}/_{4320}$ inches is performed. After forming the pattern B for a certain correction pattern, the carrying process by a target carry amount of $^{20}/_{4320}$ inches is performed, and the pattern B of the subsequent correction pattern is formed. Accordingly, the pattern B of a certain correction pattern is formed shifted by $^{38}/_{4320}$ inches to the carrying direction upstream side, compared with the pattern B of the correction pattern that was formed immediately before the pattern B of that certain correction pattern. As a result, the positional relation between the pattern A and pattern B of a certain correction pattern is more distant by $^{2}/_{4320}$ inches, compared with the positional relation of the correction pattern that was formed immediately before that certain correction pattern.

After pass 53 and until pass 70, the carrying process by a target carry amount of $^{132}/_{4320}$ inches is repeated. From pass 54 to pass 70, ejection of ink and movement of the head are omitted and not performed because there is no pattern to form. Between pass 70 and pass 71, the carrying process by a target carry amount of $^{126}/_{4320}$ inches is performed.

The pattern C of each correction pattern is formed from pass 71 to pass 88. The pattern C of each correction pattern is formed by two passes. For example, the pattern C of the correction pattern (0) is formed by passes 79 and 80. Therefore, in the pattern C of the correction pattern (0), the "first pass" in FIG. 17 corresponds to pass 79, and the "second pass" corresponds to pass 80. Between the two passes for forming the pattern C, the carrying process by a target carry amount of $^{18}/_{4320}$ inches is performed. After forming the pattern C for a certain correction pattern, the carrying process by a target carry amount of $^{22}/_{4320}$ inches is performed, and the pattern C of the subsequent correction pattern is formed. Accordingly, the pattern C of a certain correction pattern is formed shifted by $^{40}/_{4320}$ inches to the carrying direction upstream side, compared with the pattern C of the correction pattern that was formed immediately before the pattern C of that certain correction pattern. As a result, the positional relation between the pattern B and pattern C of a certain correction pattern is more distant by $^{2}/_{4320}$ inches, compared with the positional relation of the correction pattern that was formed immediately before that certain correction pattern.

Characteristics of the Correction Pattern

<Cases where the Carrying Error is not Present in Either the DC Component or AC Component>

FIG. 19 is an explanatory diagram showing what the correction patterns are like when the carrying error is not present in either the DC component or AC component. In FIG. 19, for the sake of convenience, the contour of the respective patterns is indicated by a line, and the inside of the patterns is left blank. However, the actual correction pattern is a solid pattern as shown in FIG. 13 when viewed macroscopically, and constituted by raster lines as shown in FIGS. 15 to 17 when viewed microscopically. In FIG. 19, the portion where patterns overlap is filled in black.

In the correction pattern (0), the position in the carrying direction of 24 raster lines that constitute the trapezoid pattern A1, 24 raster lines that constitute sloping pattern B1, and 24 raster lines that constitute inverted trapezoid pattern A2 are the same. Right between the right extremity of 24 raster lines that constitute the trapezoid pattern A1 and the left extremity of 24 raster lines that constitute the inverted trapezoid pattern A2, 24 raster lines that constitute the sloping pattern B1 are located. As a result, 24 raster lines that constitute the trapezoid pattern A1, 24 raster lines that constitute the sloping pattern B1, and 24 raster lines that constitute the inverted trapezoid pattern A2 are connected to one another as if 24 raster lines of $^{160}/_{360}$ inches. In other words, the trapezoid pattern A1 and the sloping pattern B1 are perfectly connected to each other, and the inverse trapezoid pattern A2 and the sloping pattern B1 are also perfectly connected to each other.

Therefore, in the correction pattern (0), the boundary A1B1 and boundary A2B1 cannot be recognized. In similar manner, the boundary C1B3 and boundary C2B3 cannot be recognized as well.

In the correction patterns associated with a minus figure, the pattern B is formed shifted to the carrying direction downstream side with respect to the pattern A. Specifically, the positional relation between the pattern A and pattern B of the correction patterns associated with a minus figure is closer than the positional relation between the pattern A and pattern B of the correction pattern (0). As a result, the trapezoid pattern A1 and the sloping pattern B1 become more distant from each other, and the inversed trapezoid pattern A2 and the sloping pattern B1 overlap.

Accordingly, in the correction patterns associated with a minus figure, the boundary A1B1 is recognized light and causes a white streak, and the boundary A2B1 is recognized dark and causes a black streak. In a similar manner, the boundary C1B3 is recognized light and causes a white streak, and the boundary C2B3 is recognized dark and causes a black streak.

Further, the larger the minus figure associated with the correction pattern is, the shorter the distance between the pattern A and pattern B, and the distance between the pattern B and pattern C become to a significant degree. As a result, the trapezoid pattern A1 and the sloping pattern B1 become significantly distant from each other, and the inversed trapezoid pattern A2 and the sloping pattern B1 significantly overlap. For this reason, the white streak and black streak is recognized more clearly in the correction pattern associated with the larger minus figure.

In the correction patterns associated with a plus figure, the pattern B is formed shifted to the carrying direction upstream side with respect to the pattern A. Specifically, the positional relation between the pattern A and pattern B of the correction patterns associated with a plus figure is more distant than the positional relation between the pattern A and pattern B of the correction pattern (0). As a result, the trapezoid pattern A1 and the sloping pattern B1 overlap, and the inversed trapezoid pattern A2 and the sloping pattern B1 become more distant from each other.

Accordingly, in the correction patterns associated with a plus figure, the boundary A1B1 is recognized dark and causes a black streak, and the boundary A2B1 is recognized light and causes a white streak. In a similar manner, the boundary C1B3 is recognized dark and causes a black streak, and the boundary C2B3 is recognized light and causes a white streak.

Further, the larger the plus figure associated with the correction pattern is, the longer the distance between the pattern A and pattern B, and the distance between the pattern B and pattern C become to a significant degree. As a result, the trapezoid pattern A1 and the sloping pattern B1 significantly overlap, and the inversed trapezoid pattern A2 and the sloping pattern B1 become significantly distant from each other. For this reason, the white streak and black streak is recognized more clearly in the correction pattern associated with the larger plus figure.

In the present embodiment, two boundaries (boundary A1B1 and boundary A2B1) are formed between the pattern A and pattern B. At the boundary A1B1, the trapezoid pattern A1 of the pattern A is located on the further carrying direction upstream side than the sloping pattern B1 of the pattern B. At the boundary A1B2, the sloping pattern B1 of the pattern B is located on the further carrying direction upstream side than the inverted trapezoid pattern A2 of the pattern A. By such a constitution, it becomes possible to cause both the white streak and black streak to appear at the boundary between the pattern A and pattern B, when the positional relation between the pattern A and pattern B changes. This improves the visibility for the inspection operator.

In a similar manner, in the present embodiment, two boundaries (boundary C1B3 and boundary C2B3) are formed between the pattern B and pattern C. At the boundary C1B3, the sloping pattern B3 of the pattern B is located on the further carrying direction upstream side than the inversed trapezoid pattern C1 of the pattern C. At the boundary C2B3, the trapezoid pattern C2 of the pattern C is located on the further carrying direction upstream side than the sloping pattern B3 of the pattern B. By such a constitution, it becomes possible to cause both the white streak and black streak to appear at the boundary between the pattern B and pattern C, when the positional relation between the pattern B and pattern C changes. This improves the visibility for the inspection operator.

Also in the present embodiment, the boundary A1B1 and the boundary A2B1 are parallel. Therefore, the white streak and black streak appear substantially in the same width regardless of the direction to which the positional relation between the pattern A and pattern B is shifted, and good visibility is achieved for the inspection operator. In a similar manner, since the boundary C1B3 and the boundary C2B3 are parallel, good visibility is achieved for the inspection operator.

<Cases where the Carrying Error is Present in the DC Component>

Next, a case in which only the DC component carrying error is present is described. Here, a case in which the paper is carried by a carry amount larger than the target carry amount is described.

Figure 20A:
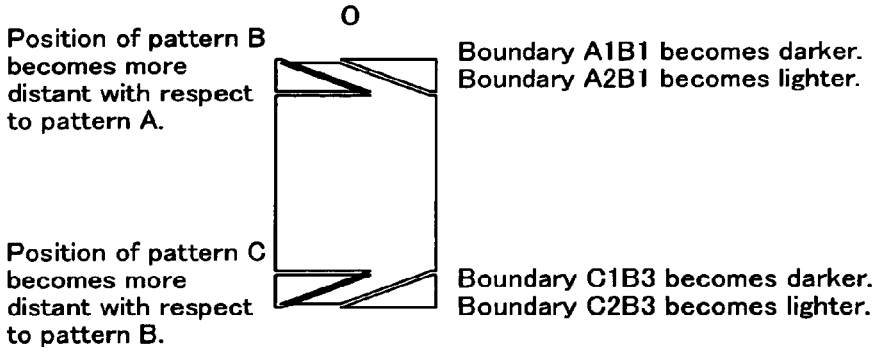
FIG. 20A is an explanatory diagram showing what a correction pattern (0) is like when paper is carried by a carry amount larger than a target carry amount.

FIG. 20A is an explanatory diagram showing what the correction pattern (0) is like when the paper is carried by a carry amount larger than the target carry amount.

In this case, since the paper is carried by a carry amount larger than the target carry amount, the carry amount of the carrying process that is performed from pass 10 for forming the pattern A to pass 44 for forming the pattern B of the correction pattern (0) is larger than the target carry amount. Therefore, the pattern B of the correction pattern (0) is formed shifted to the carrying direction upstream side compared with the case in which no carrying error is present. In other words, since the paper is carried by an amount larger than the target carry amount, the positional relation between the pattern A and pattern B becomes more distant. As a result, the trapezoid pattern A1 and the sloping pattern B1 overlap, and the inversed trapezoid pattern A2 and the sloping pattern B1 become more distant from each other. Accordingly, in the correction pattern (0), the boundary A1B1 is recognized dark and causes a black streak, and the boundary A2B1 is recognized light and causes a white streak. In a similar manner, in the correction pattern (0), the boundary C1B3 is recognized dark and causes a black streak, and the boundary C2B3 is recognized light and causes a white streak.

In other words, the boundary of the correction pattern (0) in the case where paper is carried by a carry amount larger than the target carry amount is similar to the boundary of the correction patterns associated with a plus figure obtained when no carrying error is present.

Figure 20B:
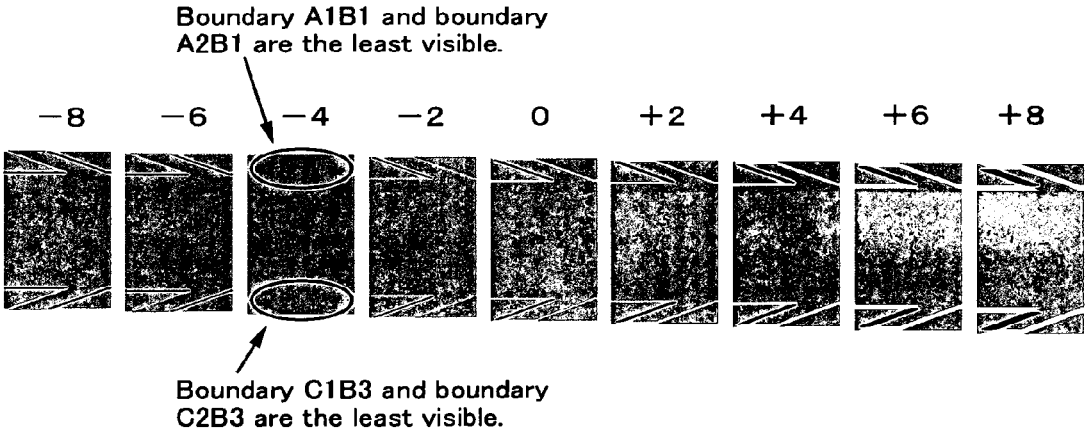
FIG. 20B is an explanatory diagram showing what nine correction patterns are like in the case described above.

FIG. 20B is an explanatory diagram showing what nine correction patterns are like in the case described above.

In this case, since the paper is carried by a carry amount larger than the target carry amount, the positional relation between the pattern A and pattern B of each correction pattern is more distant compared with the case in which no carrying error is present. As a result, the white streak and black streak in the correction patterns associated with a minus figure is reduced.

If, during a half rotation of the carry roller 23, the paper is carried by a carry amount larger by, for example, 4/4320 inches than the target carry amount, in the correction pattern (−4) in which the positional relation between the pattern A and pattern B is closer by 4/4320 inches than in the correction pattern (0), the boundary A1B1 and boundary A2B1 become less visible. In a similar manner, if during a half rotation of the carry roller 23, the paper is carried by a carry amount larger by, for example, 4/4320 inches than the target carry amount, in the correction pattern (−4) in which the positional relation between the pattern B and pattern C is closer by 4/4320 inches than in the correction pattern (0), the boundary C1B3 and boundary C2B3 become less visible.

In other words, a minus figure is assigned to the correction patterns in which the boundary A1B1 and boundary A2B1 become less visible when the paper is carried by a carry amount larger than the target carry amount. In a similar manner, a minus figure is assigned to the correction patterns in which the boundary C1B3 and boundary C2B3 become less visible when the paper is carried by a carry amount larger than the target carry amount.

In contrast, a plus figure is assigned to the correction patterns in which the boundary A1B1 and boundary A2B1 become less visible when the paper is carried by a carry amount smaller than the target carry amount. In a similar manner, a plus figure is assigned to the correction patterns in which the boundary C1B3 and boundary C2B3 become less visible when the paper is carried by a carry amount smaller than the target carry amount.

As described above, when only the DC component carrying error is present, the correction pattern in which the boundary A1B1 and boundary A2B1 are the least visible, and the correction pattern in which the boundary C1B3 and boundary C2B3 are the least visible are the same. The greater the DC component carrying error is, the more distant from the correction pattern (0) is the correction pattern in which the boundaries are the least visible.

Accordingly, when only the DC component carrying error is present, the figure associated with the correction pattern in which the boundaries are the least visible reflects the DC component carrying error. The figure also indicates the value that corresponds to the correction value for correcting the DC component carrying error.

<Cases Where the AC Component Carrying Error is Present>

Next, a case in which only the AC component carrying error is present is described. Here, it is assumed that the AC component carrying error as shown in FIG. 11A is generated, and the rotation start position of the carry roller when forming the pattern A is the position after a one-fourth rotation from the reference position. In other words, in the carrying process performed between the formation of the pattern A and pattern B, the paper is carried by a carry amount smaller than the target carry amount, and in the carrying process performed between the formation of the pattern B and pattern C, the paper is carried by a carry amount larger than the target carry amount.

Figure 21A:
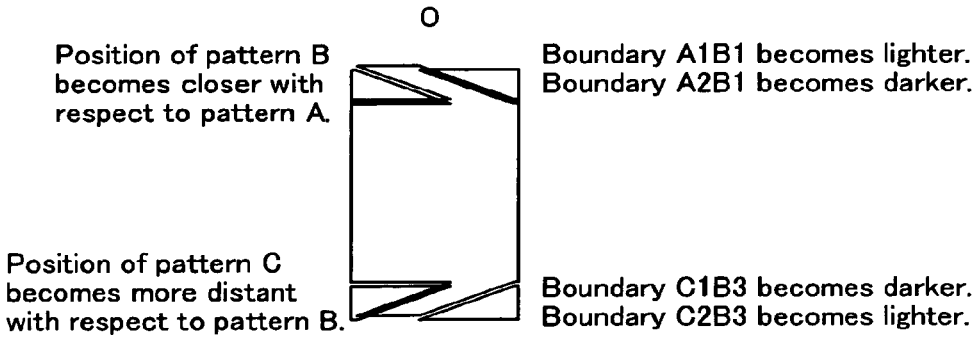
FIG. 21A is an explanatory diagram showing what the correction pattern (0) is like when the AC component carrying error is present.

FIG. 21A is an explanatory diagram showing what the correction pattern (0) is like when the AC component carrying error is present.

The pattern B of the correction pattern (0) is formed after the paper is carried by a carry amount smaller than the target carry amount, the pattern B is formed shifted to the carrying direction downstream side compared with the case where no carrying error is present. Therefore, the positional relation between the pattern A and pattern B becomes closer. As a result, the trapezoid pattern A1 and the sloping pattern B1 become more distant from each other, and the inversed trapezoid pattern A2 and the sloping pattern B1 overlap. Accordingly, in the correction pattern (0), the boundary A1B1 is recognized light and causes a white streak, and the boundary A2B1 is recognized dark and causes a black streak. In other words, in this case, the boundary of the upper portion of the correction pattern (0) is similar to the boundary of the upper portion of the correction patterns associated with a minus figure obtained when no carrying error is present.

On the other hand, the AC component carrying error is indicated by a substantial sine curve, and a carry amount for a half rotation of the carry roller performed after the pattern B is formed until the formation of the pattern C is started contains the carrying error that is opposite to the carrying error contained in a carry amount for a half rotation of the carry roller performed after the pattern A is formed until the formation of the pattern B is started. Therefore, the positional relation between the pattern B and pattern C becomes more distant contrary to the positional relation between the pattern A and pattern B. As a result, the inverse trapezoid pattern C1 and the sloping pattern B3 overlap, and the trapezoid pattern C2 and the sloping pattern B3 become more distant. Accordingly, in the correction pattern (0), the boundary C1B3 is recognized dark and causes a black streak, and the boundary C2B3 is recognized light and causes a white streak. In other words, in this case, the boundary of the lower portion of the correction pattern (0) is similar to the boundary of the lower portion of the correction patterns associated with a plus figure obtained when no carrying error is present.

Figure 21B:
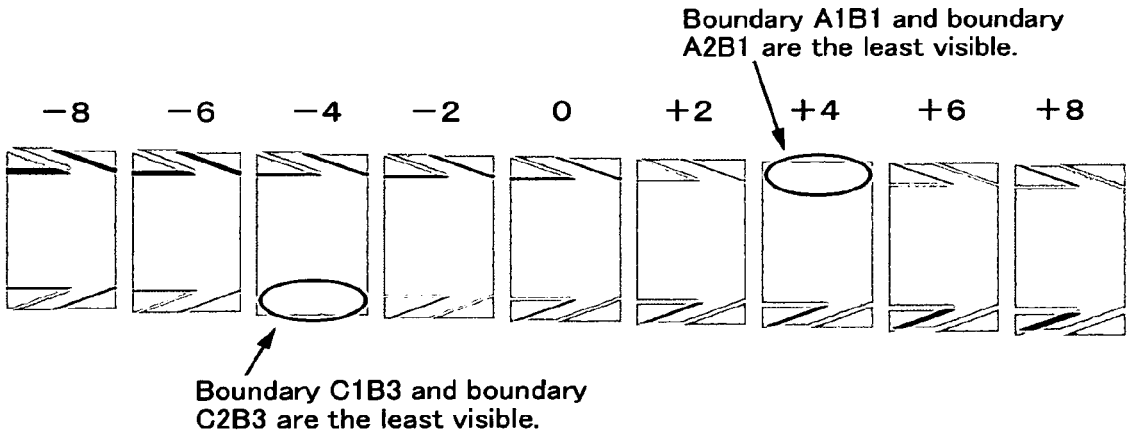
FIG. 21B is an explanatory diagram showing what the nine correction patterns are like in the case described above.

FIG. 21B is an explanatory diagram showing what the nine correction patterns are like in the case described above.

In this case, when the positional relation between the pattern A and pattern C of each correction pattern is focused, only the AC component carrying error is present, and no DC component carrying error is present. Therefore, the positional relation is the same as the positional relation between the pattern A and pattern C in FIG. 19. Provided that the pattern B is shifted to the carrying direction downstream side with respect to the pattern A and pattern C as affected by the AC component carrying error.

Since the positional relation between the pattern A and pattern B of each correction pattern is closer compared with the case where no carrying error is present, as a result, the white streak and black streak in the correction patterns associated with a plus figure is reduced. In contrast, since the positional relation between the pattern B and pattern C of each correction pattern is more distant compared with the case where no carrying error is present, as a result, the white streak and black streak in the correction patterns associated with a minus figure is reduced.

It is assumed that the position of the pattern B is shifted by $4/4320$ inches to the carrying direction downstream side with respect to the pattern A and pattern C as affected by the AC component carrying error. In such a case, the boundary A1B1 and boundary A2B1 become the least visible in the correction pattern (+4) in which the positional relation between the pattern A and pattern B is more distant by $4/4320$ inches than in the correction pattern (0). On the other hand, the boundary C1B3 and boundary C2B3 become the least visible in the correction pattern (−4) in which the positional relation between the pattern B and pattern C is closer by $4/4320$ inches than in the correction pattern (0).

As described above, when only the AC component carrying error is present, the correction pattern in which the boundary A1B1 and boundary A2B1 are the least visible, and the correction pattern in which the boundary C1B3 and boundary C2B3 are the least visible are located on the opposite sides with respect to the correction pattern (0). In other words, the correction pattern (0) is located in the middle of the correction pattern in which the boundary A1B1 and boundary A2B1 are the least visible and the correction pattern in which the boundary C1B3 and boundary C2B3 are the least visible. Moreover, the greater the AC component carrying error is, the more distant from the correction pattern (0) is the correction pattern in which the boundaries are the least visible.

When both of the DC component and AC component carrying errors are present, a state in which the above-described states shown in FIGS. 20B and 21B are overlapped is realized. Specifically, in such a case, the correction pattern in which the boundary A1B1 and boundary A2B1 are the least visible and the correction pattern in which the boundary C1B3 and boundary C2B3 are the least visible are located on the opposite sides with respect to the correction pattern associated with the figure corresponding to the DC component carrying error. In other words, the correction pattern associated with the figure corresponding to the DC component carrying error is located in the middle of the correction pattern in which the boundary A1B1 and boundary A2B1 are the least visible, and the correction pattern in which the boundary C1B3 and boundary C2B3 are the least visible.

<Cases where Displacement in the Landing Position is Present>

Figure 22:
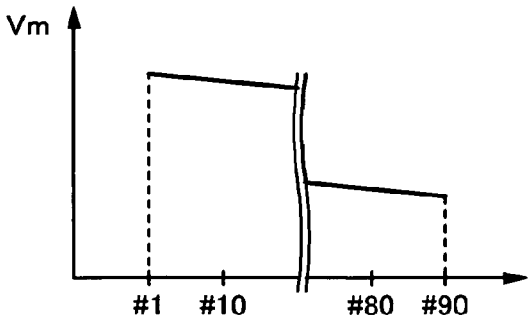
FIG. 22 is an explanatory diagram of an ink ejection speed Vm of each nozzle.

FIG. 22 is an explanatory diagram of the ink ejection speed Vm of the nozzles. The ink ejection speed Vm of the nozzles differs due to variance in manufacturing of the head or the like. The nozzles adjacent to each other have a similar ink ejection speed, but the ink ejection speed Vm of the nozzles distant from each other may significantly differ. In this case, the nozzles on the carrying direction downstream side (nozzles near the nozzle #1) have a faster ink ejection speed than that of the nozzles on the carrying direction upstream side (nozzles near the nozzle #90).

When ink is ejected from the nozzles that are moving in the movement direction, an ink droplet ejected from the nozzle at the faster ink ejection speed lands on the medium earlier, and therefore the dot formed by the nozzle whose ink ejection speed is fast is formed on the further upstream side in movement direction compared with the dot formed by the nozzle whose ink ejection speed is slow. Therefore, the pattern formed by nozzles on the carrying direction downstream side (nozzles near the nozzle #1) is located on the further upstream side in the movement direction compared with the pattern formed by the nozzles on the carrying direction upstream side (nozzles near the nozzle #90).

Figure 23A:
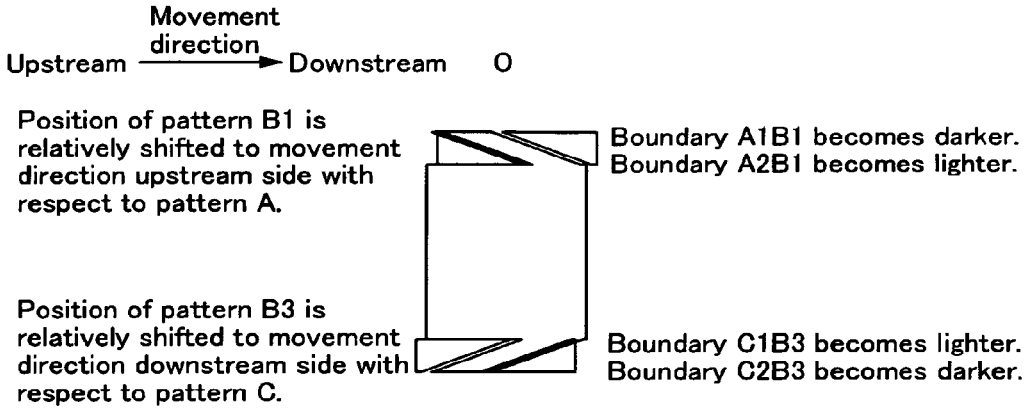
FIG. 23A is an explanatory diagram of the correction pattern (0) obtained when the ink ejection speed Vm differs in the nozzles.

FIG. 23A is an explanatory diagram of the correction pattern (0) obtained when the ink ejection speed Vm differs.

The trapezoid pattern A1 and the inversed trapezoid pattern A2 are formed by the nozzles on the carrying direction upstream side (nozzles #76 to #86), and the sloping pattern B1 is formed by the nozzles on the carrying direction downstream side (nozzles #1 to #12). Therefore, the trapezoid pattern A1 and the inversed trapezoid pattern A2 are relatively located on the movement direction downstream side (right side in FIG. 23A) with respect to the sloping pattern B1. As a result, the trapezoid pattern A1 and the sloping pattern B1 overlaps, and the inversed trapezoid pattern A2 and the sloping pattern B1 become more distant from each other. Accordingly, in the correction pattern (0), the boundary A1B1 is recognized dark and causes a black streak, and the boundary A2B1 is recognized light and causes a white streak. That is, the boundary A1B1 and boundary A2B1 of the correction pattern (0) in this case are similar to the boundary A1B1 and boundary A2B1 of the correction patterns associated with a plus figure obtained when no carrying error is present (provided that the boundary A1B2 is in a different state).

The inversed trapezoid pattern C1 and the trapezoid pattern C2 are formed by the nozzles on the carrying direction downstream side (nozzles #1 to #12), and the sloping pattern B3 is formed by the nozzles on the carrying direction upstream side (nozzles #76 to #86). Therefore, the inversed trapezoid pattern C1 and the trapezoid pattern C2 are relatively located on the movement direction upstream side (left side in FIG. 23A) with respect to the sloping pattern B3. As a result, the inverted trapezoid pattern C1 and the sloping pattern B3 become more distant from each other, and the trapezoid pattern C2 and the sloping pattern B3 overlap. Accordingly, in the correction pattern (0), the boundary C1B3 is recognized light and causes a white streak, and the boundary C2B3 is recognized dark and causes a black streak. That is, the boundary C1B3 and boundary C2B3 of the correction pattern (0) are similar to the boundary C1B3 and boundary C2B3 of the correction patterns associated with a minus figure obtained when no carrying error is present (provided that the boundary C1B2 is in a different state).

The nozzles that form the pattern A and the nozzles that form the sloping pattern B3 are the same. In addition, in the correction patterns, the nozzles that form the sloping pattern B1 and the nozzles that form the pattern C are the same. For this reason, the change amount in the relative positional relation of the pattern A with respect to the sloping pattern B1 and that of the sloping pattern B3 with respect to the pattern C are the same. In other words, the pattern C is shifted to the left side with respect to the sloping pattern B3 by the amount by which the pattern A is shifted to the right side with respect to the sloping pattern B1.

Figure 23B:
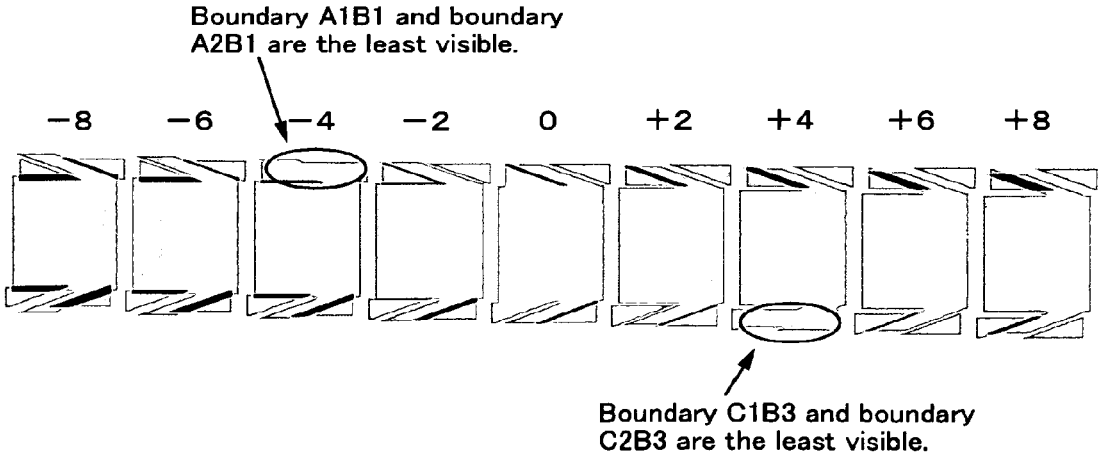
FIG. 23B is an explanatory diagram showing what the nine correction patterns are like in the case described above.

FIG. 23B is an explanatory diagram showing what the nine correction patterns are like in the case described above.

The pattern A of each correction pattern is located relatively on the movement direction downstream side (right side in FIG. 23B) with respect to the sloping pattern B1 of the pattern B. The sloping pattern B3 of the pattern B in each correction pattern is located relatively on the movement direction upstream side (left side in FIG. 23B) with respect to the pattern C.

In the correction patterns associated with a minus figure, the positional relation between the pattern A and pattern B is closer than in the correction pattern (0). Therefore, in the correction patterns associated with a minus figure, the black streak at the boundary A1B1 and the white streak at the boundary A2B1 are reduced than in the correction pattern (0).

In the correction patterns associated with a plus figure, the positional relation between the pattern B and pattern C becomes more distant than in the correction pattern (0). Therefore, in the correction patterns associated with a plus figure, the white streak at the boundary C1B3 and the black streak at the boundary C2B3 are reduced than in the correction pattern (0).

In the correction patterns, the pattern C is shifted to the left side with respect to the sloping pattern B3 by the amount by which the pattern A is shifted to the right side with respect to the sloping pattern B1. Therefore, the correction pattern in which the boundary A1B1 and boundary A2B1 are the least visible and the correction pattern in which the boundary C1B3 and boundary C2B3 are the least visible are located on the opposite sides with respect to the correction pattern (0). In other words, the correction pattern (0) is located in the middle of the correction pattern in which the boundary A1B1 and boundary A2B1 are the least visible and the correction pattern in which the boundary C1B3 and boundary C2B3 are the least visible. For example, in FIG. 23B, the correction pattern (−4) in which the boundary A1B1 and boundary A2B1 are the least visible and the correction pattern (+4) in which the boundary C1B3 and boundary C2B3 are the least visible are located on the opposite sides with respect to the correction pattern (0). It should be noted that the greater is the difference in the ink ejection speed in the nozzles, the more distant from the correction pattern (0) is the correction pattern in which the boundaries are the least visible.

At the boundary A1B2 of the correction pattern (−4) in which the boundary A1B1 and boundary A2B1 are the least visible, a black streak appears. At the boundary C1B2 of the correction pattern (+4) in which the boundary C1B3 and boundary C2B3 are the least visible, a white streak appears. Provided that, as described below, the boundary A1B2 and boundary C1B2 are not used in the inspection.

In the case where the DC component carrying error is present and the ink ejection speed differs in the nozzles, a state in which the above-described states shown in FIGS. 20B and 23B are overlapped is realized. Specifically, in such a case, the correction pattern in which the boundary A1B1 and boundary A2B1 are the least visible and the correction pattern in which the boundary C1B3 and boundary C2B3 are the least visible are located on the opposite sides with respect to the correction pattern associated with the figure corresponding to the DC component carrying error. In other words, the correction pattern associated with the figure corresponding to the DC component carrying error is located in the middle of the correction pattern in which the boundary A1B1 and boundary A2B1 are the least visible and the correction pattern in which the boundary C1B3 and boundary C2B3 are the least visible.

In addition, both of the case in which the AC component carrying error is present and the case in which the ink ejection speed differs in the nozzles, the correction pattern in which the boundary A1B1 and boundary A2B1 are the least visible and the correction pattern in which the boundary C1B3 and boundary C2B3 are the least visible are located on the opposite sides with respect to the correction pattern associated with the figure corresponding to the DC component carrying error. For this reason, when the AC component carrying error is present and the ink ejection speed differs in the nozzles, even if a state in which the above-described states shown in FIGS. 21B and 23B are overlapped is realized, the correction pattern in which the boundary A1B1 and boundary A2B1 are the least visible and the correction pattern in which the boundary C1B3 and boundary C2B3 are the least visible are located on the opposite sides with respect to the correction pattern associated with the figure corresponding to the DC component carrying error. In other words, the correction pattern associated with the figure corresponding to the DC component carrying error is located in the middle of the correction pattern in which the boundary A1B1 and boundary A2B1 are the least visible and the correction pattern in which the boundary C1B3 and boundary C2B3 are the least visible.

Figure 24A:
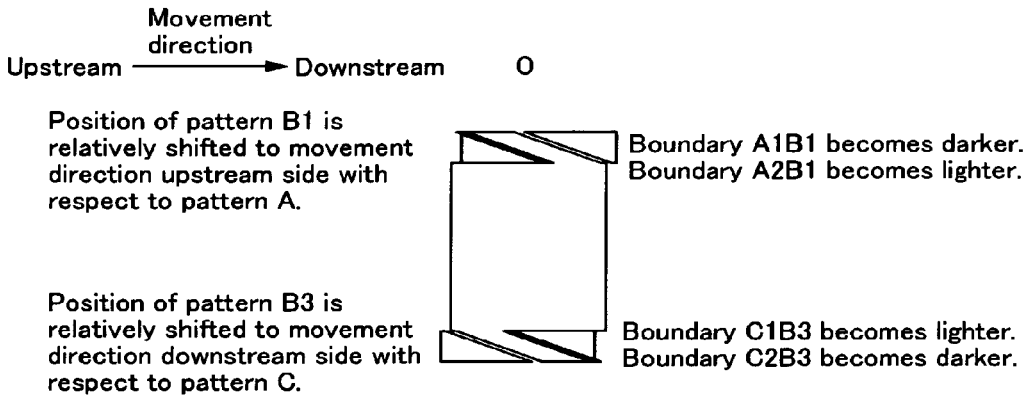
FIG. 24A is an explanatory diagram of the correction pattern of a comparative example.

FIG. 24A is an explanatory diagram of the correction pattern of the comparative example. In the correction pattern of the comparative example, the direction of the diagonal side of the sloping pattern B3 is the same as the direction of the diagonal side of the sloping pattern B1.

Figure 24B:
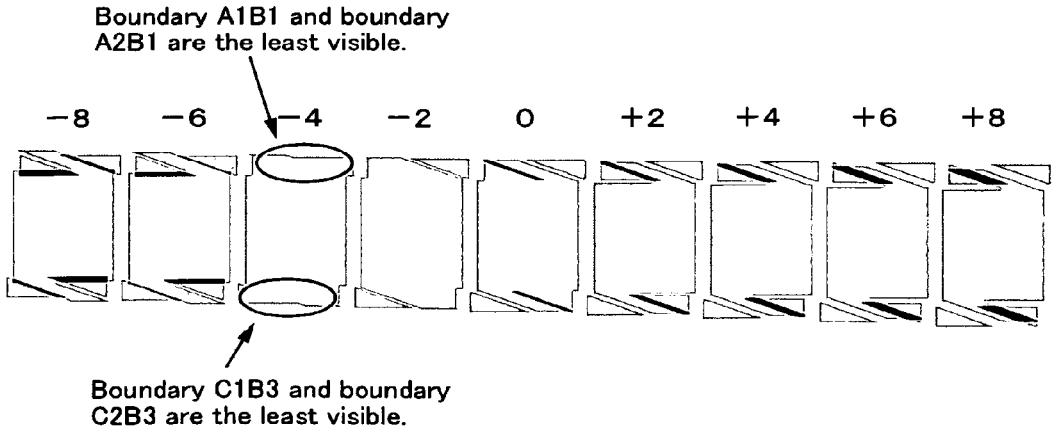
FIG. 24B is an explanatory diagram showing what the nine correction patterns are like in the comparative example.

FIG. 24B is an explanatory diagram showing what nine correction patterns are like in the comparative example. Here, for the sake of convenience, neither the DC component carrying error nor the AC component carrying error is present, and simply the ink ejection speed differs in the nozzles. As shown in FIG. 24B, in such a case, the correction pattern in which the boundary A1B1 and boundary A2B1 are the least visible and the correction pattern in which the boundary C1B3 and boundary C2B3 are the least visible are the same. If the DC component carrying error and the AC component carrying error are present in such a state, it is not guaranteed that the correction pattern associated with the figure corresponding to the DC component carrying error is located in the middle of the correction pattern in which the boundary A1B1 and boundary A2B1 are the least visible and the correction pattern in which the boundary C1B3 and boundary C2B3 are the least visible.

Method for Inspecting Test Sheet

Figure 25:
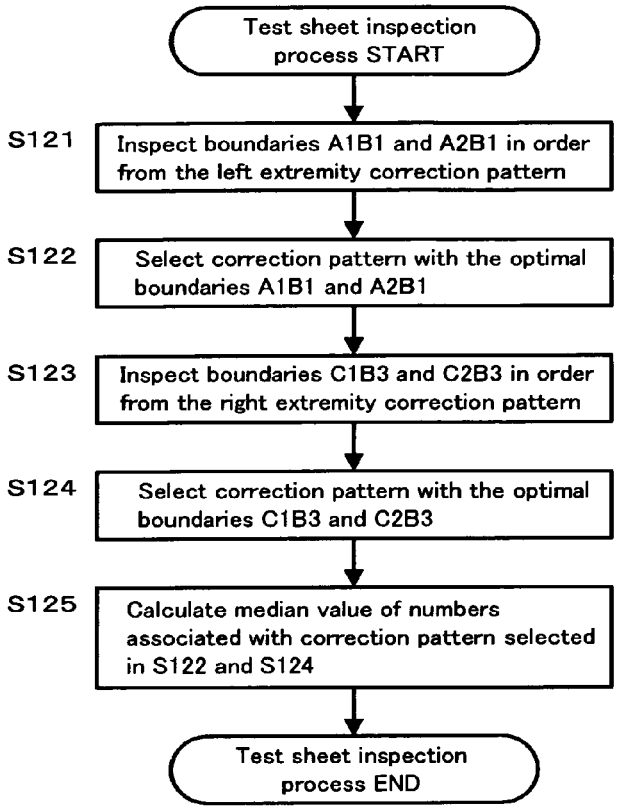
FIG. 25 is a flowchart of the method for inspecting the test sheet.
Figure 26:
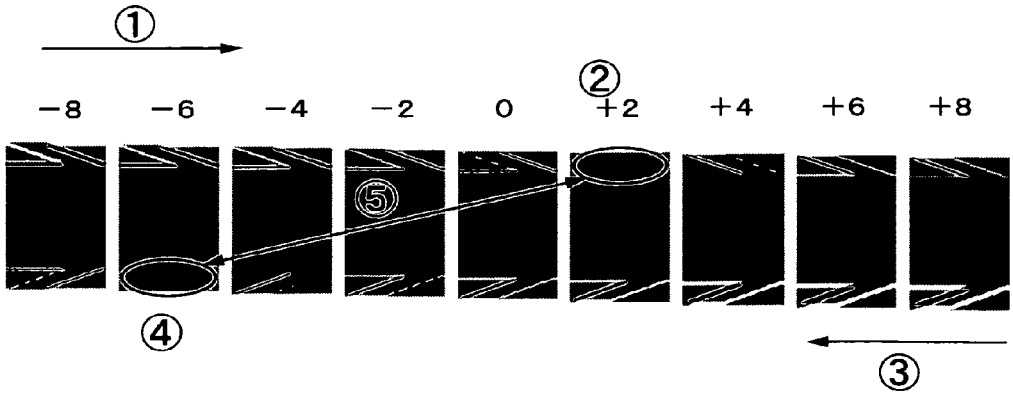
FIG. 26 is an explanatory diagram of inspection processes of the test sheet.

FIG. 25 is a flowchart of the method for inspecting the test sheet. FIG. 26 is an explanatory diagram of the inspection processes of the test sheet. Thereafter, the method for inspecting the test sheet of the present embodiment is described with reference to these figures.

First, the inspection operator inspects the boundary A1B1 and boundary A2B1 that are located in the upper portion (carrying direction downstream side) of the correction pattern in order from the correction pattern on the extreme left (see S121 in FIG. 25 and circled number 1 in FIG. 26). In the correction pattern (−8) that is inspected first, a white streak appears at the boundary A1B1, and a black streak appears at the boundary A2B1. The further right side to the correction pattern (−8) is the location of the correction pattern, the more the white streak at the boundary A1B1 and the black streak at the boundary A2B1 are reduced. The state of the boundary A1B2 (the boundary along the movement direction) is ignored when the boundary of the upper portion of the correction pattern is inspected.

Then, the inspection operator selects the correction pattern with the optimal boundary A1B1 and boundary A2B1 (see S122 in FIG. 25 and circled number 2 in FIG. 26). Here, the correction pattern in which the boundary A1B1 and boundary A2B1 are the least visible, specifically, the correction pattern in which a diagonal white streak and black streak are the least visible in the upper portion of the correction pattern, is selected as the correction pattern with the optimal boundary A1B1 and boundary A2B1. In this case, the inspection operator would select the correction pattern (+2) (the correction patterns to the right side of the correction pattern (+2) contain a black streak at the boundary A1B1, and a white streak at the boundary A2B1). Even if the white streak or black streak are present at the boundary A1B2, determination on the optimal boundary A1B1 and boundary A2B1 is not affected at all.

Next, the inspection operator inspects the boundary C1B3 and boundary C2B3 that are located in the lower portion (carrying direction upstream side) of the correction pattern in order from the correction pattern on the extreme right (see S123 in FIG. 25 and circled number 3 in FIG. 26). In the correction pattern (+8) that is inspected first, a black streak appears at the boundary C1B3, and a white streak appears at the boundary C2B3. The further left side to the correction pattern (+8) is the location of the correction pattern, the more the black streak at the boundary C1B3 and the white streak at the boundary C2B3 are reduced. The state of the boundary C1B2 (the boundary along the movement direction) is ignored when the boundary of the lower portion of the correction pattern is inspected.

Then, the inspection operator selects the correction pattern with the optimal boundary C1B3 and boundary C2B3 (see S124 in FIG. 25 and circled number 4 in FIG. 26). Here, the correction pattern in which the boundary C1B3 and boundary C2B3 are the least visible, specifically, the correction pattern in which the diagonal white streak and black streak are the least visible in the lower portion of the correction pattern is selected as the correction pattern with the optimal boundary C1B3 and boundary C2B3. In this case, the inspection operator would select the correction pattern (−6) (the correction pattern to the left side of the correction pattern (−6) contains a white streak at the boundary C1B3, and a black streak at the boundary C2B3). Even if the white streak or black streak is present at the boundary C1B2, determination on the optimal boundary C1B3 and boundary C2B3 is not affected at all.

Subsequently, the inspection operator calculates the median value of the numbers of the correction patterns selected in S122 and S124 (S125). In this case, since the correction pattern (+2) is selected in S122 and the correction pattern (−6) in S124, "−2" is obtained as the median value.

This median value is the value that indicates the DC component carrying error. The correction pattern (−2) associated with this median value is different from the correction pattern (+2) and correction pattern (−6) containing the optimal boundaries because of effects of the AC component carrying error or ink ejection speed of the nozzles. In other words, even if effects of the AC component carrying error or of the ink ejection speed of the nozzles is present, the median value of the numbers of the correction pattern (+2) and correction pattern (−6) including the optimal boundaries represents the value that indicates the DC component carrying error.

Thereafter, the inspection operator inputs the calculated median value to the computer for the inspection that is connected to a printer. The computer for the inspection determines the correction value based on the input median value (S103), and stores the correction value in the memory of the printer (S104). This correction value is for correcting the DC component carrying error. That is, the correction value indicates the correction amount when the target carry amount is 1.25 inches, which corresponds to a single rotation of the carry roller.

In this way, for each printer manufactured at the manufacturing plant, the correction value that is suitable for each printer is stored in the memory of each printer.

Then, when printing is performed at the place of the user who has purchased the printer, the controller 60 corrects a target carry amount for one rotation of the carry roller based on the correction value, and performs the carrying process based on the corrected target carry amount. As a result, the paper is carried by the target carry amount and the image quality of the printed image is improved.

<Method for Inspecting the Comparative Example>

Figure 27:
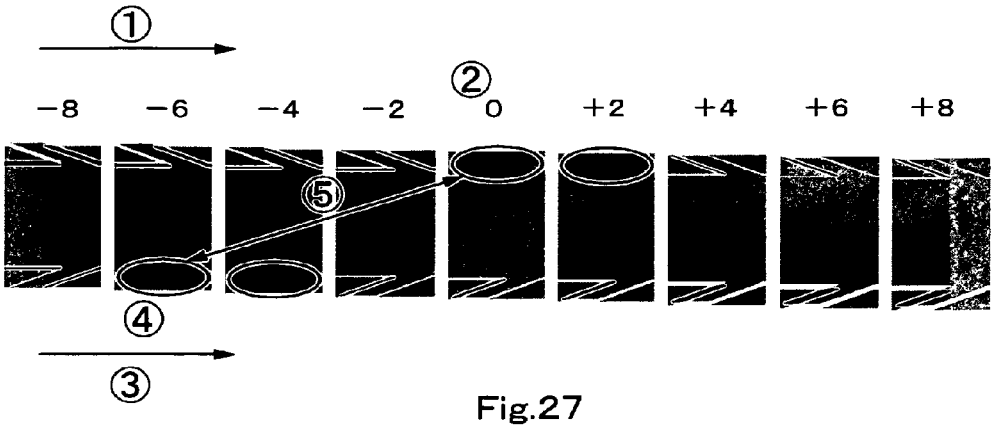
FIG. 27 is an explanatory diagram of the inspection processes of the comparative example.

FIG. 27 is an explanatory diagram of the inspection processes of the comparative example. In the comparative example, in step S123 of the flow of the above-described inspection method, the inspection is conducted not from the right extremity, but from the left extremity (circled number 3 in FIG. 27).

In this example, since the AC component carrying error is a little smaller than in FIG. 26, it is impossible to determine which of the correction pattern (0) and correction pattern (+2) is better in determining the boundary A1B1 and boundary A2B1 in the upper portion of the correction pattern. In a similar manner, it is impossible to determine which of the correction pattern (−6) and correction pattern (−4) is better in determining the boundary C1B3 and boundary C2B3 in the lower portion of the correction pattern.

In such a situation, if the direction of the determination order of the boundary in the upper portion of the correction pattern (see circled number 1 in FIG. 27) and the direction of the determination order of the boundary in the lower portion of the correction pattern (see circled number 3 in FIG. 27) are coincided, the correction patterns located on the left side are selected, that is, the correction pattern (0) and correction pattern (−6) are selected. As a result, the median value is calculated as "−3", and the DC component carrying error is evaluated lower than the actual DC component carrying error.

Based on this, in the present embodiment, the boundary in the upper portion of the correction pattern is inspected from the left extremity in S121, and the boundary in the lower portion of the correction pattern is inspected from the right extremity in S123, thereby making the inspection order of the correction patterns reversed. As a result, the median value corresponding to the actual DC component carrying error can be calculated. Specifically, in the case of the present embodiment in which the correction pattern in which the boundary A1B1 and boundary A2B1 are the least visible and the correction pattern in which the boundary C1B3 and boundary C2B3 are the least visible are located on the opposite sides with respect to the correction pattern associated with the figure corresponding to the DC component carrying error, by inspecting the boundaries of the both patterns in the reversed orders, it is possible to calculate the median value corresponding to the actual DC component carrying error.

Other Embodiments

In the foregoing example, mainly the printer was described, but the disclosure of, for example, the printing apparatus, storing device, liquid ejection device, printing method, storing method, liquid ejection method, printing system, storing system, computer system, program, storing medium storing a program, manufacturing method of printing materials, is included.

Moreover, although a printer or the like is explained as an embodiment, the foregoing embodiment is for the purpose of elucidating the present invention, and is not to be interpreted as limiting the present invention. The invention can of course be altered and improved without departing from the gist thereof, and includes functional equivalents.

<Regarding the Inspection of the Boundary>

In the present embodiment, each boundary of the correction pattern is inspected by an inspection operator in charge of the inspection processes at the printer manufacturing plant. However, the user who has purchased the printer may cause the printer to print the test sheet, and perform the inspection of each boundary of the correction pattern.

Inspection of each boundary of the correction pattern may be performed using a sensor, not by human beings. For example, the test sheet may be read by the scanner. Also, the controller 60 may perform the inspection of the test sheet using the optical sensor 54 provided in the carriage 31 of the printer.

<Regarding the Shape of the Correction Pattern: 1>

In the foregoing embodiment, the sloping pattern B1 and sloping pattern B3 are formed integrally as the pattern B. However, this is not a limitation. For example, the sloping pattern B1 and the sloping pattern B3 may be formed separated from each other without forming the rectangular pattern B2.

<Regarding the Shape of the Correction Pattern: 2>

In the foregoing embodiment, two boundaries are formed in the upper portion of the correction pattern, and two boundaries are formed in the lower portion of the correction pattern. However, the shape of the correction pattern is not limited to this.

Figure 28:
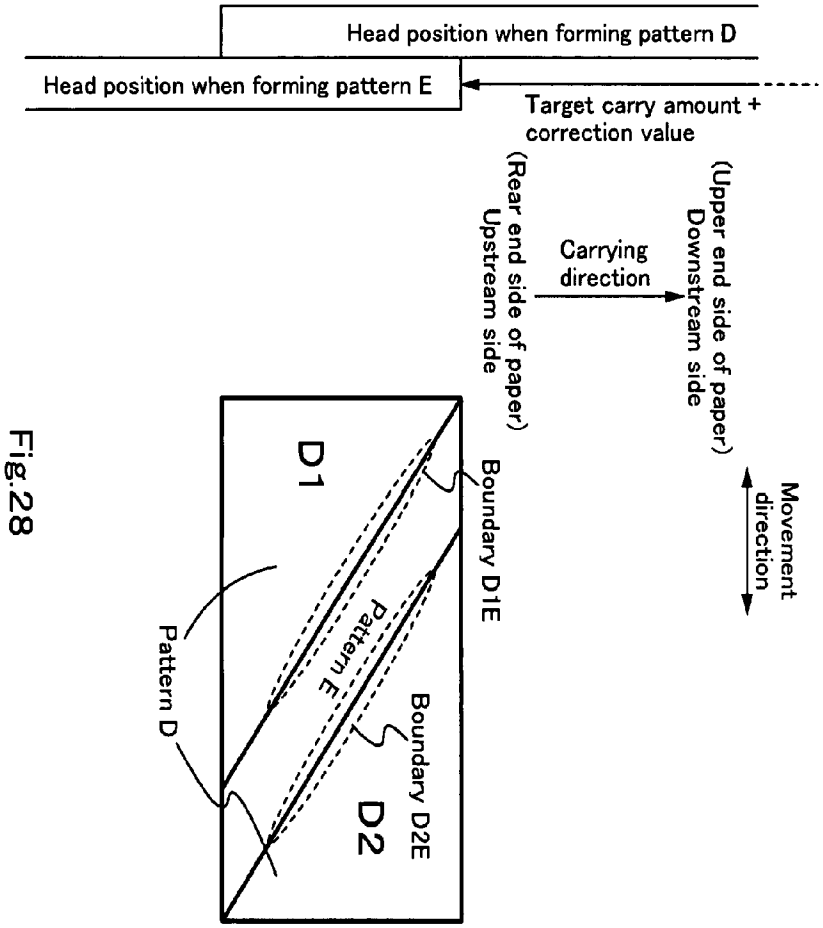
FIG. 28 is an explanatory diagram of the correction pattern of the other embodiment.

FIG. 28 is an exemplary diagram of the correction pattern of another embodiment. This correction pattern is constituted by a pattern D and a pattern E, and has a substantial rectangle shape as a whole.

The pattern D is constituted by a triangle pattern D1 and an inversed triangle pattern D2. The right extremity position in the movement direction of a plurality of raster lines that constitute the triangle pattern D1 gradually changes by 4/360 inches at a time, as the above described trapezoid A1. Accordingly, when the triangle pattern D1 is viewed macroscopically, a diagonal side that intersects both the carrying direction and the movement direction is formed as one side of the triangle pattern D1. Also, the right extremity position in the movement direction of a plurality of raster lines that constitute the inverted triangle pattern D2 gradually changes by 4/360 inches at a time, as in the inversed trapezoid pattern A2 described above. Accordingly, when the inverted triangle pattern D2 is viewed macroscopically, a diagonal side that intersects both the carrying direction and the movement direction is formed as one side of the inversed triangle pattern D2.

The pattern E has a shape of a parallelogram. The right extremity and left extremity positions in the movement direction of a plurality of raster lines that constitute the pattern E gradually change by 4/360 inches at a time, respectively, as in the sloping pattern B1 described above. As a result, the pattern E has two sides that are parallel to the diagonal sides of the above-described triangle pattern D1 and inverted triangle pattern D2.

The pattern D is formed by the nozzles of the head on the carrying direction upstream side. Thereafter, the paper is carried substantially by the target carry amount. The carry amount at this time varies depending on the correction value associated with the correction pattern. If the associated correction value is a minus figure, the carrying process is performed by a carry amount smaller than the target carry amount, and if the associated correction value is a plus figure, the carrying process is performed by a carry amount larger than the target carry amount. After carrying, the pattern E is formed by the nozzles on the carrying direction downstream side. In this way, a boundary D1E is formed between the triangle pattern D1 and pattern E, and a boundary D2E is formed between the inverted triangle pattern D2 and pattern E.

Figure 29:
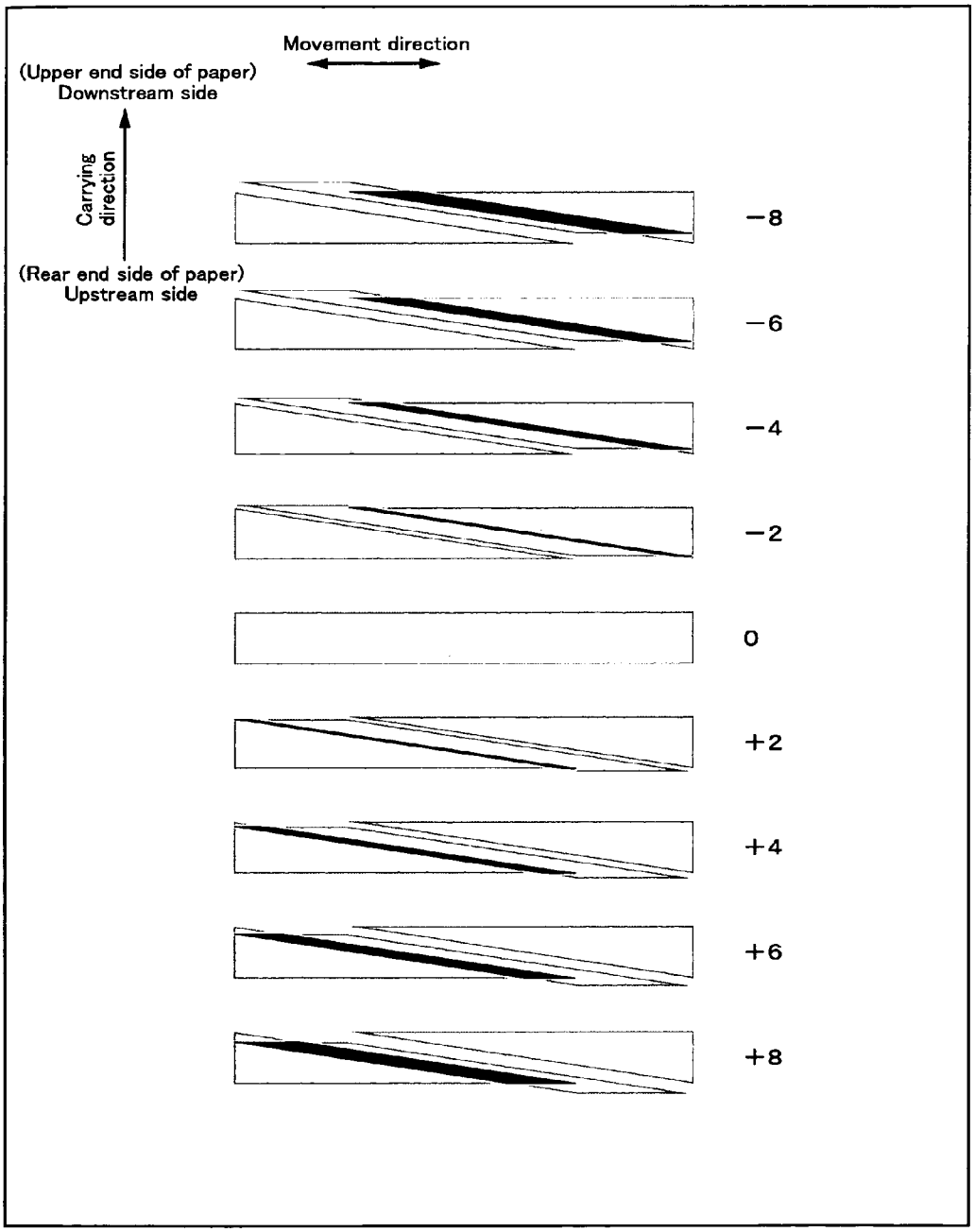
FIG. 29 is an explanatory diagram of the nine correction patterns of another embodiment.

FIG. 29 is an explanatory diagram of nine correction patterns of this embodiment. It is assumed that the carrying error is not present.

In such a case, in the correction pattern (0) for which the paper is carried by the target carry amount, the boundary D1E and boundary D2E cannot be recognized. In the correction patterns associated with a minus figure, the pattern E is formed shifted to the carrying direction downstream side with respect to the pattern D. Therefore, a white streak appears at the boundary D1E and a black streak appears at the boundary D2E. On the other hand, in the correction patterns associated with a plus figure, the pattern E is formed shifted to the carrying direction upstream side with respect to the pattern D. Therefore, a black streak appears at the boundary D1E and a white streak appears at the boundary D2E. If the inspection operator selects the correction pattern in which the boundary cannot be recognized as the optimal correction pattern, the correction value corresponding to the target carry amount can be determined.

In such a correction pattern as well, the boundary is made up of a plurality of raster lines that constitute one of the patterns and a plurality of raster lines that constitute the other pattern. Therefore, even if variance is present in the position in the carrying direction of the raster lines, it is possible to determine whether the black streak or white streak is present at the boundary in a stable manner.

<Regarding the Shape of the Correction Pattern: 3>

In the foregoing embodiment, two boundaries (boundary A1B1 and boundary A2B1) are formed between the pattern A and pattern B, and at the two boundaries, the relation of the two patterns in terms of the carrying direction upstream and downstream sides is opposite.

However, there is no limitation to this. For example, the inverted trapezoid pattern A2 of the pattern A may be omitted and the number of the boundary between the pattern A and pattern B may be made one. Also, the trapezoid pattern C2 of the pattern C may be omitted and the number of the boundary between the pattern B and pattern C may be made one. In such a case as well, at least one of the white streak and black streak appears when the positional relation between the two patterns changes, based on which the state of the boundary can be inspected.

<Regarding the Shape of the Correction Pattern: 4>

In the foregoing embodiment, the boundary between the pattern A and pattern B extends along a direction that intersects the carrying direction and the movement direction. However, there is no limitation to this.

Figure 30A:
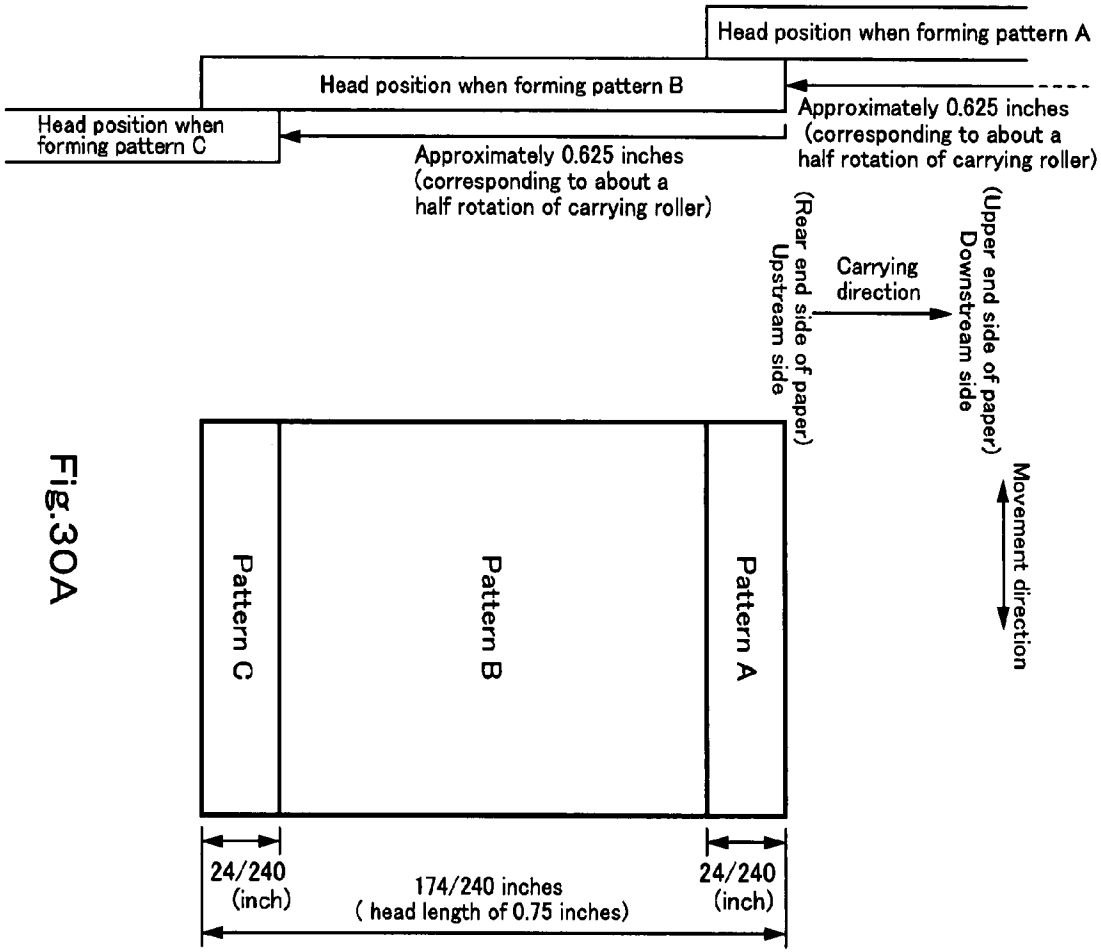
FIG. 30A is an explanatory diagram of the correction pattern of yet another embodiment of FIG. 30A.

FIG. 30A is an explanatory diagram of a correction pattern of yet another embodiment.

The pattern A of this correction pattern is formed by two passes with the nozzles #76 to #87, and is constituted by 24 raster lines of 160/320 inch long. The pattern B is formed by two passes with the nozzles #13 to #75, in a similar manner to the above-described rectangular pattern B2, and is constituted by 124 raster lines. The pattern C is formed by two passes with the nozzles #1 to #12, and is constituted by 24 raster lines of 160/320 inch long.

In this correction pattern, a boundary is formed between the pattern A that is formed by the nozzles on the carrying direction upstream side, and the upper portion of the pattern B that is formed by the nozzles on the carrying direction downstream side. Also in this correction pattern, a boundary is formed between the lower portion of the pattern B that is formed by the nozzles on the carrying direction upstream side and the pattern C that is formed by the nozzles on the carrying direction downstream side.

Figure 30B:
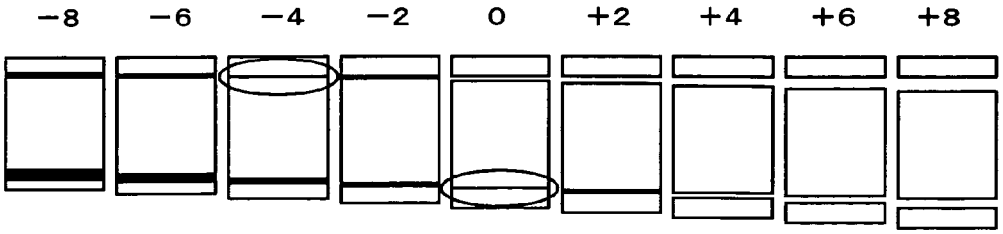
FIG. 30B is an explanatory diagram of the nine correction patterns of yet another embodiment.

FIG. 30B is an explanatory diagram of nine correction patterns of this embodiment. The interval between the pattern A and pattern C of the correction patterns varies depending on the figure associated with the correction patterns. The position in the carrying direction of the pattern B vertically changes as affected by the AC component carrying error.

In such a correction pattern as well, if the correction pattern in which the boundary between the pattern A and pattern B is optimal and the correction pattern in which the boundary between the pattern B and pattern C is optimal are selected, and the median value of the figures associated with the selected correction patterns is calculated, the median value represents a value that indicates the DC component carrying error. In this case, the correction pattern (−4) and correction pattern (0) are selected, the median value "−2" is obtained by calculation, and the correction value corresponding to this value is stored in the memory of the printer.

SUMMARY (1-1) In the foregoing embodiment, the circumferential length of the carry roller is 1.25 inches, and the length in the carrying direction of the nozzle row is 0.75 inches (1/120 inches×90 nozzles). Therefore, when forming the correction pattern for correcting the target carry amount corresponding to a single rotation of the carry roller, two patterns formed before and after the correction process according to the target carry amount are formed distant from each other (see FIG. 10A). For this reason, no boundary can be formed between the two patterns, and it is impossible to determine the interval between the two patterns.

Accordingly, in the present embodiment, the controller 60 of the printer first carries paper (an example of the medium) to a predetermined position in the carrying direction, and forms the pattern A (an example of the first pattern) with the nozzles #76 to #87 on the carrying direction upstream side (see FIGS. 10B, 14, and 18). Next, the controller 60 carries the paper in the carrying direction by a target carry amount approximately equal to 0.625 inches that is shorter than the length in the carrying direction of the nozzle row (see FIGS. 10B, 14 and 18). The target carry amount at that time differs in the correction patterns. The controller 60 forms the pattern B by forming the sloping pattern B1 that forms a boundary with the pattern A with the nozzles #1 to #12 on the carrying direction downstream side, as well as by forming the sloping pattern B3 with the nozzle #76 to #87 on the carrying direction upstream side (see FIGS. 10B, 14, 16 and 18). Thereafter, the controller 60 carries the paper by a target carry amount approximately equal to 0.625 inches that is shorter than the length in the carrying direction of the nozzle row so that the total carry amount after forming the pattern A is approximately 1.25 inches (see FIGS. 10B, 14 and 18). Then, the controller 60 forms the pattern C that forms a boundary with the sloping pattern B3 with the nozzles #1 to #12 on the carrying direction downstream side (see FIGS. 10B, 14, 17 and 18).

In the correction pattern in the test sheet prepared as described above, the boundary A1B1 and boundary A2B1 are formed between the pattern A and sloping pattern B1, and the boundary C1B3 and boundary C2B3 are formed between the pattern C and sloping pattern B3 (see FIGS. 14 and 19). Based on the states of these boundaries, the inspection operator can detect the carrying error that is generated when the paper is carried by a target carry amount that is longer than the length in the carrying direction of the nozzle row (target carry amount that corresponds to a single rotation of the carry roller) (see FIGS. 19 and 20B). In addition, based on the states of these boundaries, the inspection operator can determine the correction value for correcting the target carry amount that is longer than the length in the carrying direction of the nozzle row (target carry amount that corresponds to a single rotation of the carry roller).

(1-2) The foregoing embodiment is particularly effective for a case in which the paper is carried by rotating the carry roller, and the length in the carrying direction of the nozzle row is shorter than the length of the circumferential surface of the carry roller 23.

However, the case that can achieve the effects of the present embodiment is not limited to this. For example, the carry roller may not have a cylindrical shape, but a belt-like shape. In addition, the length in the carrying direction of the nozzle row may be longer than the length of the circumferential surface of the carry roller. In such cases as well, it is possible to form the correction pattern that is suitable for correcting the target carry amount that is longer than the length in the carrying direction of the nozzle row.

(1-3) In the foregoing embodiment, the target carry amount subject to the correction corresponds to a single rotation of the carry roller 23. Therefore, even if the AC component carrying error is present, the positional relation between the pattern A and pattern C is not affected by the rotation start position of the carry roller 23 when forming the pattern A. For this reason, with such a correction pattern, even if the AC component carrying error is present, it is possible to determine the correction value for correcting the DC component carrying error.

However, the target carry amount subject to the correction is not limited to this. For example, the target carry amount subject to the correction may be set to one and half rotations of the carry roller 23. In such a case as well, as long as no AC component carrying error is present, it is possible to determine the correction value for correcting the DC component carrying error.

(1-4) In the foregoing embodiment, the carry amount of the carrying process performed after the pattern A is formed until the formation of the pattern B is started corresponds to a half rotation of the carry roller 23. As a result, the carry amount of the carrying process performed after the pattern B is formed until the formation of the pattern C is started also corresponds to a half rotation of the carry roller 23. In this way, it is possible to form the boundary between the pattern A and pattern B and the boundary between the pattern B and pattern C substantially in the same shape.

However, the carry amount of the carrying process performed after the pattern A is formed until the formation of the pattern B is started is not limited to this. For example, the carry amount of the carrying process performed after the pattern A is formed until the formation of the pattern B is started may be more than a half rotation of the carry roller 23. However, in such a case, the width in the carrying direction of the pattern A or that of the sloping pattern B1 becomes short, and the visibility of the boundary A1B1 and boundary A2B1 is worse than the visibility of the boundary C1B3 and boundary C2B3.

(1-5) In the foregoing embodiment, the nozzles for forming the pattern A and the nozzles for forming the sloping pattern B3 are both the nozzles #76 to #87. In the foregoing embodiment, the nozzles for forming the sloping pattern B1 and the nozzles for forming the pattern C are both the nozzles #1 to #12. In this way, it is possible to form the boundary between the pattern A and pattern B and the boundary between the pattern B and pattern C substantially in the same shape.

However, there is no limitation to this. For example, the nozzles for forming the pattern A may be the nozzles #76 to #87, and the nozzles for forming the sloping pattern B3 may be the nozzles #76 to #90. However, in such a case, the visibility of the boundary A1B1 and boundary A2B1 is different from that of the boundary C1B3 and boundary C2B3. Considering the fact that in the present embodiment, the median value is calculated as shown in circled number 5 in FIG. 26, it is preferable that the both visibilities are equal.

(1-6) In the foregoing embodiment, both of the boundaries between the pattern A and pattern B and between the pattern B and pattern C are formed along a direction that intersects the movement direction (see FIGS. 12E, 12F, 13 and 14). In this way, even if the position in the carrying direction of the raster lines is inconsistent and the interval between the raster lines differs to some extent in each pattern, it is possible to determine the presence of the black streak or white streak at the boundary in a stable manner.

However, as shown in FIG. 30A, the boundary may be along the movement direction. Also in such a case, it is possible to form the correction pattern for correcting the target carry amount that is longer than the length in the carrying direction of the nozzle row. However, in such a case, if the interval between the raster lines constituting the respective patterns becomes inconsistent, portions recognized as a white streak or a black streak appear in each pattern. Thus it becomes difficult to determine the presence of the black streak or white streak at the boundary.

(1-7) In the foregoing embodiment, the direction of the boundary A1B1 and boundary A2B1 and the direction of the boundary C1B3 and boundary C2B3 intersect with each other (see FIGS. 13 and 14). In this way, it is possible to determine the correction value for correcting the DC component carrying error even if the ink ejection speed is different between the nozzles on the carrying direction upstream side and the nozzles on the carrying direction downstream side.

However, as shown in FIGS. 24A and 24B, for example, the boundary of the pattern A and pattern C and the boundary of the pattern B and pattern C may be parallel to each other. Also in such a case, as long as the ink ejection speed is not different between the nozzles on the carrying direction upstream side and the nozzles on the carrying direction downstream side, it is possible to determine the correction value for correcting the DC component carrying error.

(1-8) It is preferable to include all the structural elements of the foregoing embodiment, since all the effects can be achieved. However, if the correction pattern for correcting the target carry amount that is longer than the length in the carrying direction of the nozzle row is formed, it is not always necessary to include all the structural elements of the foregoing embodiment.

(1-9) In the foregoing embodiment, after the test sheet is printed, the correction value for the target carry amount is determined based on the boundary in the upper portion of the correction pattern and the boundary in the lower portion of the correction pattern. In this way, it is possible to determine the correction value for correcting the target carry amount that is longer than the length in the carrying direction of the nozzle row.

(1-10) In the foregoing embodiment, the controller 60 forms a plurality of the correction patterns and the inspection operator selects the correction pattern with the optimal boundary A1B1 and boundary A2B1, and the correction pattern with the optimal boundary C1B3 and boundary C2B3, and the correction value is determined (see FIG. 25).

However, the method for determining the correction value is not limited to this. For example, if the AC component carrying error is not present, the correction value can be determined based on the correction pattern (0) only. Specifically, if the state of the boundary of the correction pattern (0) is as shown in FIG. 20A, it is understood that the paper is carried by a carry amount larger than the target carry amount, and therefore the correction value for decreasing the target carry amount can be determined.

(1-11) In the foregoing embodiment, the numbers of the correction patterns are associated with predetermined correction values. In the foregoing embodiment, the median value of the number of the correction pattern selected in S122 and the number of the correction pattern selected in S124 is calculated (see FIG. 25), and the correction value is determined based on the median value. In this way, even if the AC component carrying error or the variance in ink ejection speed of the nozzles is present, it is possible to determine the correction value for correcting the DC component carrying error. The median value is not a limitation. For example, it is possible to correct the DC component carrying error to a certain extent if a value between the numbers of the selected correction patterns is used.

(1-12) In the foregoing embodiment, the boundary located in the upper portion of the correction pattern is inspected in order from the correction pattern on the extreme left. Thereafter, the boundary located in the lower portion of the correction pattern is inspected in order from the correction pattern on the extreme right (see FIGS. 25 and 26). This is because, if the direction of the determination order of the boundaries in the upper and lower portions of the correction patterns are coincided as shown in FIG. 27, the correction patterns on the left side are selected, and the DC component carrying error is evaluated lower than the actual DC component carrying error.

However, the inspection order is not limited to this. Even if the inspection is conducted as shown in FIG. 27, it is possible to correct the DC component carrying error.

(1-13) After the correction value is determined as described above, information on the correction value is stored in the memory of a printer that has printed the test sheet. When printing is performed at the place of the user who has purchased the printer, the controller 60 corrects the target carry amount based on the correction value, rotates the carry roller according to the corrected target carry amount, and carries paper. In this way, since the paper can be carried by a carry amount according to the target carry amount before correction, high quality printing can be performed.

(1-14) In the foregoing embodiment, in the inspection process at the printer manufacturing plant, a printer is connected to a computer for the inspection. Then the printer prints the test sheet, the inspection operator inspects the test sheet and inputs the inspection results in the computer for the inspection, and the computer stores the correction value in the memory of the printer. If a printer can independently print the test sheet without being connected to the computer for the inspection, and the inspection results can be directly input to the printer, it is not always necessary to connect the printer to the computer for the inspection.

It is also possible that the test sheet is not printed at the printer manufacturing plant, but is printed at the place of the user who has purchased the printer, to determine the correction value.

(1-15) The test sheet itself as well achieves an effect of detecting the carrying error when the target carry amount is longer than the length in the carrying direction of the nozzle row.

(2-1) In the foregoing embodiment, the printer prints nine correction patterns in the movement direction in order of the associated correction values. The inspection operator inspects the states of the white streak or black streak at the boundaries in the upper portion of the correction patterns (boundaries A1B1 and A2B1), and selects the correction pattern in which the white streak and black streak are the least visible. Further, the inspection operator inspects the states of the white streak or black streak at the boundaries in the lower portion of the correction patterns (boundaries C1B3 and C2B3), and selects the correction pattern in which the white streak and black streak are the least visible. The inspection operator calculates the median value of the numbers associated with the selected two correction patterns. Since the respective numbers of the correction patterns indicates the correction values associated with the respective correction patterns, the calculated median value is the value between the correction values associated with the selected correction patterns. In the foregoing embodiment, in this way, the correction value for correcting the DC component carrying error is determined (see FIGS. 25 and 26).

Incidentally, as shown in FIG. 27, depending on the condition of the AC component carrying error, in determining the boundary A1B1 and boundary A2B1 in the upper portion of the correction pattern, two or more correction patterns may become possible choices. Similarly, in determining the boundary C1B3 and boundary C2B3 in the lower portion of the correction pattern, two or more correction patterns may become possible choices. In such a case, if the correction patterns on the left side are preferentially selected as shown in FIG. 27, the DC component carrying error is evaluated lower than the actual DC component carrying error. In other words, in determining the correction value used for printing based on a value between the correction values that are respectively associated with two selected correction patterns, if the correction patterns on the left side are selected, the determined correction value is evaluated lower than the actual DC component carrying error.

In the present embodiment, initially, the boundaries in the upper portion of the correction pattern are inspected from the extreme left, and when two or more correction patterns become possible choices in determining the boundary A1B1 and boundary A2B1 in the upper portion of the correction pattern, the correction pattern on the left side is preferentially selected. Furthermore, the boundaries in the lower portion of the correction pattern are inspected in order from the extreme right, and when two or more correction patterns become possible choices in determining the boundary C1B3 and boundary C2B3 in the lower portion of the correction pattern, the correction pattern on the right side is preferentially selected. As a result, the median value corresponding to the actual DC component carrying error can be calculated.

(2-2) In the foregoing embodiment, the correction pattern is constituted by the pattern A (an example of the first pattern), the upper pattern of the pattern B (an example of the second pattern), the lower pattern of the pattern B (an example of the third pattern), and the pattern C (an example of the fourth pattern) (see FIGS. 14 and 30A). When selecting the initial correction pattern, the boundary between the pattern A and the upper pattern of the pattern B is inspected. When selecting the next correction pattern, the boundary between the lower pattern of the pattern B and the pattern C is inspected.

However, the constitution of the correction pattern is not limited to this. Any test sheet can determine the suitable correction value regardless of the constitution of the correction pattern as long as the correction value used in printing can be determined as a value between the correction values associated with the two selected correction patterns.

(2-3) In the foregoing embodiment, the controller 60 of the printer first carries paper (an example of the medium) to a predetermined position in the carrying direction, and forms the pattern A (an example of the first pattern) with the nozzles #76 to #87 on the carrying direction upstream side (see FIGS. 10B, 14, and 18). Next, the controller 60 carries the paper in the carrying direction by a target carry amount equal to approximately 0.625 inches that is shorter than the length in the carrying direction of the nozzle row (see FIGS. 10B, 14 and 18). The target carry amount at that time differs in each of the correction patterns. The controller 60 forms the pattern B by forming the sloping pattern B1 that forms a boundary with the pattern A with the nozzles #1 to #12 on the carrying direction downstream side, as well as by forming the sloping pattern B3 with the nozzle #76 to #87 on the carrying direction upstream side (see FIGS. 10B, 14, 16 and 18). Thereafter, the controller 60 carries the paper by a target carry amount equal to approximately 0.625 inches that is shorter than the length in the carrying direction of the nozzle row (see FIGS. 10B, 14, and 18). After that, the controller 60 forms the pattern C that forms a boundary with the sloping pattern B3 with the nozzles #1 to #12 on the carrying direction downstream side (see FIGS. 10B, 14, 17 and 18). With the correction pattern prepared in this manner, it is possible to determine the correction value corresponding to the target carry amount.

However, the purpose of the correction value associated with the correction pattern is not limited to this. The purpose of the correction value may not be the correction of the target carry amount, but the correction of the ink ejection timing, for example. In short, any test sheet can determine the suitable correction value regardless of the purpose of the correction pattern as long as the correction value used in printing is determined as a value between the correction values associated with the two selected correction patterns.

(2-4) In the foregoing embodiment, the carry amount of the paper after the pattern A is formed until the formation of the pattern C is started (approximately 1.25 inches) is longer than the length in the carrying direction of the nozzle row (approximately 0.75 inches). In such a case, the boundary cannot be formed between the pattern A and pattern C, and in the correction pattern shown in FIG. 10, it is impossible to determine the interval between the pattern A and pattern C. On the other hand, according to the present embodiment, it becomes possible to indirectly determine the positional relation between the pattern A and pattern C.

(2-5) In the foregoing embodiment, the nozzles for forming the pattern A and the nozzle for forming the sloping pattern B3 are both the nozzles #76 to #87. In the foregoing embodiment, the nozzles for forming the sloping pattern B1 and the nozzle for forming the pattern C are both the nozzles #1 to #12. In this way, it is possible to form the boundary between the pattern A and pattern B and the boundary between the pattern B and pattern C substantially in the same shape.

However, there is no limitation to this. For example, the nozzles for forming the pattern A may be the nozzles #76 to #87, and the nozzle for forming the sloping pattern B3 may be the nozzles #76 to #90. However, in such a case, the visibility of the boundary A1B1 and boundary A2B1 is different from that of the boundary C1B3 and boundary C2B3. Considering the fact that in the present embodiment, the median value is calculated as shown in circled number 5 in FIG. 26, it is preferable that the both visibilities are equal.

(2-6) In the foregoing embodiment, both of the boundary between the pattern A and pattern B and the boundary between the pattern B and pattern C are formed along a direction that intersects the movement direction (see FIGS. 12E, 12F, 13 and 14). In this way, even if the position in the carrying direction of the raster lines is inconsistent and the interval between the raster lines differs to some extent in the respective patterns, it is possible to determine the presence of the black streak and white streak at the boundary in a stable manner.

However, as shown in FIG. 30A, the boundary may be along the movement direction. Also in such a case, it is possible to form the correction pattern for correcting the target carry amount that is longer than the length in the carrying direction of the nozzle row. However, in such a case, if the interval between the raster lines constituting the respective patterns is inconsistent, portions recognized as a white streak or a black streak appear in the patterns. Thus it becomes difficult to determine the presence of the black streak and white streak at the boundary.

(2-7) In the foregoing embodiment, the direction of the boundary A1B1 and boundary A2B1 and the direction of the boundary C1B3 and boundary C2B3 intersect with each other (see FIGS. 13 and 14). In this way, it is possible to determine the correction value for correcting the DC component carrying error even if the ink ejection speed is different between the nozzles on the carrying direction upstream side and the nozzles on the carrying direction downstream side.

However, as shown in FIGS. 24A and 24B, the boundary between the pattern A and pattern B and the boundary between the pattern B and pattern C may be parallel to each other. Also in such a case, as long as the ink ejection speed is not different between the nozzles on the carrying direction upstream side and the nozzles on the carrying direction downstream side, it is possible to determine the correction value for correcting the DC component carrying error.

(2-8) In the foregoing embodiment, the inspection operator of the inspection process at the printer manufacturing plant conducts inspection of the boundaries of the correction patterns. However, the controller 60 may inspect the test sheet using the optical sensor 54 provided in the carriage 31 of the printer.

In such a case, when the boundaries in the upper portion of the correction pattern are inspected, the controller 60 moves the carriage 31 from the left to the right to inspect the density of the boundaries with the optical sensor 54. After it is detected that the density of the boundary has reached a predetermined threshold value while the sensor is moving, the controller 60 stores the number of the correction pattern inspected at that time in the memory and ends the inspection of the boundaries in the upper portion of the correction pattern. Then, the controller 60 moves the carriage 31 from the right to the left to inspect the density of the boundaries in the lower portion of the correction pattern with the optical sensor 54. After it is detected that the density of the boundary has reached a predetermined threshold value while the sensor is moving, the controller 60 stores the number of the correction pattern inspected at that time in the memory and ends the inspection of the boundaries in the lower portion of the correction pattern. Thereafter, the controller calculates the median value of the two numbers stored in the memory, and stores the calculated value as the correction value.

Such an embodiment is more advantageous because inspection of the boundaries can be finished in a shorter time.

(2-9) It is preferable to include all the structural elements of the foregoing embodiment, since all the effects can be achieved. However, it is not always necessary to include all the structural elements of the foregoing embodiment.

(2-10) After the correction value is determined as described above, information on the correction value is stored in the memory of a printer that has printed the test sheet. When printing is performed at the place of the user who has purchased the printer, the controller 60 corrects the target carry amount based on the correction value, rotates the carry roller according to the corrected target carry amount, and carries paper. In this way, since the paper can be carried by a carry amount according to the target carry amount before correction, high quality printing can be performed.

(3-1) When forming the correction patterns for correcting the target carry amount, two patterns are formed before and after the correction process corresponding to the target carry amount. The two block patterns are, when viewed microscopically, constituted by a plurality of raster lines formed by dots lined up in the movement direction. Accordingly, the boundary between the two block patterns is parallel to the raster line.

Incidentally, the raster line that constitutes each pattern is sometimes formed with its position in the carrying direction shifted due to variance in manufacturing of the nozzles, irregularity in the flying direction of ink or other reasons. As a result, the interval between a raster line and a raster line adjacent thereto may differ to some extent for each raster line.

When the interval between the raster lines is inconsistent, an area in which raster lines are formed close to each other so as to be recognized as a black streak, or an area in which raster lines are formed distant from each other so as to be recognized as a white streak may be present in the block pattern as well. Consequently, it becomes difficult to specify the boundary position. Even if the boundary position can be specified, it is difficult to determine whether the black streak or white streak is present at the boundary of the two patterns. In addition, depending on the inconsistency in the position in the carrying direction of the raster lines around the boundary, the presence of the black streak or white streak at the boundary is determined differently.

In the present embodiment, the controller 60 of the printer first carries paper (an example of the medium) to a predetermined position in the carrying direction, and forms the pattern A (an example of the first pattern) with the nozzles #76 to #87 on the carrying direction upstream side (see FIGS. 10B, 14, 15 and 18). Next, the controller 60 carries the paper in the carrying direction by a predetermined target carry amount (see FIGS. 10B, 14 and 18). The target carry amount at that time differs in each of the correction patterns. The controller 60 forms the pattern B by forming the sloping pattern B1 that forms a boundary with the pattern A with the nozzles #1 to #12 on the carrying direction downstream side (see FIGS. 10B, 14, 16 and 18). In the present embodiment, the boundary A1B1 and boundary A2B1 are formed between the pattern A and pattern B along a direction that intersects the carrying direction and the movement direction.

By forming the boundary in this way, the boundary is constituted by a plurality of raster lines that constitute one of the patterns, and a plurality of raster lines that constitute the other pattern. Therefore, even if the position in the carrying direction of the raster lines is inconsistent, the presence of the black streak or white streak at the boundary can be performed in a stable manner. That is, it becomes easier for the inspection operator to inspect the test sheet.

(3-2) In the present embodiment, the boundary A1B1 and boundary A2B1 are formed between the pattern A and pattern B. At the boundary A1B1, the trapezoid pattern A1 of the pattern A is located on the further carrying direction upstream side than the sloping pattern B1 of the pattern B. At the boundary A1B2, the sloping pattern B1 of the pattern B is located on the further carrying direction upstream side than the inverted trapezoid pattern A2 of the pattern A. By such a constitution, it becomes possible to cause both the white streak and black streak to appear at the boundary between the pattern A and pattern B, when the positional relation between the pattern A and pattern B changes. This improves the visibility for the inspection operator.

However, the boundaries between the pattern A and pattern B are not limited to this. For example, there may be one boundary between the pattern A and pattern B, omitting the inversed trapezoid pattern A2 of the pattern A. In such a case as well, one of the white streak and black streak appears, based on which the state of the boundary can be inspected.

(3-3) In the present embodiment, the boundary A1B1 and boundary A2B1 are parallel to each other. Therefore, the white streak and black streak appear substantially in the same width regardless of the direction to which the positional relation between the pattern A and pattern B is shifted, and good visibility is achieved for the inspection operator.

However, the boundary A1B1 and boundary A2B1 may not be parallel to each other. The sloping angle of the two boundaries may be different from each other. In such a case as well, both the black streak and white streak appear at the boundaries between the pattern A and pattern B when the positional relation between the pattern A and pattern B is changed.

(3-4) In the foregoing embodiment, the circumferential length of the carry roller is 1.25 inches, and the length in the carrying direction of the nozzle row is 0.75 inches (1/120 inches×90 nozzles). Therefore, when forming the correction pattern for correcting the target carry amount corresponding to a single rotation of the carry roller, two patterns formed before and after the correction process according to the target carry amount are formed distant from each other (see FIG. 10A). For this reason, no boundary can be formed between the two patterns, and it is impossible to determine the interval between the two patterns.

Accordingly, in the present embodiment, the controller 60 of the printer first carries the paper (an example of the medium) to a predetermined position in the carrying direction, and forms the pattern A (an example of the first pattern) with the nozzles #76 to #87 on the carrying direction upstream side (see FIGS. 10B, 14, 15, and 18). Next, the controller 60 carries the paper in the carrying direction by a target carry amount equal to approximately 0.625 inches that is shorter than the length in the carrying direction of the nozzle row (see FIGS. 10B, 14, and 18). The target carry amount at that time differs in each of the correction patterns. The controller 60 forms the pattern B by forming the sloping pattern B1 that forms a boundary with the pattern A with the nozzles #1 to #12 on the carrying direction downstream side, as well as by forming the sloping pattern B3 with the nozzle #76 to #87 on the carrying direction upstream side (see FIGS. 10B, 14, 16, and 18). Thereafter, the controller 60 carries the paper by a target carry amount equal to approximately 0.625 inches that is shorter than the length in the carrying direction of the nozzle row so that the total carry amount after forming the pattern A is approximately 1.25 inches (see FIGS. 10B, 14, and 18). Then, the controller 60 forms the pattern C that forms a boundary with the sloping pattern B3 with the nozzles #1 to #12 on the carrying direction downstream side (see FIGS. 10B, 14, 17, and 18).

The correction pattern on the test sheet prepared as described above, the boundary A1B1 and the boundary A2B1 are formed between the pattern A and sloping pattern B1, and the boundary C1B3 and boundary C2B3 are formed between the pattern C and sloping pattern B3 (see FIGS. 14, and 19). Based on the states of these boundaries, the inspection operator can detect the carrying error that is generated when the paper is carried by a target carry amount that is longer than the length in the carrying direction of the nozzle row (target carry amount that corresponds to a single rotation of the carry roller) (see FIGS. 19, and 20B). In addition, based on the states of these boundaries, the inspection operator can determine the correction value for correcting the target carry amount that is longer than the length in the carrying direction of the nozzle row (target carry amount that corresponds to a single rotation of the carry roller).

However, in cases other than the case described above, the boundaries between the two patterns may be formed along a direction that intersects the carrying direction and the movement direction. Also, if the length of the target carry amount subject to correction is shorter than the length in the carrying direction of the nozzle row, it is sufficient merely to form two patterns in the correction pattern.

(3-5) The foregoing embodiment is particularly effective for a case in which the paper is carried by rotating the carry roller, and the length in the carrying direction of the nozzle row is shorter than the length of the circumferential surface of the carry roller 23.

However, the case that can achieve the effects of the present embodiment is not limited to the above. For example, the carry roller may not have a cylindrical shape, but a belt-like shape. In addition, the length in the carrying direction of the nozzle row may be longer than the length of the circumferential surface of the carry roller.

(3-6) In the foregoing embodiment, the target carry amount subject to the correction corresponds to a single rotation of the carry roller 23. Therefore, even if the AC component carrying error is present, the positional relation between the pattern A and pattern C is not affected by the rotation start position of the carry roller 23 when forming the pattern A. For this reason, with such a correction pattern, even if the AC component carrying error is present, it is possible to determine the correction value for correcting the DC component carrying error.

However, the target carry amount subject to the correction is not limited to this. For example, the target carry amount subject to the correction may be set to one and half rotations of the carry roller 23. In such a case as well, as long as no AC component carrying error is present, it is possible to determine the correction value for correcting the DC component carrying error.

(3-7) In the foregoing embodiment, the carry amount of the carrying process performed after the pattern A is formed until the formation of the pattern B is started corresponds to a half rotation of the carry roller 23. As a result, the carry amount of the carrying process performed after the pattern B is formed until the formation of the pattern C is started also corresponds to a half rotation of the carry roller 23. In this way, it is possible to form the boundary between the pattern A and pattern B and the boundary between the pattern B and pattern C substantially in the same shape.

However, the carry amount of the carrying process performed after the pattern A is formed until the formation of the pattern B is started is not limited to this. For example, the carry amount of the carrying process performed after the pattern A is formed until the formation of the pattern B is started may correspond to more than a half rotation of the carry roller 23. However, in such a case, the width in the carrying direction of the pattern A or that of the sloping pattern B1 becomes short, and the visibility of the boundary A1B1 and boundary A2B1 is worse than the visibility of the boundary C1B3 and boundary C2B3.

(3-8) In the foregoing embodiment, the nozzles for forming the pattern A and the nozzles for forming the sloping pattern B3 are both the nozzles #76 to #87. In the foregoing embodiment, the nozzles for forming the sloping pattern B1 and the nozzles for forming the pattern C are both the nozzles #1 to #12. In this way, it is possible to form the boundary between the pattern A and pattern B and the boundary between the pattern B and pattern C substantially in the same shape.

However, there is no limitation to this. For example, the nozzles for forming the pattern A may be the nozzles #76 to #87, and the nozzle for forming the sloping pattern B3 may be the nozzles #76 to #90. However, in such a case, the visibility of the boundary A1B1 and boundary A2B1 is different from that of the boundary C1B3 and boundary C2B3. Considering the fact that in the present embodiment, the median value is calculated as shown in circled number 5 in FIG. 26, it is preferable that the both visibilities are equal.

(3-9) In the foregoing embodiment, the direction of the boundary A1B1 and boundary A2B1 and the direction of the boundary C1B3 and boundary C2B3 intersect with each other (see FIGS. 13 and 14). In this way, it is possible to determine the correction value for correcting the DC component carrying error even if the ink ejection speed is different between the nozzles on the carrying direction upstream side and the nozzles on the carrying direction downstream side.

However, as shown in FIGS. 24A and 24B, the direction of the boundary of the pattern A and pattern C and the direction of the boundary of the pattern B and pattern C may be parallel to each other. Also in such a case, as long as the ink ejection speed is not different between the nozzles on the carrying direction upstream side and the nozzles on the carrying direction downstream side, it is possible to determine the correction value for correcting the DC component carrying error.

(3-10) It is preferable to include all the structural elements of the foregoing embodiment, since all the effects can be achieved. However, in order to simply improve the visibility of the boundaries between the two patterns, it is not always necessary to include all the structural elements of the foregoing embodiment.

(3-11) In the foregoing embodiment, after the test sheet is printed, the correction value for the target carry amount is determined based on the boundaries. Due to good visibility of the boundaries, the inspection operator can determine the correction value easily.

In the foregoing embodiment, the controller 60 forms a plurality of the correction patterns and the inspection operator selects the correction pattern with the optimal boundary A1B1 and boundary A2B1, and selects the correction pattern with the optimal boundary C1B3 and boundary C2B3, and the correction value is determined (see FIG. 25).

However, the method for determining the correction value is not limited to this. For example, if the AC component carrying error is not present, the correction value can be determined based on the correction pattern (0) only. Specifically, if the state of the boundary of the correction pattern (0) is as shown in FIG. 20A, since it is understood that the paper is carried by a carry amount larger than the target carry amount, the correction value for decreasing the target carry amount can be determined.

In addition, in the foregoing embodiment, the numbers of the correction patterns are associated with predetermined correction values. In the foregoing embodiment, the median value of the number of the correction pattern selected in S122 and the number of the correction pattern selected in S124 is calculated (see FIG. 25), and the correction value is determined based on the median value. In this way, even if the AC component carrying error or variance in the ink ejection speed of the nozzles is present, it is possible to determine the correction value for correcting the DC component carrying error. The median value is not a limitation. For example, it is possible to correct the DC component carrying error to certain extent if a value between the numbers of the selected correction patterns is used.

Further, in the foregoing embodiment, the boundary located in the upper portion of the correction pattern is inspected in order from the correction pattern on the extreme left. Thereafter, the boundary located in the lower portion of the correction pattern is inspected in order from the correction pattern on the extreme right (see FIGS. 25 and 26). This is because, if the direction of the determination order of the boundaries in the upper and the lower portions of the correction patterns are coincided as shown in FIG. 27, the correction patterns on the left side are selected, and the DC component carrying error is evaluated lower than the actual DC component carrying error.

However, the inspection order is not limited to this. Even if the inspection is performed as shown in FIG. 27, it is possible to correct the DC component carrying error.

(3-12) After the correction value is determined as described above, information on the correction value is stored in the memory of a printer that has printed the test sheet. When printing is performed at the place of the user who has purchased the printer, the controller 60 corrects the target carry amount based on the correction value, rotates the carry roller according to the corrected target carry amount, and carries paper. In this way, since the paper can be carried by a carry amount according to the target carry amount before correction, high quality printing can be performed.

(3-13) In the foregoing embodiment, in the inspection process at the printer manufacturing plant, a printer is connected to a computer for the inspection. Then the printer prints the test sheet, the inspection operator inspects the test sheet and inputs the inspection results in the computer for the inspection to store the correction value in the memory of the printer. If a printer can independently print the test sheet without being connected to the computer for the inspection, and the inspection results can be directly input to the printer, it is not always necessary to connect the printer to the computer for the inspection.

It is also possible that the test sheet is not printed at the printer manufacturing plant, but at the place of the user who has purchased the printer, and the correction value is determined.

(3-14) The above-described test sheet as well achieves an effect of realizing good visibility of the two patterns.

What is claimed is:

1. A method for determining a correction value, comprising:

printing a plurality of correction patterns along a predetermined direction in order of associated correction values;

selecting a first correction pattern from among a plurality of the correction patterns based on results obtained by inspecting a part of each of the correction patterns;

selecting a second correction pattern from among a plurality of the correction patterns based on results obtained by inspecting a part other than the part of each of the correction patterns; and determining a correction value used in printing that is a value between a correction value associated with the first correction pattern and a correction value associated with the second correction pattern, wherein if two or more correction patterns become possible choices in selecting the first correction pattern, a correction pattern on one end's side of the predetermined direction is preferentially selected, and if two or more correction patterns become possible choices in selecting the second correction pattern, a correction pattern on the other end's side of the predetermined direction is preferentially selected.

2. A method for determining a correction value according to claim 1, wherein the correction pattern is constituted by a first pattern, a second pattern, a third pattern, and a fourth pattern, in selecting the first correction pattern, a boundary between the first pattern and the second pattern of each correction pattern is inspected, and in selecting the second correction pattern, a boundary between the third pattern and the fourth pattern of each correction pattern is inspected.

3. A method for determining a correction value according to claim 2, wherein when the correction pattern is printed, a medium is carried to a predetermined position in a carrying direction, the first pattern is formed on the medium with at least one nozzle on the carrying direction upstream side of a nozzle row constituted by a plurality of nozzles lined up at predetermined intervals, after forming the first pattern, the medium is carried in the carrying direction by a target carry amount that is shorter than the length in the carrying direction of the nozzle row, along with forming on the medium the second pattern that forms a boundary with the first pattern with at least one nozzle on the carrying direction downstream side of the nozzle row, the third pattern is formed on the medium with the at least one nozzle on the carrying direction upstream side of the nozzle row, after forming the second pattern, the medium is carried in the carrying direction by a target carry amount that is shorter than the length in the carrying direction of the nozzle row, and the fourth pattern that forms a boundary with the third pattern is formed on the medium with the at least one nozzle on the carrying direction downstream side of the nozzle row.

4. A method for determining a correction value according to claim 3, wherein a carry amount of the medium after the first pattern is formed until the formation of the fourth pattern is started is longer than the length in the carrying direction of the nozzle row.

5. A method for determining a correction value according to claim 3, wherein the at least one nozzle for forming the first pattern and the at least one nozzle for forming the third pattern are the same, and the at least one nozzle for forming the second pattern and the at least one nozzle for forming the fourth pattern are the same.

6. A method for determining a correction value according to claim 1, wherein the first pattern, the second pattern, the third pattern, and the fourth pattern are constituted by a plurality of dot rows, and the boundary is formed along a direction that intersects the direction of the dot rows.

7. A method for determining a correction value according to claim 6, wherein the direction of a boundary between the first pattern and the second pattern intersects the direction of a boundary between the third pattern and the fourth pattern.

8. A method for determining a correction value according to claim 1, wherein a sensor that can move in the predetermined direction is used for inspecting the part and the part other than the part of the correction pattern, and in selecting the first correction pattern, the sensor moves in one direction of the predetermined direction, and in selecting the second correction pattern, the sensor moves in a direction opposite to the predetermined direction.

9. A printing method comprising:

carrying a medium to a predetermined position in a carrying direction;

forming a first pattern made up of a plurality of dot rows along the movement direction with at least one nozzle on the carrying direction upstream side of a nozzle row that moves, by moving in a movement direction the nozzle row constituted by a plurality of nozzles lined up at predetermined intervals;

carrying the medium in the carrying direction by a predetermined target carry amount; and forming a second pattern made up of a plurality of dot rows along the movement direction with at least one nozzle on the carrying direction downstream side of the nozzle row that moves in the movement direction, wherein a boundary between the first pattern and the second pattern is formed along a direction that intersects the carrying direction and the movement direction.

10. A printing method according to claim 9, wherein a first boundary and a second boundary are formed between the first pattern and the second pattern, at the first boundary, the first pattern is located further carrying direction upstream side than the second pattern, and at the second boundary, the second pattern is located further carrying direction upstream side than the first pattern.

11. A printing method according to claim 10, wherein the first boundary and the second boundary are parallel to each other.

12. A printing method according to claim 9, wherein when the second pattern is formed, a third pattern is formed with the at least one nozzle on the carrying direction upstream side of the nozzle row, after forming the second pattern, the medium is carried in the carrying direction by a target carry amount that is shorter than the length in the carrying direction of the nozzle row so that a carry amount of the medium after forming the first pattern is longer than the length in the carrying direction of the nozzle row, and a fourth pattern that forms a boundary with the third pattern is formed on the medium with the at least one nozzle on the carrying direction downstream side of the nozzle row.

13. A printing method according to claim 12, wherein a carry roller is rotated when the medium is carried, and the length in the carrying direction of the nozzle row is shorter than the length of a circumferential surface of the carry roller.

14. A printing method according to claim 12, wherein a carry roller is rotated when the medium is carried, and a carry amount of the medium after the first pattern is formed until formation of the third pattern is started corresponds to substantially a single rotation of the carry roller.

15. A printing method according to claim 14, wherein a carry amount of the medium after the first pattern is formed until formation of the second pattern is started corresponds to substantially a half rotation of the carry roller.

16. A printing method according to claim 9, wherein the at least one nozzle for forming the first pattern is the same as the at least one nozzle for forming the third pattern, and the at least one nozzle for forming the second pattern is the same as the at least one nozzle for forming the fourth pattern.

17. A printing method according to claim 9, wherein the boundary between the third pattern and the fourth pattern is formed along a direction that intersects the carrying direction and the movement direction, and the direction of the boundary between the first pattern and the second pattern intersects the direction of the boundary between the third pattern and the fourth pattern.

18. A printing method according to claim 9, wherein a correction value for a target carry amount is determined based on the boundary between the first pattern and the second pattern, and the boundary is formed along a direction that intersects the carrying direction and the movement direction.

19. A printing method according to claim 9, wherein a correction value for a target carry amount is determined based on the boundary between the first pattern and the second pattern, when the medium is carried to perform printing, a target carry amount is corrected and the medium is carried according to the corrected target carry amount, and the boundary is formed along a direction that intersects the carrying direction and the movement direction.

20. A printing system comprising:

a carry unit for carrying a medium to a predetermined position in a carrying direction; and a controller that causes the carry unit to carry the medium according to a target carry amount, and that causes ink to be ejected from a nozzle row constituted by a plurality of nozzles lined up at predetermined intervals, wherein the controller causes to form a first pattern made up of a plurality of dot rows along the movement direction with at least one nozzle on the carrying direction upstream side of the nozzle row that moves, by causing the nozzle row to move in a movement direction, causes to carry the medium in the carrying direction by a predetermined target carry amount, and causes to form a second pattern made up of a plurality of dot rows along the movement direction with at least one nozzle on the carrying direction downstream side of the nozzle row that moves in the movement direction, and wherein a boundary between the first pattern and the second pattern is caused to be formed along a direction that intersects the carrying direction and the movement direction.

* * * * *